US008102345B2

(12) United States Patent
Hashimoto

(10) Patent No.: US 8,102,345 B2
(45) Date of Patent: Jan. 24, 2012

(54) METHOD OF DRIVING A COLOR LIQUID CRYSTAL DISPLAY AND DRIVER CIRCUIT FOR DRIVING THE DISPLAY AS WELL AS PORTABLE ELECTRONIC DEVICE WITH THE DRIVER CIRCUIT

(75) Inventor: Yoshiharu Hashimoto, Tokyo (JP)

(73) Assignee: Renesas Electronics Corporation, Kanagawa (JP)

( * ) Notice: Subject to any disclaimer, the term of this patent is extended or adjusted under 35 U.S.C. 154(b) by 966 days.

(21) Appl. No.: 12/050,832

(22) Filed: Mar. 18, 2008

(65) Prior Publication Data

US 2008/0165104 A1 Jul. 10, 2008

Related U.S. Application Data

(63) Continuation of application No. 10/051,567, filed on Jan. 18, 2002, now abandoned.

(30) Foreign Application Priority Data

Jan. 19, 2001 (JP) ..... 2001-012540

(51) Int. Cl.
*G09G 3/36* (2006.01)

(52) U.S. Cl. ..... 345/89; 345/88; 345/100; 345/204; 345/690; 345/691; 713/320; 713/340

(58) Field of Classification Search ..... 345/89, 345/690, 88, 100, 204, 691; 713/320, 340
See application file for complete search history.

(56) References Cited

U.S. PATENT DOCUMENTS

| | | | | |
|---|---|---|---|---|
| 5,414,443 | A | 5/1995 | Kanatani et al. | |
| 5,886,689 | A * | 3/1999 | Chee et al. | 345/212 |
| 6,166,725 | A * | 12/2000 | Isami et al. | 345/209 |
| 6,340,970 | B1 | 1/2002 | Furuhashi et al. | |
| 6,384,807 | B1 | 5/2002 | Furuhashi et al. | |
| 6,452,579 | B1 | 9/2002 | Itoh et al. | |
| 6,563,482 | B1 | 5/2003 | Yamazaki et al. | |

FOREIGN PATENT DOCUMENTS

| | | |
|---|---|---|
| EP | 0 479 304 A2 | 4/1992 |
| JP | 4-165329 | 6/1992 |
| JP | 6-161392 | 6/1994 |
| JP | 7-325556 | 12/1995 |

(Continued)

OTHER PUBLICATIONS

U.S. Office Action dated Mar. 1, 2011 from U.S. Appl. No. 11/407,803.

*Primary Examiner* — Lun-Yi Lao
*Assistant Examiner* — Insa Sadio
(74) *Attorney, Agent, or Firm* — Scully, Scott, Murphy & Presser, P.C.

(57) ABSTRACT

The present invention provides a method and a circuit for driving a color liquid crystal display in a normal driving mode and a power saving mode, wherein in the normal driving mode, voltages corresponding to image display data are applied to data electrodes of the color liquid crystal display, and wherein in the power saving mode, voltages corresponding to highly significant bit signals of the image display data are applied as display data signals to the data electrodes.

10 Claims, 23 Drawing Sheets

FOREIGN PATENT DOCUMENTS

| | | |
|---|---|---|
| JP | 8-76726 | 3/1996 |
| JP | 2695981 | 9/1997 |
| JP | 10-187106 | 7/1998 |
| JP | 11-95729 | 4/1999 |
| JP | 11-282421 | 10/1999 |
| JP | 2000-250494 | 9/2000 |
| JP | 2001-188499 | 7/2001 |

* cited by examiner

METHOD OF DRIVING A COLOR LIQUID CRYSTAL DISPLAY AND DRIVER CIRCUIT FOR DRIVING THE DISPLAY AS WELL AS PORTABLE ELECTRONIC DEVICE WITH THE DRIVER CIRCUIT

CROSS REFERENCE TO RELATED APPLICATION

The present application is a continuation application of Ser. No. 10/051,567 dated Jan. 18, 2002.

BACKGROUND OF THE INVENTION

1. Field of the Invention

The present invention relates to a method of driving a liquid crystal display and a driver circuit for driving the liquid crystal display as well as an electronic device with the driver circuit, and more particularly to an improvement of the driver circuit and the driving method for driving a color liquid crystal display with a relatively small display screen in a line inversion driving system or in a frame inversion driving system at a reduced power consumption.

2. Description of the Related Art

The liquid crystal display has been applied to various electronic devices such as note-type computers, palm-type computers, pocket-type computers, mobile terminals such as personal digital assistants, mobile phones, and personal handyphone systems. The advanced liquid crystal display is a color liquid crystal display.

FIG. 1 is a block diagram illustrative of a first conventional driver circuit for driving a color liquid crystal display. A color liquid crystal display 1 may be driven by an active matrix driving system using thin film transistors as switching devices. The color liquid crystal display 1 includes a plurality of scanning lines or gate lines which extend parallel to each other in a column direction at a constant pitch, and a plurality of data lines or source lines which extend parallel to each other in a row direction at another constant pitch, as well as a two-dimensional matrix array of pixels, each of which is positioned in an area defined by adjacent two of the scanning lines and adjacent two of the data lines.

Each of the pixels further includes a liquid crystal cell as an equivalent capacitive load, a common electrode, a thin film transistor for driving the liquid crystal cell, and a data electrode for storing data charge in a vertical synchronizing term. A gate electrode of the thin film transistor is connected to the scanning line. The gate electrode of the thin film transistor serves as a scanning electrode.

The color liquid crystal display 1 may be driven as follows. The common electrode is applied with a common potential Vcom. The data electrode is applied with data signals, wherein the data signals may include data red signals, data green signals and data blue signals, which have been generated from red data $D_R$, green data $D_G$, and blue data $D_B$ as digital image data. The scanning electrode is applied with a scanning signal which has been generated from a horizontal synchronizing signal $S_H$ and a vertical synchronizing signal $S_V$.

The following description with reference to FIG. 1 will be made assuming that the color liquid crystal display 1 is a normally white type color liquid crystal display which is high in transitivity under no voltage application.

The driver circuit for driving the color liquid crystal display 1 mainly includes a control circuit 2, a gray scale power supply 3, a common power supply 4, a data electrode driver circuit 5, and a scanning electrode driver circuit 6.

The control circuit 2 may, for example, comprise an application specific integrated circuit (ASIC). The control circuit 2 receives parallel inputs of red data $D_R$ of 6-bits, green data $D_G$ of 6-bits and blue data $D_B$ of 6-bits. The control circuit 2 converts the red data $D_R$, green data $D_G$ and blue data $D_B$ into 18-bits display data D00-D05, D10-D15 and D20-D25 respectively, and outputs the 18-bits display data. The 18-bits display data outputted from the control circuit 2 are supplied to the data electrode driver circuit 5.

The control circuit 2 also receives further inputs of a dot-clock signal DCLK, a horizontal synchronizing signal $S_H$, and a vertical synchronizing signal $S_V$, so that the control circuit 2 generates a strobe signal STB, a clock signal CLK, a horizontal start pulse signal STH, a vertical start pulse signal STV, a polarity signal POL, a data inversion signal INV from the dot-clock signal DCLK, the horizontal synchronizing signal $S_H$, and the vertical synchronizing signal $S_V$. The strobe signal STB, the clock signal CLK, the horizontal start pulse signal STH and the data inversion signal INV are supplied to the data electrode driver circuit 5. The polarity signal POL is supplied to the gray scale power supply 3 and the common power supply 4. The vertical start pulse signal STV is supplied to the scanning electrode driver circuit 6.

The strobe signal STB has the same cycle as the horizontal synchronizing signal $S_H$. The clock signal CLK may be either identical with or different in frequency from the dot-clock signal DCLK. The clock signal CLK may be used for allowing shift registers in the data electrode driver circuit 5 to generate sampling pulse signals SP1-SP176 from the horizontal start pulse signal STH.

The horizontal start pulse signal STH is identical in cycle to the horizontal synchronizing signal $S_H$, and delayed from the strobe signal STB by a time corresponding to a few pulses of the clock signal CLK. The polarity signal POL is inverted in a single line unit or in a single horizontal synchronizing cycle for alternating current driving of the color liquid crystal display 1. The vertical start pulse signal STV has the same cycle as the vertical synchronizing signal $S_V$.

The data inversion signal INV is used for the purpose of reducing the power which is consumed by the control circuit 2. If the current 18-bits display data D00-D05, D10-D15 and D20-D25 has at least 10-inverted bits from the previous 18-bits display data, the data inversion signal INV is inverted in synchronizing with the clock signal CLK, instead of inversions of the current 18-bits display data D00-D05, D10-D15 and D20-D25 for the following reasons.

It is general that the control circuit 2 and the gray scale power supply 3 are integrated over a printed board, whilst the data electrode driver circuit 5 is mounted as a tape carrier package (TCP) over a film tape carrier which provides an electrical connection between the printed board and the color liquid crystal display 1. The printed board is mounted at an upper portion on a back face of a back light which is attached to the color liquid crystal display 1.

18-signal lines are provided on the film carrier tape for transmitting the 18-bits display data D00-D05, D10-D15 and D20-D25 from the control circuit 2 to the data electrode driver circuit 5. The 18-signal lines have a line capacitance. In addition, the data electrode driver circuit 5 has an input capacitance of about 20 pF from the control circuit 2. A sufficient current for charging and discharging the line capacitance and the input capacitance would be needed if the polarity of the 18-bits display data D00-D05, D10-D15 and D20-D25 are inverted and supplied to the data electrode driver circuit 5 from the control circuit 2. For reducing the necessary charge and discharge currents to the line capacitance and the input capacitance, it is effective that the data inversion signal INV is inverted, instead of inversions of the 18-bits display data D00-D05, D10-D15 and D20-D25. The reduction of the charge and discharge currents results in a reduction in the power consumed by the control circuit 2.

FIG. 2 is a circuit diagram illustrative of a circuit configuration of a gray scale power supply in the driver circuit shown in FIG. 1. The gray scale power supply 3 includes a series connection of resistances 7-1, 7-2, 7-3, 7-4, 7-5, 7-6, 7-7, 7-8, 7-9, and 7-10, a first pair of switches 8-*a* and 8-*b*, a second pair of switches 9-*a* and 9-*b*, a single inverter 10, and voltage followers 11-1, 11-2, 11-3, 11-4, 11-5, 11-6, 11-7 11-8, and 11-9 as well as gray scale voltage input ports which receive gray scale voltages VI1, VI2, VI3, VI4, VI5, VI6, VI7, VI8 and VI9. The gray scale voltages VI1, VI2, VI3, VI4, VI5, VI6, VI7, VI8 and VI9 have been set for gamma-control.

The gray scale power supply 3 amplifies the gray scale voltages VI1, VI2, VI3, VI4, VI5, VI6, VI7, VI8 and VI9 and supplies the amplified gray scale voltages to the data electrode driver circuit 5. The polarity inversions of the gray scale voltages VI1, VI2, VI3, VI4, VI5, VI6, VI7, VI8 and VI9 between positive and negative potentials with reference to the common voltage Vcom applied to the common electrode are made based on the polarity signal POL in the single line unit.

The resistances 7-1, 7-2, 7-3, 7-4, 7-5, 7-6, 7-7, 7-8, 7-9, and 7-10 are different in resistance values from each other. The switch 8-*a* has a first terminal applied with a power voltage VDD and a second terminal connected to a first end of the series connection of the resistances 7-1, 7-2, 7-3, 7-4, 7-5, 7-6, 7-7, 7-8, 7-9, and 7-10, wherein the resistance 7-1 is connected directly to the second terminal of the switch 8-*a*. The switch 8-*a* also has a control terminal applied with the polarity signal POL. If the polarity signal POL is low level "L", then the switch 8-*a* is in OFF-state. If the polarity signal POL is high level "H", then the switch 8-*a* is in ON-state, whereby the power voltage VDD is applied to the first end of the series connection of the resistances 7-1, 7-2, 7-3, 7-4, 7-5, 7-6, 7-7, 7-8, 7-9, and 7-10.

The inverter 10 receives the polarity signal POL and generates an inverted polarity signal /POL. The switch 8-*b* has a first terminal grounded and a second terminal connected to the first end of the series connection of the resistances 7-1, 7-2, 7-3, 7-4, 7-5, 7-6, 7-7, 7-8, 7-9, and 7-10, wherein the resistance 7-1 is connected directly to the second terminal of the switch 8-*b*. The switch 8-*b* also has a control terminal connected to an output from the inverter 10 for receiving the inverted polarity signal /POL from the inverter 10. If the inverted polarity signal /POL is low level "L", then the switch 8-*b* is in OFF-state. If the inverted polarity signal /POL is high level "H", then the switch 8-*b* is in ON-state, whereby the ground potential GND is applied to the first end of the series connection of the resistances 7-1, 7-2, 7-3, 7-4, 7-5, 7-6, 7-7, 7-8, 7-9, and 7-10.

The switch 9-*a* has a first terminal grounded and a second terminal connected to a second end of the series connection of the resistances 7-1, 7-2, 7-3, 7-4, 7-5, 7-6, 7-7, 7-8, 7-9, and 7-10, wherein the resistance 7-10 is connected directly to the second terminal of the switch 9-*a*. The switch 9-*a* also has a control terminal applied with the polarity signal POL. If the polarity signal POL is low level "L", then the switch 9-*a* is in OFF-state. If the polarity signal POL is high level "H", then the switch 9-*a* is in ON-state, whereby the ground potential GND is applied to the second end of the series connection of the resistances 7-1, 7-2, 7-3, 7-4, 7-5, 7-6, 7-7, 7-8, 7-9, and 7-10.

The switch 9-*b* has a first terminal applied with the power voltage VDD and a second terminal connected to the second end of the series connection of the resistances 7-1, 7-2, 7-3, 7-4, 7-5, 7-6, 7-7, 7-8, 7-9, and 7-10, wherein the resistance 7-10 is connected directly to the second terminal of the switch 9-*b*. The switch 9-*b* also has a control terminal connected to the output from the inverter 10 for receiving the inverted polarity signal /POL from the inverter 10. If the inverted polarity signal /POL is low level "L", then the switch 9-*b* is in OFF-state. If the inverted polarity signal /POL is high level "H", then the switch 9-*b* is in ON-state, whereby the ground potential GND is applied to the second end of the series connection of the resistances 7-1, 7-2, 7-3, 7-4, 7-5, 7-6, 7-7, 7-8, 7-9, and 7-10.

The series connection of the resistances 7-1, 7-2, 7-3, 7-4, 7-5, 7-6, 7-7, 7-8, 7-9, and 7-10 has first to ninth nodes N1, N2, N3, N4, N5, N6, N7, N8 and N9, at which divided voltages V1, V2, V3, V4, V5, V6, V7, V8 and V9 are generated respectively if the first and second ends of the series connection are biased. The first to ninth nodes N1, N2, N3, N4, N5, N6, N7, N8 and N9 are connected to inputs of the voltage followers 11-1, 11-2, 11-3, 11-4, 11-5, 11-6, 11-7, 11-8 and 11-9 respectively, whereby the divided voltages V1, V2, V3, V4, V5, V6, V7, V8 and V9 are amplified by the voltage followers 11-1, 11-2, 11-3, 11-4, 11-5, 11-6, 11-7, 11-8 and 11-9 respectively.

If the polarity signal POL is the high level "H", then the first end of the series connection of the resistances 7-1, 7-2, 7-3, 7-4, 7-5, 7-6, 7-7, 7-8, 7-9, and 7-10 is applied with the power voltage VDD, whilst the second end thereof is applied with the ground voltage, whereby positive polarity divided voltages V1, V2, V3, V4, V5, V6, V7, V8 and V9 are generated at the first to ninth nodes N1, N2, N3, N4, N5, N6, N7, N8 and N9 respectively in accordance with respective ratios of the resistances 7-1, 7-2, 7-3, 7-4, 7-5, 7-6, 7-7, 7-8, 7-9, and 7-10, provided that VDD>V1>V2>V3>V4>V5>V6>V7>V8>V9>GND. The positive polarity divided voltages V1, V2, V3, V4, V5, V6, V7, V8 and V9 are then amplified by the voltage followers 11-1, 11-2, 11-3, 11-4, 11-5, 11-6, 11-7, 11-8 and 11-9 respectively to generate the first to ninth positive polarity gray scale voltages VI1, VI2, VI3, VI4, VI5, VI6, VI7, VI8 and VI9 which will subsequently be supplied to the data electrode driver circuit 5, provided that the VI1>VI2>VI3>VI4>VI5>VI6>VI7>VI8>VI9.

If the polarity signal POL is the low level "L", then the first end of the series connection of the resistances 7-1, 7-2, 7-3, 7-4, 7-5, 7-6, 7-7, 7-8, 7-9, and 7-10 is applied with the ground voltage, whilst the second end thereof is applied with the power voltage VDD, whereby negative polarity divided voltages V1, V2, V3, V4, V5, V6, V7, V8 and V9 are generated at the first to ninth nodes N1, N2, N3, N4, N5, N6, N7, N8 and N9 respectively in accordance with respective ratios of the resistances 7-1, 7-2, 7-3, 7-4, 7-5, 7-6, 7-7, 7-8, 7-9, and 7-10, provided that VDD<V1<V2<V3<V4<V5<V6<V7<V8<V9<GND. The negative polarity divided voltages V1, V2, V3, V4, V5, V6, V7, V8 and V9 are then amplified by the voltage followers 11-1, 11-2, 11-3, 11-4, 11-5, 11-6, 11-7, 11-8 and 11-9 respectively to generate the first to ninth negative polarity gray scale voltages VI1, VI2, VI3, VI4, VI5, VI6, VI7, VI8 and VI9 which will subsequently be supplied to the data electrode driver circuit 5, provided that VI1<VI2<VI3<VI4<VI5<VI6<VI7<VI8<VI9.

The common power supply 4 receives an input of the polarity signal "POL" from the control circuit 2 and supplies the common potential Vcom to the common electrode of the color liquid crystal display 1. If the polarity signal "POL" is in the high level "H", then the common power supply 4 sets the common potential Vcom at the ground level GND. If the polarity signal "POL" is in the low level "L", then the common power supply 4 sets the common potential Vcom at the power voltage level VDD.

The data electrode driver circuit 5 receives the strobe signal STB, the clock signal CLK, the horizontal start pulse signal STH and the data inversion signal INV in addition to the 18-bits display data D00-D05, D10-D15 and D20-D25 from the control circuit 2. The data electrode driver circuit 5 selects the gray scale voltages based on the 18-bits display data D00-D05, D10-D15 and D20-D25 under the controls by the strobe signal STB, the clock signal CLK, the horizontal start pulse signal STH and the data inversion signal INV. The data electrode driver circuit 5 applies the selected gray scale voltages to the data electrodes of the color liquid crystal display 1.

The scanning electrode driver circuit 6 receives the vertical start pulse signal STV from the control circuit 2, so that the scanning electrode driver circuit 6 generates, in sequence, the scanning signals and applies the scanning signals to the scanning electrodes of the color liquid crystal display 1.

FIG. 3 is a block diagram illustrative of the data electrode driver circuit shown in FIG. 1. It is assumed that a resolution of the color liquid crystal display 1 is defined by 176×220 pixels. Since each pixel comprises three-dots of red (R), green (G) and blue (B), then the color liquid crystal display 1 has a 528×220 dot-pixels.

The data electrode driver circuit 5 includes a shift register 12, a data buffer 13, a data register 14, a control circuit 15, a data latch 16, a gray scale voltage generating circuit 17, a gray scale voltage selecting circuit 18, and an output circuit 19.

The shift register 12 is a serial-in parallel-out shift register which comprises 176 delay-flip-flops. The shift register 12 receives the clock signal CLK and the horizontal start pulse signal STH from the control circuit 2, so that the shift register 12 shifts the horizontal start pulse signal STH in synchronizing with the clock signal CLK, and generates sampling pulses SP1, SP2, - - - SP176 which comprise a 176-bits parallel-out signal.

The data buffer 13 receives the 18-bits display data D00-D05, D10-D15 and D20-D25 and the data inversion signal INV from the control circuit 2, so that the data buffer 13 performs an inversion operation of the 18-bits display data in accordance with the data inversion signal INV, so that the data buffer 13 outputs 18-bits display data D'00-D'05, D'10-D'15 and D'20-D'25.

FIG. 4 is a partial circuit diagram illustrative of a part of the circuit configuration of the data buffer shown in FIG. 3. The data buffer 13 comprises first to eighteenth data buffer circuits 13*a*1, 13*a*2, 13*a*3, - - - 13*a*18, and a single control unit 13*b*. The control unit 13*b* includes two series connections of plural inverters. The two series connections of plural inverters in the control unit 13*b* receive the data inversion signal INV and the clock signal CLK from the control circuit 2 respectively, so that the control unit 13*b* delays the data inversion signal INV and the clock signal CLK from the control circuit 2 by predetermined delay times respectively, whereby the control unit 13*b* supplies a delayed clock signal CLK1 and a delayed data inversion signal INV1 to the first data buffer circuit 13*a*1.

The control unit 13*b* also supplies other delayed clock signals CLK2, CLK3, - - - CLK18 and other delayed data inversion signals INV2, INV3 - - - INV18 to the remaining second to eighteenth data buffer circuits 13*a*2, 13*a*3, - - - 13*a*18, respectively. The first to eighteenth data buffer circuits 13*a*1, 13*a*2, 13*a*3, - - - 13*a*18 have the same circuit configuration and perform the same operations, for which reason the following description will focus on the first data buffer circuit 13*a*1 only.

The first data buffer circuit 13*a*1 includes a D-flip-flop 20-1, inverters 21-1, 22-1 and 23-1, and a switching circuit 24-1. The switching circuit 24-1 comprises two parallel switches 24-1*a* and 24-1*b*. The control unit 13*b* supplies the delayed clock signal CLK1 to the D-flip-flop 20-1 and the delayed data inversion signal INV1 to the switching circuit 24-1.

The D-flip-flop 20-1 latches a single bit display data D00 in synchronizing with the clock signal CLK1 for a term corresponding to the single pulse width of the clock signal CLK1, and outputs the single bit display data D00. The inverter 21-1 inverts the single bit display data D00, so that the inverted bit display data D00 is supplied to the switch 24-1*b*. The non-inverted bit display data D00 outputted from the D-flip-flop 20-1 is also directly supplied to the switch 24-1*a*.

If the delayed data inversion signal INV1 from the control unit 13*b* is high level "H", then the switching circuit 24-1*a* is placed in the ON-state, whilst the switching circuit 24-1*b* is placed in the OFF-state, whereby the non-inverted bit display data D00 is transmitted through the series connection of the inverters 22-1 and 23-1 to an output terminal as the output bit display data D'00.

If the delayed data inversion signal INV1 from the control unit 13*b* is low level "L", then the switching circuit 24-1*a* is placed in the OFF-state, whilst the switching circuit 24-1*b* is placed in the ON-state, whereby the inverted bit display data D00 is transmitted through the series connection of the inverters 22-1 and 23-1 to the output terminal as the output single bit display data D'00.

With reference again to FIG. 3, the data register 14 receives the 18-bits display data D'00-D'05, D'10-D'5 and D'20-D'25 from the data buffer 13 and also receives the sampling pulses SP1, SP2, - - - SP176 from the shift register 12. In synchronizing with the sampling pulses SP1, SP2, - - - SP176, the data register 14 accepts the inputs of the 18-bits display data D'00-D'05, D'10-D'15 and D'20-D'25 and transmits display data PD1, PD2, PD3, - - - PD528 to the data latch 16.

The control circuit 15 comprises a series connection of plural inverters. The control circuit 15 receives the strobe signal STB from the control circuit 2, so that the control circuit 15 generates a delayed strobe signal STB1 which has a predetermined delay time from the strobe signal STB as well as generates a switch control signal SWA which is opposite in phase to the delayed strobe signal STB1. The control circuit 15 transmits the delayed strobe signal STB1 to the data latch 16 and also transmits the switch control signal SWA to the output circuit 19.

The data latch 16 accepts the inputs of the display data PD1, PD2, PD3, - - - PD528 in synchronizing with a rising edge of the delayed strobe signal STB1 and holds the display data PD1, PD2, PD3, - - - PD528 for a time period of the vertical synchronizing term. In synchronizing with the next rising edge of the delayed strobe signal STB1, the data latch 16 transmits the display data PD1, PD2, PD3, - - - PD528 to the gray scale voltage selecting circuit 18.

FIG. 5 is a circuit diagram illustrative of the gray scale voltage generating circuit shown in FIG. 3. The gray scale voltage generating circuit 17 comprises a single series connection of first to sixty third resistances 25-1, 25-2, 25-3, 25-4, - - - 25-63. The first to sixty third resistances 25-1, 25-2, 25-3, 25-4, - - - 25-63 have respective resistance values which are adjusted to applied voltage-to-transitivity characteristic of the color liquid crystal display 1. The gray scale voltage generating circuit 17 receives first to ninth gray scale voltages VI1, VI2, VI3, - - - VI9 from the gray scale power supply 3.

The first gray scale voltage VI1 is supplied to a first node of the first side of the first resistance 25-1. The second gray scale voltage VI2 is supplied to an eighth node between the seventh resistance 25-7 and the eighth resistance 25-8. The third gray scale voltage VI3 is supplied to a sixteenth node between the fifteenth resistance 25-15 and the sixteenth resistance 25-16. The fourth gray scale voltage VI4 is supplied to a twenty fourth node between the twenty third resistance 25-23 and the twenty fourth resistance 25-24. The fifth gray scale voltage VI5 is supplied to a thirty second node between the thirty first resistance 25-31 and the thirty second resistance 25-32. The sixth gray scale voltage VI6 is supplied to a fortieth node between the thirty ninth resistance 25-39 and the fortieth resistance 25-40. The seventh gray scale voltage VI7 is supplied to a forty eighth node between the forty seventh resistance 25-47 and the forty eighth resistance 25-48. The eighth gray scale voltage VI8 is supplied to a fifty sixth node between the fifty fifth resistance 25-55 and the fifty sixth resistance 25-56. The ninth gray scale voltage VI9 is supplied to a sixty fourth node of a second side of the sixty third resistance 25-63.

The gray scale voltage generating circuit 17 generates first to sixty fourth gray scale voltages V1, V2, V3, - - - V64 at the first to sixty fourth nodes respectively, wherein the generated first to sixty fourth gray scale voltages V1, V2, V3, - - - V64 depend on the first to ninth gray scale voltages VI1, VI2, VI3, - - - VI9 from the gray scale power supply 3 and also on the respective resistance values of the first to sixty third resistances 25-1, 25-2, 25-3, - - - 25-63. Each of the first to sixty fourth gray scale voltages V1, V2, V3, - - - V64 may individually be inverted between positive polarity and negative polarity with reference to the common potential Vcom.

With reference back to FIG. 3, the generated first to sixty fourth gray scale voltages V1, V2, V3, - - - V64 are supplied to the gray scale voltage selecting circuit 18. Namely, a gray scale signal of 64 bits is supplied from the gray scale voltage generating circuit 17 to the gray scale voltage selecting circuit 18.

The gray scale voltage selecting circuit 18 comprise first to five hundred twenty eighth gray scale voltage selecting units 18-1, 18-2, 18-3, - - - , 18-528. Each of the first to five hundred twenty eighth gray scale voltage selecting units 18-1, 18-2, 18-3, - - - , 18-528 receives corresponding one of 6-bits display data PD1, PD2, - - - PD528, so as to select one of the first to sixty fourth gray scale voltages V1, V2, V3, - - - V64 based on the corresponding one of 6-bits display data PD1, PD2, - - - PD528, whereby the selected one gray scale voltage is supplied to the output circuit 19. For example, the first gray scale voltage selecting unit 18-1 receives the 6-bits display data PD1 to select one of the first to sixty fourth gray scale voltages V1, V2, V3, - - - V64 based on the 6-bits display data PD1, whereby the selected one gray scale voltage is supplied to the output circuit 19.

The first to five hundred twenty eighth gray scale voltage selecting units 18 -, 18-2, 18-3, - - - , 18-528 have the same circuit configuration, for which reason the following description will focus only on the first gray scale voltage selecting unit 18-1. The output circuit 19 comprises first to five hundred twenty eighth output units 19-1, 19-2, 19-3, - - - , 19-528 which are connected to the first to five hundred twenty eighth gray scale voltage selecting units 18-1, 18-2, 18-3, - - - , 18-528 respectively. The first to five hundred twenty eighth output units 19-1, 19-2, 19-3, - - - , 19-528 have the same circuit configuration, for which reason the following description will focus only on the first output unit 19-1.

FIG. 6 is a circuit diagram illustrative of the first gray scale voltage selecting unit included in the gray scale voltage selecting circuit and a first output unit included in the output circuit of FIG. 3. The first gray scale voltage selecting unit 18-1 comprises a single multiplexer 26, first to sixty fourth transfer gates 27-1, 27-2, 27-3, - - - 27-64, and first to sixty fourth inverters 28-1, 28-2, 28-3, - - - 28-64. Each of the first to sixty fourth transfer gates 27-1, 27-2, 27-3, - - - 27-64 comprises a pair of p-channel MOS field effect transistor 29*a* and an n-channel MOS field effect transistor 29*b*.

A gate of the p-channel MOS field effect transistor 29*a* of each of the first to sixty fourth transfer gates 27-1, 27-2, 27-3, - - - 27-64 receives the display data PD1 from the multiplexer 26. A gate of the n-channel MOS field effect transistor 29*b* of each of the first to sixty fourth transfer gates 27-1, 27-2, 27-3, - - - 27-64 receives inverted display data /PD1 through the corresponding one of the first to sixty fourth inverters 28-1, 28-2, 28-3, - - - 28-64 from the multiplexer 26.

The first to sixty fourth transfer gates 27-1, 27-2, 27-3, - - - 27-64 also receive the first to sixty fourth gray scale voltages V1, V2, V3, - - - V64 from the gray scale voltage generating circuit 17 respectively. For example, the first transfer gate 27-1 receives the first gray scale voltage V1. The single multiplexer 26 receives the 6-bits display data PD1 from the data latch 16 for selecting one of the first to sixty fourth transfer gates 27-1, 27-2, 27-3, - - - 27-64 based on the received 6-bits display data PD1, whereby the selected one of the first to sixty fourth transfer gates 27-1, 27-2, 27-3, - - - 27-64 turns ON, and the selected one of the first to sixty fourth transfer gates 27-1, 27-2, 27-3, - - - 27-64 outputs the corresponding one of the first to sixty fourth gray scale voltages V1, V2, V3, - - - V64 as a data red signal, a data green signal or a data blue signal.

The first output unit 19-1 is connected to the first gray scale voltage selecting unit 18-1. The first output unit 19-1 comprises a first amplifier 30-1, and a first switch 31-1. The first amplifier 30-1 receives the data red signal, a data green signal or a data blue signal as the gray scale voltage from the first gray scale voltage selecting unit 18-1 for amplifying the received signal. Each of the first to five hundred twenty eighth output units 19-1, 19-2, 19-3, - - - 19-528 also receives a switch control signal SWA from the control circuit 15. The first to five hundred twenty eighth switches 31-1, 31-2, 31-3, - - - 31-528 of the first to five hundred twenty eighth output units 19-1, 19-2, 19-3, - - - 19-528 receive the switch control signal SWA from the control circuit 15.

If the first switch 31-1 of the first output unit 19-1 turns ON based on the switch control signal SWA from the control circuit 15, then the amplified data red, green or blue signal S1 is outputted from the first output unit 19-1. As shown in FIG. 3, the output circuit 19 outputs the first to five hundred twenty eighth data red, green and blue signals S1, S2, S3, - - - S528 which are then supplied to the data electrodes of the color liquid crystal display 1.

FIG. 7 is a timing chart illustrative of operations of the control circuit, the gray scale power supply 3, the common power supply 4 and the data electrode driver circuit 5 in FIG. 1. The control circuit 2 supplies the data electrode driver circuit 5 with the strobe signal STB, the clock signal CLK, the horizontal start pulse signal STH delayed by a few clock pulses of the clock signal CLK from the strobe signal STH, and the polarity signal POL. The shift register 12 in the data electrode driver circuit 5 shifts the horizontal start pulse signal STH and outputs the sampling pulse signals SP1-SP176 of 176 bits in synchronizing with the clock signal CLK.

The control circuit 2 also converts the red data $D_R$, green data $D_G$, and blue data $D_B$, into the 18-bits display data D00-D05, D10-D15 and D20-D25 which are then supplied to the data electrode driver circuit 5. The data buffer 13 in the data electrode driver circuit 5 receives the 18-bits display data D00-D05, D10-D15 and D20-D25 from the control circuit 2 and holds the 18-bits display data D00-D05, D10-D15 and D20-D25 for a time period corresponding a single pulse width of the clock signal CLK in synchronizing with the clock signal CLK, before the data buffer 13 supplies the data register 14 with the 18-bits display data D'00-D'05, D'10-D'15 and D'20-D'25.

The data register 14 in the data electrode driver circuit 5 accepts serious inputs of the 18-bits display data D'00-D'05, D'10-D'15 and D'20-D'25 as the 6-bits display data PD1, PD2, - - - PD528 in synchronizing with the sampling pulse signals SP1-SP176. The data latch 16 accepts simultaneous inputs of the 6-bits display data PD1, PD2, - - - PD528 in synchronizing with a rising edge of the strobe signal STB and latches the 6-bits display data PD1, PD2, - - - PD528 for a single horizontal time period.

The gray scale power supply 3 shown in FIG. 2 receives the polarity signal POL. If the polarity signal POL is high level "H", then the switches 8*a* and 9*a* turn ON as well as the switches 8*b* and 9*b* turn OFF, whereby the first side of the first resistance 7-1 is applied with the power voltage VDD whilst the second side of the tenth resistance 7-10 is applied with the ground voltage GND, so that the series connection of the first to tenth resistances 7-1, 7-2, 7-3, - - - 7-10 is biased between the power voltage VDD and the ground voltage GND. As a result, positive polarity divided voltages V1, V2, V3, V4, V5, V6, V7, V8 and V9 are generated at the first to ninth nodes N1, N2, N3, N4, N5, N6, N7, N8 and N9 respectively in accordance with respective ratios of the resistances 7-1, 7-2, 7-3, 7-4, 7-5, 7-6, 7-7, 7-8, 7-9, and 7-10, provided that VDD>V1>V2>V3 >V4>V5>V6>V7>V8>V9>GND. The positive polarity divided voltages V1, V2, V3, V4, V5, V6, V7, V8 and V9 are then amplified by the voltage followers 11-1, 11-2, 11-3, 11-4, 11-5, 11-6, 11-7, 11-8 and 11-9 respectively to generate the first to ninth positive polarity gray scale voltages VI1, VI2, VI3, VI4, VI5, VI6, VI7, VI8 and VI9 which will subsequently be supplied to the gray scale voltage generating circuit 17 in the data electrode driver circuit 5, provided that the VI1>VI2>VI3>VI4>VI5>VI6>VI7>VI8>VI9.

The gray scale voltage generating circuit 17 generates first to sixty fourth positive polarity gray scale voltages V1, V2, V3, - - - V64 at the first to sixty fourth nodes respectively, wherein the generated first to sixty fourth positive polarity gray scale voltages V1, V2, V3, - - - V64 depend on the first to ninth gray scale voltages VI1, VI2, VI3, - - - VI9, wherein V1>V2>V3> - - - >V64, The first to sixty fourth positive polarity gray scale voltages V1, V2, V3, - - - V64 are then supplied to the gray scale voltage selecting circuit 18 in the data electrode driver circuit 5.

Each of the first to five hundred twenty eighth gray scale voltage selecting units 18-1, 18-2, 18-3, - - - , 18-528 receives corresponding one of 6-bits display data PD1, PD2, - - - PD528.

A gate of the p-channel MOS field effect transistor 29*a* of each of the first to sixty fourth transfer gates 27-1, 27-2, 27-3, - - - 27-64 receives the display data PD from the multiplexer 26. A gate of the n-channel MOS field effect transistor 29*b* of each of the first to sixty fourth transfer gates 27-1, 27-2, 27-3, - - - 27-64 receives inverted display data /PD through the corresponding one of the first to sixty fourth inverters 28-1, 28-2, 28-3, - - - 28-64 from the multiplexer 26. The first to sixty fourth transfer gates 27-1, 27-2, 27-3, - - - 27-64 also receive the first to sixty fourth gray scale voltages V1, V2, V3, - - - V64 from the gray scale voltage generating circuit 17 respectively. The single multiplexer 26 receives the 6-bits display data PD1 from the data latch 16 for selecting one of the first to sixty fourth transfer gates 27-1, 27-2, 27-3, - - - 27-64 based on the received 6-bits display data PD1, whereby the selected one of the first to sixty fourth transfer gates 27-1, 27-2, 27-3, - - - 27-64 turns ON, and the selected one of the first to sixty fourth transfer gates 27-1, 27-2, 27-3, - - - 27-64 outputs the corresponding one of the first to sixty fourth gray scale voltages V1, V2, V3, - - - V64 as a data red signal, a data green signal or a data blue signal.

The first amplifier 30-1 receives the data red signal, a data green signal or a data blue signal as the gray scale voltage from the first gray scale voltage selecting unit 18-1 for amplifying the received signal. Each of the first to five hundred twenty eighth output units 19-1, 19-2, 19-3, - - - 19-528 also receives a switch control signal SWA from the control circuit 15. The first to five hundred twenty eighth switches 31-1, 31-2, 31-3, - - - 31-528 of the first to five hundred twenty eighth output units 19-1, 19-2, 19-3, - - - 19-528 receive the switch control signal SWA from the control circuit 15, wherein the switch control signal SWA rises at the timing of falling edge of the strobe signal STB. The output circuit 19 outputs the first to five hundred twenty eighth data red, green and blue signals S1, S2, S3, - - - S528 which are then supplied to the data electrodes of the color liquid crystal display 1.

In FIG. 7, shown is the signal S1 which is the data red signal, in case that the display data PD1 is "000000". In this case, the transfer gate 27-1 in the first gray scale voltage selecting unit 18-1 turns ON based on the display data PD1 "000000", whereby the positive polarity gray scale voltage V1 is outputted as the data red signal S1. The data red signal S1 is represented by a broken line when the strobe signal "STB" is high level because the switch 31-1 is in the OFF and the signal S1 applied to the data electrode of the color liquid crystal display 1 is in the high impedance state.

The common power supply 4 supplies the ground level GND to the common electrode of the color liquid crystal display 1 based on the polarity signal POL of high level "H", wherein the common potential of the common electrode of the color liquid crystal display 1 becomes the ground level GND. The pixel corresponding to the data electrode shows black, assuming that the color liquid crystal display 1 is of the normally white type.

If the polarity signal POL is low level "L", then the switches 8*a* and 9*a* turn OFF as well as the switches 8*b* and 9*b* turn ON, whereby the first side of the first resistance 7-1 is applied with the ground voltage GND whilst the second side of the tenth resistance 7-10 is applied with the power voltage VDD, so that the series connection of the first to tenth resistances 7-1, 7-2, 7-3, - - - 7-10 is biased between the power voltage VDD and the ground voltage GND. As a result, negative polarity divided voltages V1, V2, V3, V4, V5, V6, V7, V8 and V9 are generated at the first to ninth nodes N1, N2, N3, N4, N5, N6, N7, N8 and N9 respectively in accordance with respective ratios of the resistances 7-1, 7-2, 7-3, 7-4, 7-5, 7-6, 7-7, 7-8, 7-9, and 7-10, provided that VDD<V1<V2<V3<V4<V5<V6<V7<V8<V9<GND. The negative polarity divided voltages V1, V2, V3, V4, V5, V6, V7, V8 and V9 are then amplified by the voltage followers 11-1, 11-2, 11-3, 11-4, 11-5, 11-6, 11-7, 11-8 and 11-9 respectively to generate the first to ninth negative polarity gray scale voltages VI1, VI2, VI3, VI4, VI5, VI6, VI7, VI8 and VI9 which will subsequently be supplied to the gray scale voltage generating circuit 17 in the data electrode driver circuit 5, provided that VI1<VI2<VI3<VI4<VI5<VI6<VI7<VI8<VI9.

The gray scale voltage generating circuit 17 generates first to sixty fourth negative polarity gray scale voltages V1, V2, V3, - - - V64 at the first to sixty fourth nodes respectively, wherein the generated first to sixty fourth negative polarity gray scale voltages V1, V2, V3, - - - V64 depend on the first to ninth gray scale voltages VI1, VI2, VI3, - - - VI9, wherein V1<V2<V3< - - - <V64. The first to sixty fourth negative polarity gray scale voltages V1, V2, V3, - - - V64 are then supplied to the gray scale voltage selecting circuit 18 in the data electrode driver circuit 5.

Each of the first to five hundred twenty eighth gray scale voltage selecting units 18-1, 18-2, 18-3, - - - , 18-528 receives corresponding one of 6-bits display data PD1, PD2, - - - PD528.

A gate of the p-channel MOS field effect transistor 29*a* of each of the first to sixty fourth transfer gates 27-1, 27-2, 27-3, - - - 27-64 receives the display data PD from the multiplexer 26. A gate of the n-channel MOS field effect transistor 29*b* of each of the first to sixty fourth transfer gates 27-1, 27-2, 27-3, - - - 27-64 receives inverted display data /PD through the corresponding one of the first to sixty fourth inverters 28-1, 28-2, 28-3, - - - 28-64 from the multiplexer 26. The first to sixty fourth transfer gates 27-1, 27-2, 27-3, - - - 27-64 also receive the first to sixty fourth gray scale voltages V1, V2, V3, - - - V64 from the gray scale voltage generating circuit 17 respectively. The single multiplexer 26 receives the 6-bits display data PD1 from the data latch 16 for selecting one of the first to sixty fourth transfer gates 27-1, 27-2, 27-3, - - - 27-64 based on the received 6-bits display data PD1, whereby the selected one of the first to sixty fourth transfer gates 27-1, 27-2, 27-3, - - - 27-64 turns ON, and the selected one of the first to sixty fourth transfer gates 27-1, 27-2, 27-3, - - - 27-64 outputs the corresponding one of the first to sixty fourth gray scale voltages V1, V2, V3, - - - V64 as a data red signal, a data green signal or a data blue signal.

The first amplifier 30-1 receives the data red signal, a data green signal or a data blue signal as the gray scale voltage from the first gray scale voltage selecting unit 18-1 for amplifying the received signal. Bach of the first to five hundred twenty eighth output units 19-1, 19-2, 19-3, - - - 19-528 also receives a switch control signal SWA from the control circuit 15. The first to five hundred twenty eighth switches 31-1, 31-2, 31-3, - - - 31-528 of the first to five hundred twenty eighth output units 19-1, 19-2, 19-3, - - - 19-528 receive the switch control signal SWA from the control circuit 15, wherein the switch control signal SWA rises at the timing of falling edge of the strobe signal STB. The output circuit 19 outputs the first to five hundred twenty eighth data red, green and blue signals S1, S2, S3, - - - S528 which are then supplied to the data electrodes of the color liquid crystal display 1.

In FIG. 7, shown is the signal S1 which is the data red signal, in case that the display data PD1 is "000000". In this case, the transfer gate 27-1 in the first gray scale voltage selecting unit 18-1 turns ON based on the display data PD1 "000000", whereby the positive polarity gray scale voltage V1 is outputted as the data red signal S1. The data red signal S1 is represented by a broken line when the strobe signal "STB" is high level because the switch 31-1 is in the OFF and the signal S1 applied to the data electrode of the color liquid crystal display 1 is in the high impedance state.

The common power supply 4 supplies the power voltage level VDD to the common electrode of the color liquid crystal display 1 based on the polarity signal POL of low level "L", wherein the common potential of the common electrode of the color liquid crystal display 1 becomes the power voltage level VDD. The pixel corresponding to the data electrode shows black, assuming that the color liquid crystal display 1 is of the normally white type.

The above-described driving system is so called to as a line-inversion driving system, wherein the data signals applied to the data electrodes are opposite to each other in polarity with reference to corresponding common potentials Vcom between adjacent two of the data lines, provided that the common potentials Vcom are respectively inverted between ground and power voltage levels for every data lines.

The line-inversion driving system has been utilized for the following two reasons. The first reason is that the applications of the same or uniform polarity voltages to the liquid crystal cells shorten the life-time of the color liquid crystal display. The second reason is that the transitivity of the liquid crystal cells is almost independent from the polarity of the applied voltage to the liquid crystal display.

The above described line-inversion driving system, however, has the following disadvantages particularly in case of the mobile phones and personal handy-phone systems. In a stand-by mode, the power ON-state is maintained without, however, any operations by the users, and a predetermined stand-by display is displayed in full-colors on the color liquid crystal display screen, even the users are unlikely to view the display screen. The driver circuit of the color liquid crystal display is driven in the same manner as in the normal mode. This means that, in the stand-by mode, the driver circuit consumes the same power as in the normal mode. It is desirable to suppress the power consumption by the driver circuit in the stand-by mode as many as possible.

FIG. 8 is a view illustrative of a display screen of the mobile phone or the personal handy-phone system. A display screen 1 of the mobile phone or the personal handy-phone system includes a top display region 32, a center display region 33 and a bottom display region 34. The top display region 32 displays a battery mark 32*a* and an antenna mark 32*b*. The battery mark 32*a* indicates a charge-level of a battery accommodated in the mobile phone or the personal handy-phone system. The antenna mark 32*b* indicates whether the position of the mobile phone or the personal handy-phone system is in a service area of a wireless phone service on a mobile communication network.

The center display region 33 displays images of the contents attached to e-mails and provided from Word Wide Web servers. The bottom display region 34 displays month-and-day information 34*a* and clock-time information 34*b*. The center display region 33 shows the full color display. The top and bottom display regions 32 and 34 show monochrome or 8-colors displays.

For performing the monochrome or 8-colors display on the top and bottom display regions 32 and 34, the conventional driver circuit of the color liquid crystal display 1 operates the data electrode driver circuit 5 in the same manners as performing the full-color display on the center display region 33. This causes unnecessary power consumption by the conventional driver circuit. It is thus desirable to suppress the power consumption for displaying the top and bottom display regions 32 and 34.

Another driving system, for example, the frame inversion system also has the same disadvantages as described above. In the frame inversion system, the data signals applied to the data electrodes are opposite to each other in polarity with reference to corresponding common potentials Vcom between adjacent two frames, provided that the common potentials Vcom are respectively inverted between ground and power voltage levels for every frames.

The above described disadvantages of the line-inversion driving system and the frame-inversion driving system are also common to other portable or mobile electric devices than the mobile phones and the personal handy-phone systems, for example, various electronic devices such as note-type computers, palm-type computers, pocket-type computers, mobile terminals such as personal digital assistants.

In the above circumstances, the developments of a novel method of driving a liquid crystal display and of a driver circuit for driving the liquid crystal display as well as of an electronic device with the driver circuit are desirable.

SUMMARY OF THE INVENTION

Accordingly, it is an object of the present invention to provide a novel method of driving a liquid crystal display free from the above problems.

It is a further object of the present invention to provide a novel line-inversion driving method of driving a color liquid crystal display, wherein the method is suitable for reducing the power consumption.

It is a still further object of the present invention to provide a novel frame-inversion driving method of driving a color liquid crystal display, wherein the method is suitable for reducing the power consumption.

It is yet a further object of the present invention to provide a novel driver circuit for driving a liquid crystal display free from the above problems.

It is further more object of the present invention to provide a novel driver circuit for driving a liquid crystal display in a line-inversion driving, wherein the driver circuit is suitable for reducing the power consumption.

It is moreover object of the present invention to provide a novel driver circuit for driving a liquid crystal display in a frame-inversion driving, wherein the driver circuit is suitable for reducing the power consumption.

It is yet more object of the present invention to provide a novel electronic device with an improved driver circuit driver circuit for driving a liquid crystal display free from the above problems.

It is another object of the present invention to provide a novel electronic device with an improved driver circuit for driving a liquid crystal display in a line-inversion driving, wherein the driver circuit is suitable for reducing the power consumption.

It is still another object of the present invention to provide a novel electronic device with an improved driver circuit for driving a liquid crystal display in a frame-inversion driving, wherein the driver circuit is suitable for reducing the power consumption.

The present invention provides a method and a circuit for driving a color liquid crystal display in a normal driving mode and a power saving mode, wherein in the normal driving mode, voltages corresponding to image display data are applied to data electrodes of the color liquid crystal display, and wherein in the power saving mode, voltages corresponding to highly significant bit signals of the image display data are applied as display data signals to the data electrodes.

The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

DETAILED DESCRIPTION OF THE PREFERRED EMBODIMENTS

Figure 1:
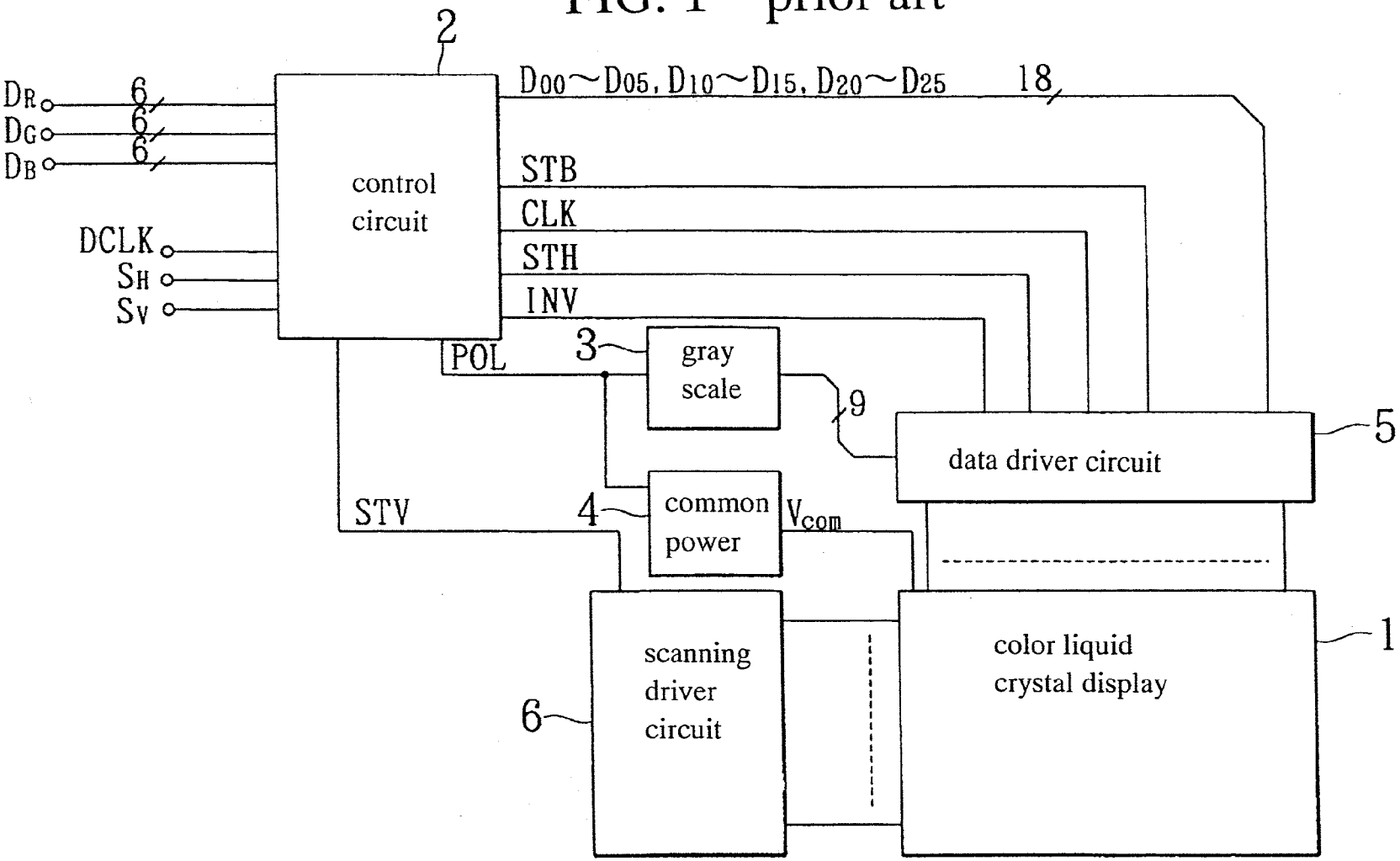
FIG. 1 prior art
FIG. 1 is a block diagram illustrative of a first conventional driver circuit for driving a color liquid crystal display.
Figure 2:
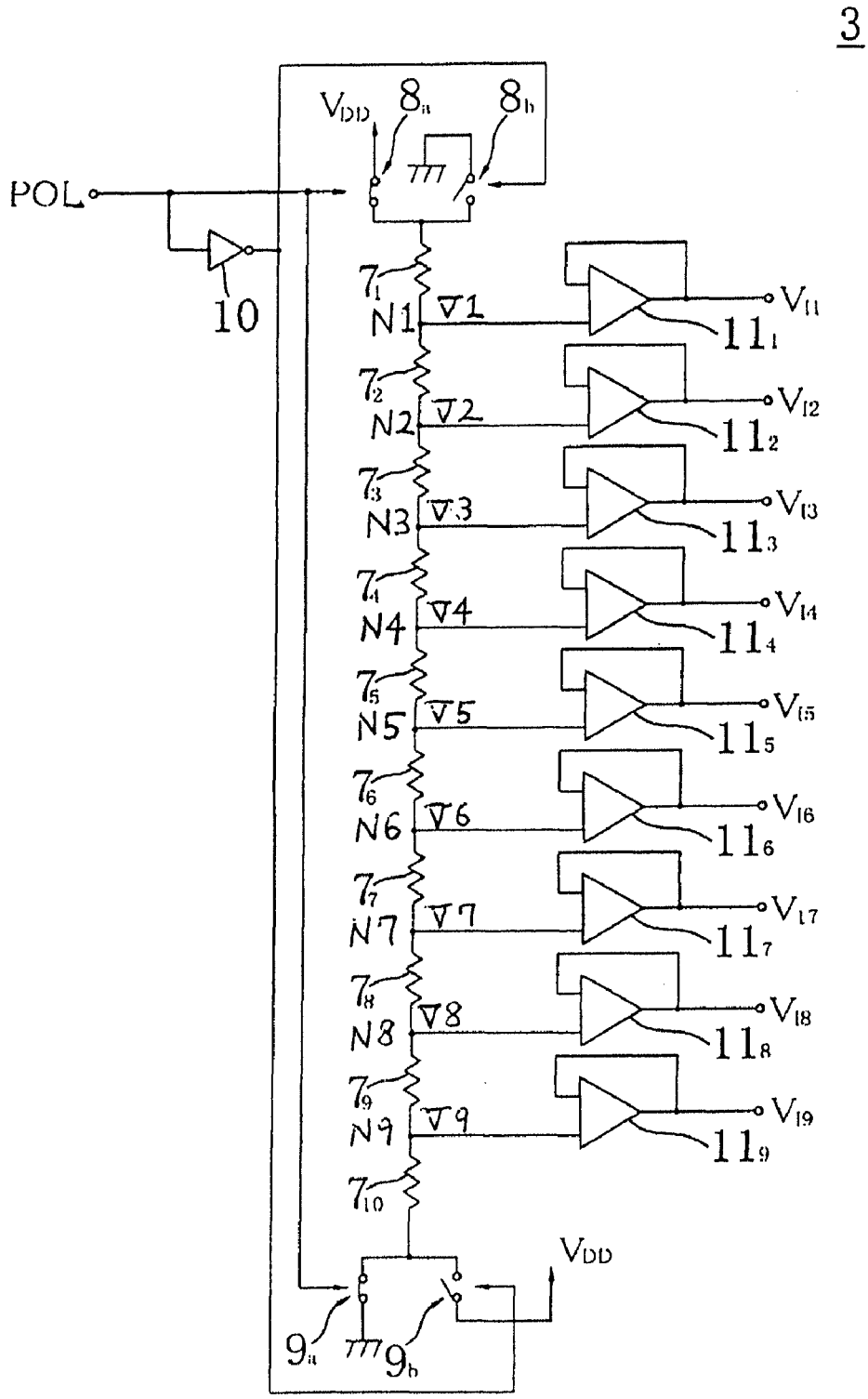
FIG. 2 prior art
FIG. 2 is a circuit diagram illustrative of a circuit configuration of a gray scale power supply in the driver circuit shown in FIG. 1.
Figure 3:
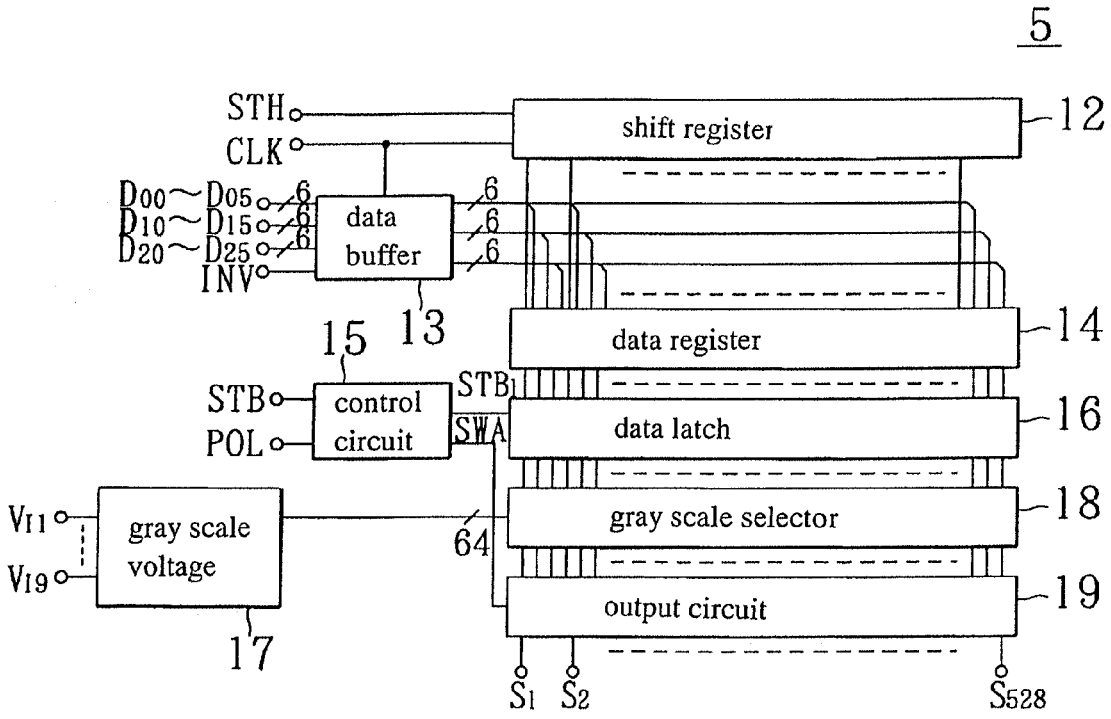
FIG. 3 prior art
FIG. 3 is a block diagram illustrative of the data electrode driver circuit shown in FIG. 1.
Figure 4:
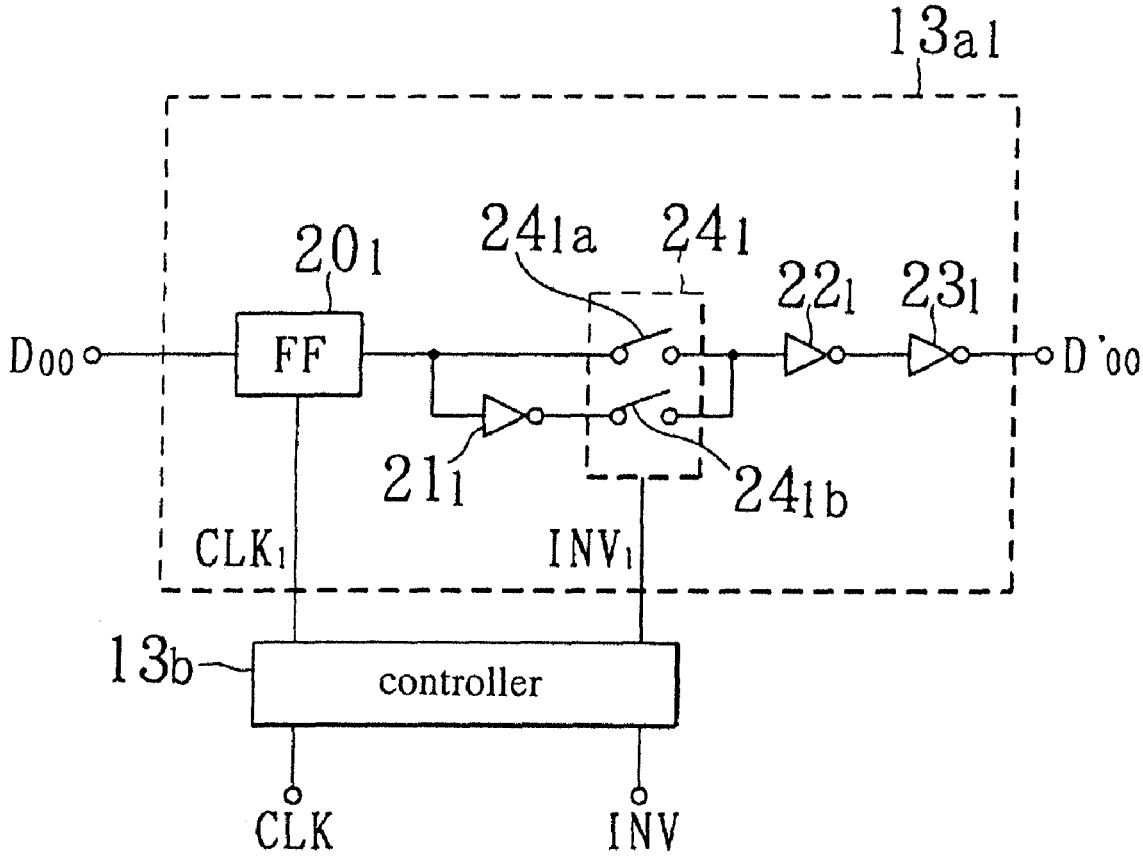
FIG. 4 prior art
FIG. 4 is a partial circuit diagram illustrative of a part of the circuit configuration of the data buffer shown in FIG. 3.
Figure 5:
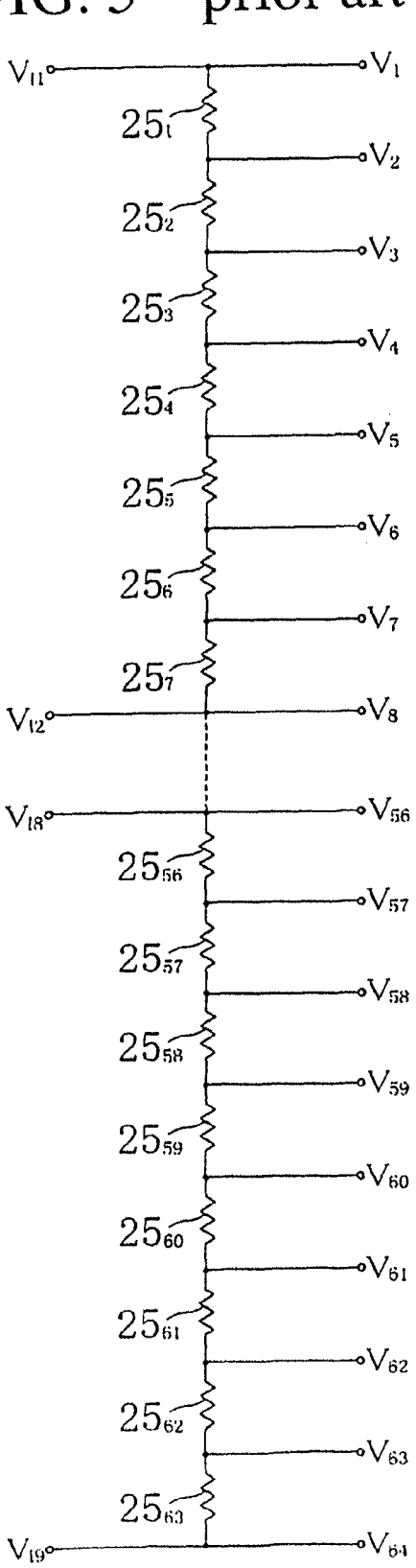
FIG. 5 prior art
FIG. 5 is a circuit diagram illustrative of the gray scale voltage generating circuit shown in FIG. 3.
Figure 6:
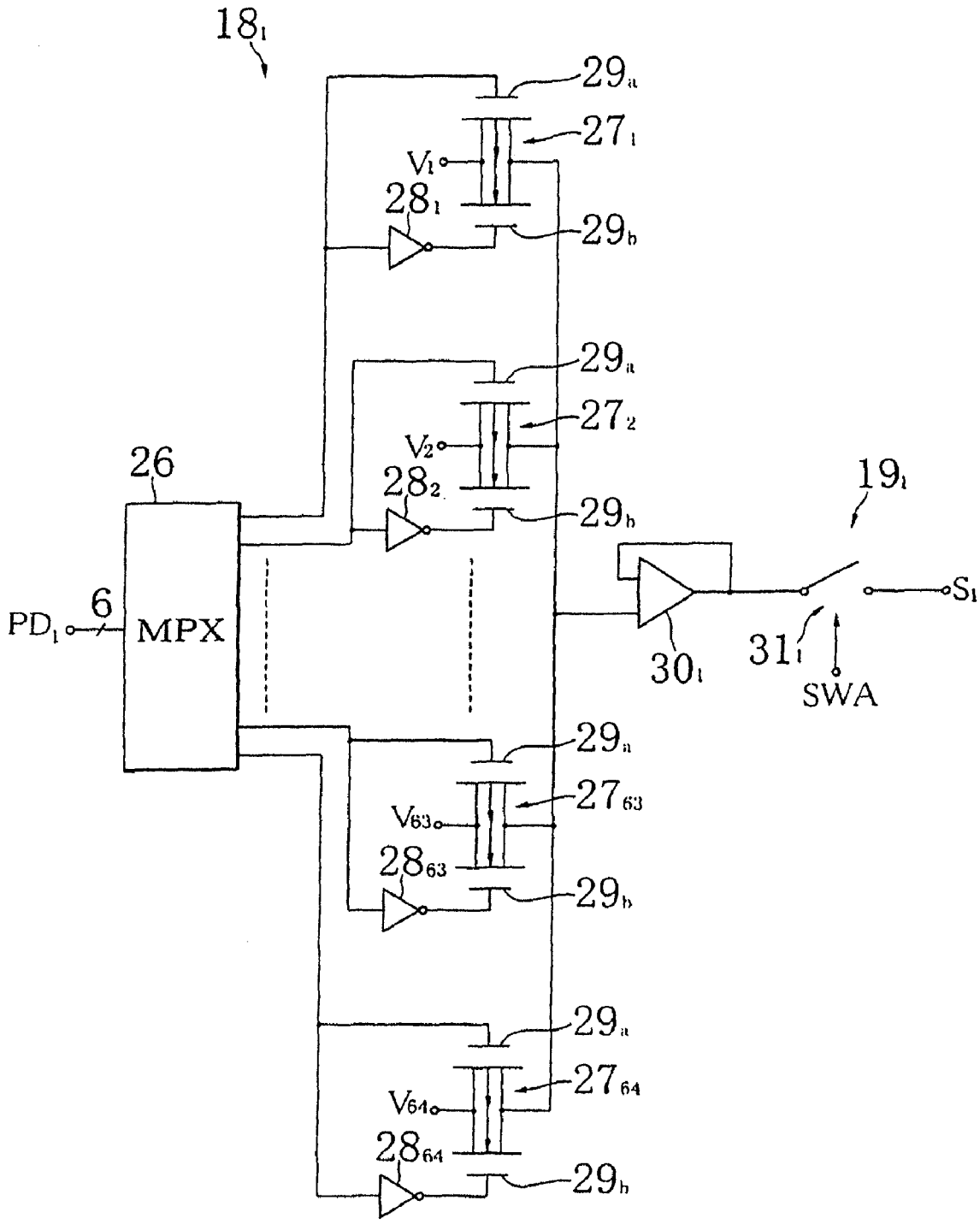
FIG. 6 prior art
FIG. 6 is a circuit diagram illustrative of the first gray scale voltage selecting unit included in the gray scale voltage selecting circuit and a first output unit included in the output circuit of FIG. 3.
Figure 7:
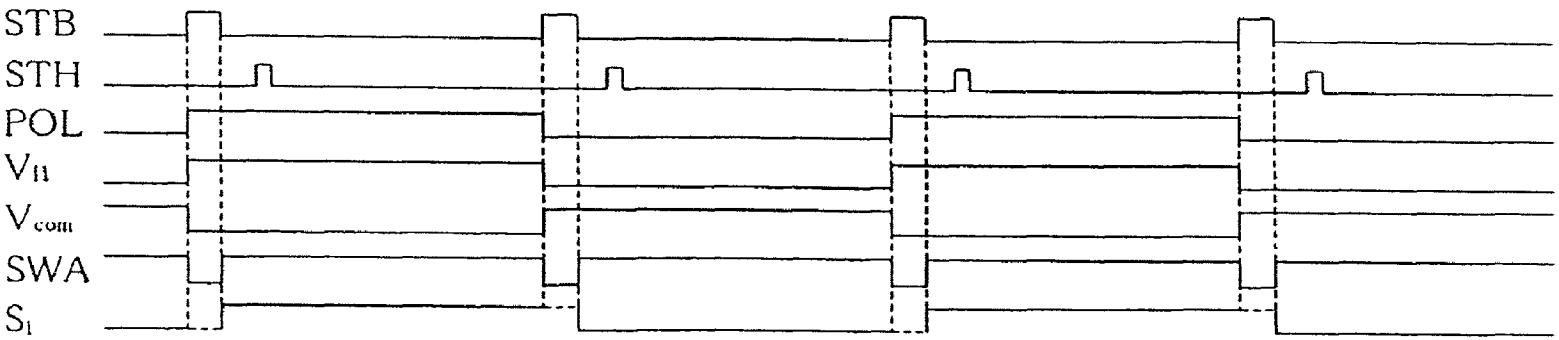
FIG. 7 prior art
FIG. 7 is a timing chart illustrative of operations of the control circuit, the gray scale power supply, the common power supply and the data electrode driver circuit in FIG. 1.
Figure 8:
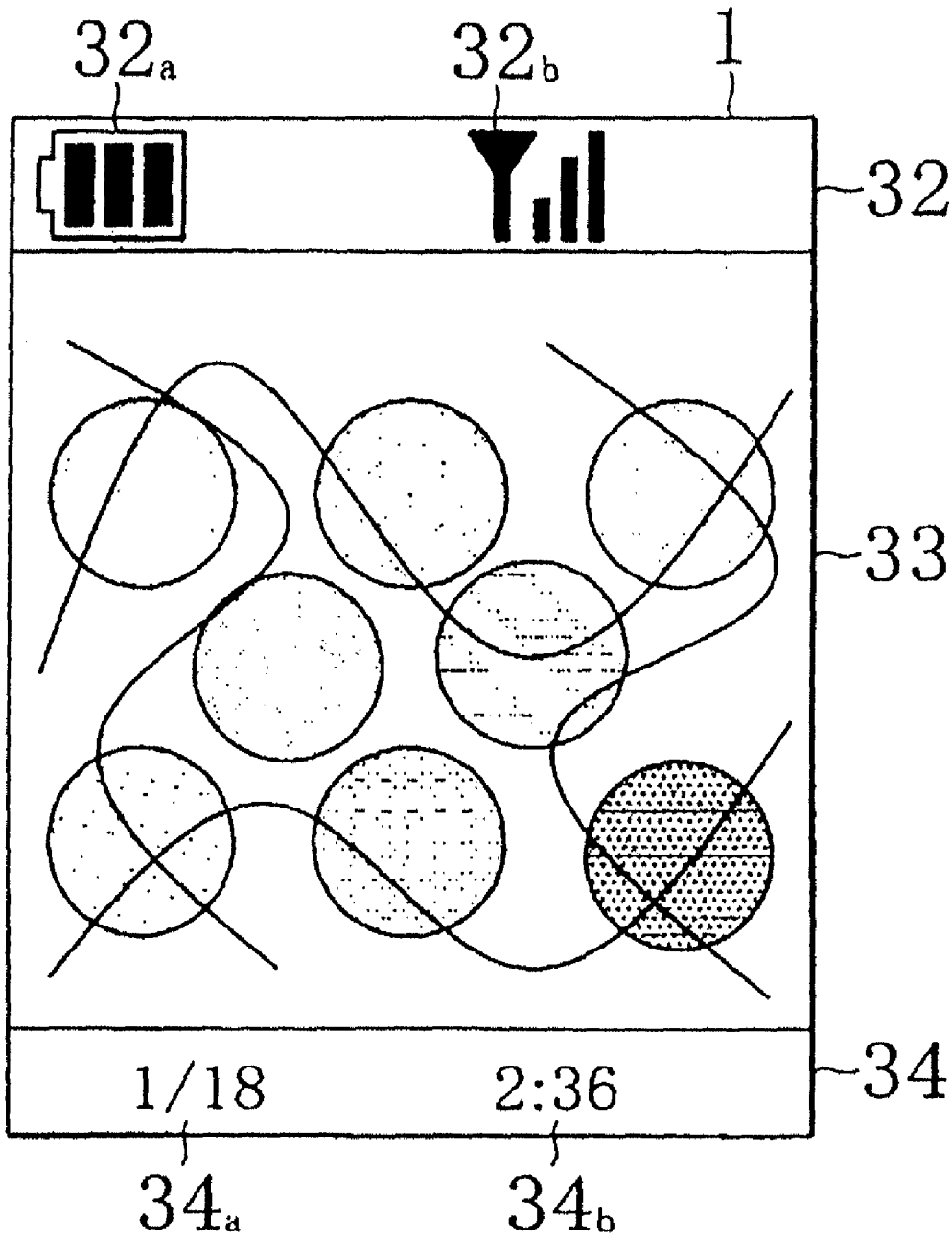
FIG. 8 prior art
FIG. 8 is a view illustrative of a display screen of the mobile phone or the personal handy-phone system.

A first aspect of the present invention is a method of driving a color liquid crystal display in a normal driving mode and a power saving mode, wherein in the normal driving mode, voltages corresponding to image display data are applied to data TO electrodes of the color liquid crystal display, and wherein in the power saving mode, voltages corresponding to highly significant bit signals of the image display data are applied as display data signals to the data electrodes. In the power saving mode, voltages corresponding to highly significant bit signals of the image display data are applied as the display data signals to the data electrodes of the color liquid crystal display, in order to reduce the power consumption in the line-inversion driving system or the frame-inversion driving system.

It is possible that the power saving mode includes an essential information display mode, where a predetermined uniform voltage level, which corresponds to a predetermined color and which is independent from the image display data, is uniformly applied to all data electrodes on other region than at least a designated region for displaying the essential information.

It is further possible that the color liquid crystal display is of normally white type, and the predetermined color is white.

It is also possible that the color liquid crystal display is of normally black type, and the predetermined color is black.

It is also possible that a uniform scanning signal is simultaneously applied to all scanning electrodes on other region than the at least designated region for displaying the essential information.

It is also possible that at least a full color display region in the color liquid crystal display is displayed in the normal driving mode, and that at least a partial color display region in the color liquid crystal display is displayed in the power saving mode.

It is also possible that the power saving mode further inactivates a gray scale voltage generating circuit, a polarity selecting circuit, and an output circuit included in a driver circuit for driving the color liquid crystal display.

A second aspect of the present invention is a circuit for driving a color liquid crystal display. The circuit comprises: a data latch for selectively inverting image display data based on a polarity signal; a gray scale voltage generating circuit for generating a first set of plural positive-polarity gray scale voltages and a second set of plural negative-polarity gray scale voltages; a polarity selecting circuit for selecting one of the first set of the plural positive-polarity gray scale voltages and the second set of the plural negative-polarity gray scale voltages based on the polarity signal; a gray scale voltage selecting circuit for selecting a single gray scale voltage from the selected plural gray scale voltages based on the image display data supplied from the data latch; an output circuit for supplying the selected single gray scale voltage to a corresponding data electrode of the color liquid crystal display; and a control circuit for inactivating the gray scale voltage generating circuit, the polarity selecting circuit, and the output circuit in a power saving mode, and also for applying voltages corresponding to highly significant bit signals of the image display data as display data signals to the data electrodes in the power saving mode. In the power saving mode, voltages corresponding to highly significant bit signals of the image display data are applied as the display data signals to the data electrodes of the color liquid crystal display, in order to reduce the power consumption in the line-inversion driving system or the frame-inversion driving system.

It is possible that the polarity signal is selectively inverted for every horizontal synchronizing time periods or for every vertical synchronizing time periods.

It is also possible that the plural positive-polarity gray scale voltages are predetermined to adjust to a positive voltage to transitivity characteristic of the color liquid crystal display, and the plural negative-polarity gray scale voltages are also predetermined to adjust to a negative voltage to transitivity characteristic of the color liquid crystal display.

It is also possible that the power saving mode includes an essential information display mode, where the control circuit controls the data latch so that a predetermined uniform voltage level, which corresponds to a predetermined color and which is independent from the image display data, is uniformly applied to all data electrodes on other region than at least a designated region for displaying the essential information.

It is further possible that the color liquid crystal display is of normally white type, and the predetermined color is white.

It is also possible that the color liquid crystal display is of normally black types and the predetermined color is black.

It is also possible to further comprise a scanning electrode driving circuit, wherein the control circuit controls the scanning electrode driving circuit for simultaneously applying a uniform scanning signal to all scanning electrodes on other region than the at least designated region for displaying the essential information.

It is also possible that at least a full color display region in the color liquid crystal display is displayed in the normal driving mode, and that at least a partial color display region in the color liquid crystal display is displayed in the power saving mode.

It is also possible that the gray scale voltage generating circuit further comprises: a divided-voltage generating circuit for generating plural divided-voltages different in voltage level from each other in a normal driving mode and also for generating no divided-voltages in the power saving modes.

It is further possible that the divided-voltage generating circuit further comprises: a series connection of plural resistances having a uniform resistance value; a high voltage side switch for applying a high voltage to a first side of the series connection of plural resistances in the normal driving mode and for applying no voltage to the first side in the power saving mode; and a low voltage side switch for applying a low voltage to a second side of the series connection of plural resistances in the normal driving mode and for applying no voltage to the second side in the power saving mode.

It is also possible that the polarity selecting circuit further comprises: a first switching group including plural switches for selecting the plural positive-polarity gray scale voltages based on a positive switching signal; and a second switching group including plural switches for selecting the plural negative-polarity gray scale voltages based on a negative switching signal.

It is also possible that the gray scale voltage selecting circuit selects either first one of the plural positive-polarity gray scale voltages or second one of the plural negative-polarity gray scale voltages based on the image display data.

It is further possible that the output circuit generates an output signal based on the selected gray scale voltage supplied from the gray scale voltage selecting circuit in the normal driving mode, and also the output circuit generates either one of predetermined high and low voltage levels which are independent from the selected gray scale voltage in the power saving mode.

It is further possible that the output circuit further comprises: an amplifying circuit for amplifying the selected gray scale voltage in the normal driving mode, and also the amplifying circuit being inactivated in the power saving mode; and a selecting circuit for selecting the amplified gray scale voltage supplied from the amplifying circuit in the normal driving mode, and also selecting either one of the predetermined high and low voltage levels which are independent from the selected gray scale voltage in the power saving mode.

It is also possible that the data latch comprises: a latch circuit for accepting input of the image display data in synchronizing with a strobe signal having the same cycle as a horizontal synchronizing signal and the latch circuit subsequently holding the image display data for a single horizontal synchronizing time period; a level shifter for shifting a voltage level of the image display data supplied from the latch circuit and also inverting the image display data to generate both non-inverted image display data and inverted image display data; and a selector for selecting, based on the polarity signal, the non-inverted image display data or the inverted image display data supplied from the level shifter.

It is also possible that the data latch comprises: a latch circuit for accepting input of the image display data in synchronizing with a strobe signal having the same cycle as a horizontal synchronizing signal and the latch circuit subsequently holding the image display data for a single horizontal synchronizing time period; a first selector for selecting, based on a partial display signal supplied from the control circuit, either monochrome display data supplied from the control circuit or the image display data supplied from the latch circuit; a level shifter for shifting a voltage level of the selected monochrome display data or the image display data supplied from the latch circuit and also inverting the display data to generate either a first pair of non-inverted image display data and inverted image display data or a second pair of non-inverted monochrome display data and inverted monochrome display data; and a second selector for selecting, based on the polarity signal, one of the non-inverted image display data and the inverted image display data or of the non-inverted monochrome display data and the inverted monochrome display data supplied from the level shifter.

A third aspect of the present invention is a portable device including a color liquid crystal display and a driver circuit for driving the color liquid crystal display with a battery power. The driver circuit comprises: a data latch for selectively inverting image display data based on a polarity signal; a gray scale voltage generating circuit for generating a first set of plural positive-polarity gray scale voltages and a second set of plural negative-polarity gray scale voltages; a polarity selecting circuit for selecting one of the first set of the plural positive-polarity gray scale voltages and the second set of the plural negative-polarity gray scale voltages based on the polarity signal; a gray scale voltage selecting circuit for selecting a single gray scale voltage from the selected plural gray scale voltages based on the image display data supplied from the data latch; an output circuit for supplying the selected single gray scale voltage to a corresponding data electrode of the color liquid crystal display; and a control circuit for inactivating the gray scale voltage generating circuit, the polarity selecting circuit, and the output circuit in a power saving mode, and also for applying voltages corresponding to highly significant bit signals of the image display data as display data signals to the data electrodes in the power saving mode. In the power saving mode, voltages corresponding to highly significant bit signals of the image display data are applied as the display data signals to the data electrodes of the color liquid crystal display, in order to reduce the power consumption in the line-inversion driving system or the frame-inversion driving system.

It is possible that the polarity signal is selectively inverted for every horizontal synchronizing time periods or for every vertical synchronizing time periods.

It is also possible that the plural positive-polarity gray scale voltages are predetermined to adjust to a positive voltage to transitivity characteristic of the color liquid crystal display, and the plural negative-polarity gray scale voltages are also predetermined to adjust to a negative voltage to transitivity characteristic of the color liquid crystal display.

It is also possible that the power saving mode includes an essential information display mode, where the control circuit controls the data latch so that a predetermined uniform voltage level, which corresponds to a predetermined color and which is independent from the image display data, is uniformly applied to all data electrodes on other region than at least a designated region for displaying the essential information.

It is further possible that the color liquid crystal display is of normally white type, and the predetermined color is white.

It is also possible that the color liquid crystal display is of normally black type, and the predetermined color is black.

It is also possible to further comprise a scanning electrode driving circuit, wherein the control circuit controls the scanning electrode driving circuit for simultaneously applying a uniform scanning signal to all scanning electrodes on other region than the at least designated region for displaying the essential information.

It is also possible that at least a full color display region in the color liquid crystal display is displayed in the normal driving mode, and that at least a partial color display region in the color liquid crystal display is displayed in the power saving mode.

It is also possible that the gray scale voltage generating circuit further comprises: a divided-voltage generating circuit for generating plural divided-voltages different in voltage level from each other in a normal driving mode and also for generating no divided-voltages in the power saving modes.

It is further possible that the divided-voltage generating circuit further comprises: a series connection of plural resistances having a uniform resistance value; a high voltage side switch for applying a high voltage to a first side of the series connection of plural resistances in the normal driving mode and for applying no voltage to the first side in the power saving mode; and a low voltage side switch for applying a low voltage to a second side of the series connection of plural resistances in the normal driving mode and for applying no voltage to the second side in the power saving mode.

It is also possible that the polarity selecting circuit further comprises a first switching group including plural switches for selecting the plural positive-polarity gray scale voltages based on a positive switching signal; and a second switching group including plural switches for selecting the plural negative-polarity gray scale voltages based on a negative switching signal.

It is also possible that the gray scale voltage selecting circuit selects either first one of the plural positive-polarity gray scale voltages or second one of the plural negative-polarity gray scale voltages based on the image display data.

It is further possible that the output circuit generates an output signal based on the selected gray scale voltage supplied from the gray scale voltage selecting circuit in the normal driving mode, and also the output circuit generates either one of predetermined high and low voltage levels which are independent from the selected gray scale voltage in the power saving mode.

It is further possible that the output circuit further comprises: an amplifying circuit for amplifying the selected gray scale voltage in the normal driving mode, and also the amplifying circuit being inactivated in the power saving mode; and a selecting circuit for selecting the amplified gray scale voltage supplied from the amplifying circuit in the normal driving mode, and also selecting either one of the predetermined high and low voltage levels which are independent from the selected gray scale voltage in the power saving mode.

It is also possible that the data latch comprises a latch circuit for accepting input of the image display data in synchronizing with a strobe signal having the same cycle as a horizontal synchronizing signal and the latch circuit subsequently holding the image display data for a single horizontal synchronizing time period; a level shifter for shifting a voltage level of the image display data supplied from the latch circuit and also inverting the image display data to generate both non-inverted image display data and inverted image display data; and a selector for selecting, based on the polarity signal, the non-inverted image display data or the inverted image display data supplied from the level shifter.

It is also possible that the data latch comprises: a latch circuit for accepting input of the image display data in synchronizing with a strobe signal having the same cycle as a horizontal synchronizing signal and the latch circuit subsequently holding the image display data for a single horizontal synchronizing time period; a first selector for selecting, based on a partial display signal supplied from the control circuit, either monochrome display data supplied from the control circuit or the image display data supplied from the latch circuit; a level shifter for shifting a voltage level of the selected monochrome display data or the image display data supplied from the latch circuit and also inverting the display data to generate either a first pair of non-inverted image display data and inverted image display data or a second pair of non-inverted monochrome display data and inverted monochrome display data; and a second selector for selecting, based on the polarity signal, one of the non-inverted image display data and the inverted image display data or of the non-inverted monochrome display data and the inverted monochrome display data supplied from the level shifter.

First Embodiment

Figure 9:
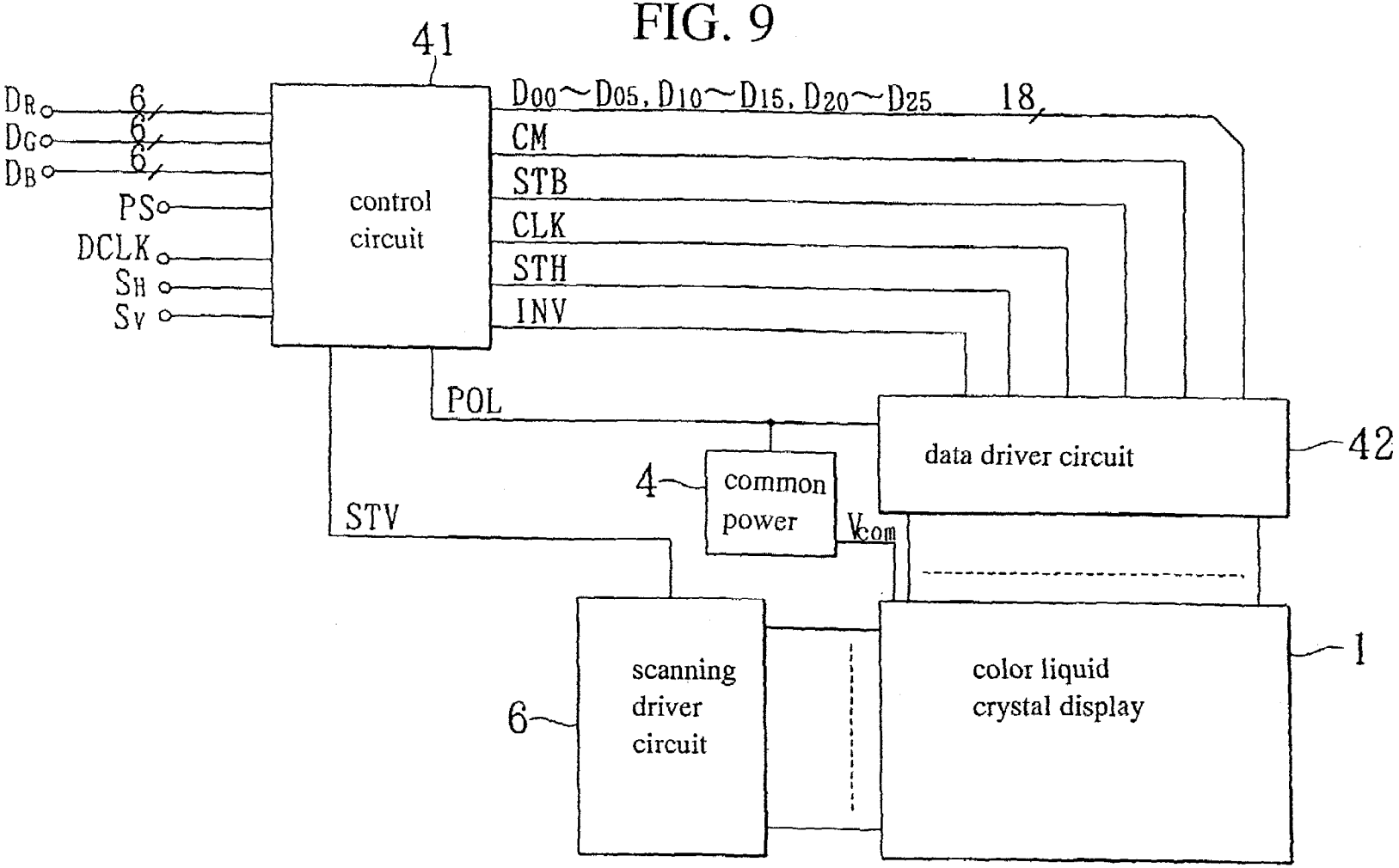
FIG. 9 is a block diagram illustrative of a first novel driver circuit for driving a color liquid crystal display in a first embodiment in accordance with the present invention.

A first embodiment according to the present invention will be described in detail with reference to the drawings. FIG. 9 is a block diagram illustrative of a first novel driver circuit for driving a color liquid crystal display in a first embodiment in accordance with the present invention.

A color liquid crystal display 1 may be driven by an active matrix driving system using thin film transistors as switching devices. The color liquid crystal display 1 includes a plurality of scanning lines or data lines which extend parallel to each other in a column direction at a constant pitch, and a plurality of data lines or source lines which extend parallel to each other in a row direction at another constant pitch, as well as a two-dimensional matrix array of pixels, each of which is positioned in an area defined by adjacent two of the scanning lines and adjacent two of the data lines.

Each of the pixels further includes a liquid crystal cell as an equivalent capacitive load, a common electrode, a thin film transistor for driving the liquid crystal cell, and a data electrode for storing data charge in a vertical synchronizing term. A gate electrode of the thin film transistor is connected to the scanning line. The gate electrode of the thin film transistor serves as a scanning electrode.

The color liquid crystal display 1 may be driven as follows. The common electrode is applied with a common potential Vcom. The data electrode is applied with data signals, wherein the data signals may include data red signals, data green signals and data blue signals, which have been generated from red data $D_R$, green data $D_G$, and blue data $D_B$ as digital image data. The scanning electrode is applied with a scanning signal which has been generated from a horizontal synchronizing signal $S_H$ and a vertical synchronizing signal $S_V$.

The following description with reference to FIG. 9 will be made assuming that the color liquid crystal display 1 is a normally white type color liquid crystal display which is high in transitivity under no voltage application.

The driver circuit for driving the color liquid crystal display 1 mainly includes a control circuit 41, a common power supply 4, a data electrode driver circuit 42, and a scanning electrode driver circuit 6.

The control circuit 41 may, for example, comprise an application specific integrated circuit (ASIC). The control circuit 41 receives parallel inputs of red data $D_R$ of 6-bits, green data $D_G$ of 6-bits and blue data $D_B$ of 6-bits. The control circuit 41 converts the red data $D_R$, green data $D_G$ and blue data $D_B$ into 18-bits display data D00-D05, D10-D15 and D20-D25 respectively, and outputs the 18-bits display data. The 18-bits display data outputted from the control circuit 41 are supplied to the data electrode driver circuit 42.

The control circuit 41 also receives further inputs of a dot-clock signal DCLK, a horizontal synchronizing signal $S_H$, and a vertical synchronizing signal $S_V$, so that the control circuit 41 generates a strobe signal STB, a clock signal CLK, a horizontal start pulse signal STH, a vertical start pulse signal STV, a polarity signal POL, a data inversion signal INV from the dot-clock signal DCLK, the horizontal synchronizing signal $S_H$, and the vertical synchronizing signal $S_V$. The strobe signal STB, the clock signal CLK, the horizontal start pulse signal STH and the data inversion signal INV are supplied to the data electrode driver circuit 42. The polarity signal POL is supplied to the common power supply 4 and also to the data electrode driver circuit 42. The vertical start pulse signal STV is supplied to the scanning electrode driver circuit 6.

The strobe signal STB has the same cycle as the horizontal synchronizing signal $S_H$. The clock signal CLK may be either identical with or different in frequency from the dot-clock signal DCLK. The clock signal CLK may be used for allowing shift registers in the data electrode driver circuit 42 to generate sampling pulse signals SP1-SP176 from the horizontal start pulse signal STH.

The horizontal start pulse signal STH is identical in cycle to the horizontal synchronizing signal $S_H$, and delayed from the strobe signal STB by a time corresponding to a few pulses of the clock signal CLK. The polarity signal POL is inverted in a single line unit or in a single horizontal synchronizing cycle for alternating current driving of the color liquid crystal display 1. The vertical start pulse signal STV has the same cycle as the vertical synchronizing signal $S_V$.

The data inversion signal INV is used for the purpose of reducing the power which is consumed by the control circuit 41. If the current 18-bits display data D00-D05, D10-D15 and D20-D25 has at least 10-inverted bits from the previous 18-bits display data, the data inversion signal INV is inverted in synchronizing with the clock signal CLK, instead of inversions of the current 18-bits display data D00-D05, D10-D15 and D20-D25 for the following reasons.

It is general that the control circuit 41 is integrated over a printed board, whilst the data electrode driver circuit 42 is mounted as a tape carrier package (TCP) over a film tape carrier which provides an electrical connection between the printed board and the color liquid crystal display 1. The printed board is mounted at an upper portion on a back face of a back light which is attached to the color liquid crystal display 1.

18-signal lines are provided on the film carrier tape for transmitting the 18-bits display data D00-D05, D10-D15 and D20-D25 from the control circuit 41 to the data electrode driver circuit 42. The 18-signal lines have a line capacitance. In addition, the data electrode driver circuit 42 has an input capacitance of about 20 pF from the control circuit 41. A sufficient current for charging and discharging the line capacitance and the input capacitance would be needed if the polarity of the 18-bits display data D00-D05, D10-D15 and D20-D25 are inverted and supplied to the data electrode driver circuit 42 from the control circuit 41. For reducing the necessary charge and discharge currents to the line capacitance and the input capacitance, it is effective that the data inversion signal INV is inverted, instead of inversions of the 18-bits display data D00-D05, D10-D15 and D20-D25. The reduction of the charge and discharge currents results in a reduction in the power consumed by the control circuit 41.

It is important for the first embodiment of the present invention that the control circuit 41 also receives a furthermore input of a power saving mode signal PS, so that the control circuit 41 generates a color mode signal CM based on the power saving mode signal PS. The color mode signal CM is then supplied to the data electrode driver circuit 42.

The power saving mode signal PS in an activated level, for example, a high level "H" instructs the data electrode driver circuit 42 to save the power consumption. The power saving mode signal PS in an inactivated level, for example, a low level "L" allows the data electrode driver circuit 42 to drive without saving the power consumption.

The color mode signal CM in an activated level, for example, a high level "H" sets the data electrode driver circuit 42 in a full-color mode. The color mode signal CM in an inactivated level, for example, a low level "L" sets the data electrode driver circuit 42 in a non-full-color mode, for example, an 8-color mode. In the full-color mode, various images such as static and/or dynamic images are displayed in full-colors on the color liquid crystal display 1.

In the 8-color mode, other informations than the contents, for example, month-and-day informations, telephone numbers for calling, characters of e-mails, various marks such as a battery mark and an antenna mark are displayed in 8-colors on the color liquid crystal display 1. In the 8-color mode, each pixel is displayed in 8-colors, wherein each pixel includes three-primary color dots, for example, red (R)-color dot, green (G)-color dot and blue (B)-color dot, and each of the three-primary color dots, for example, red (R)-color dot, green (G)-color dot and blue (B)-color dot is displayed in binary digits.

Figure 10:
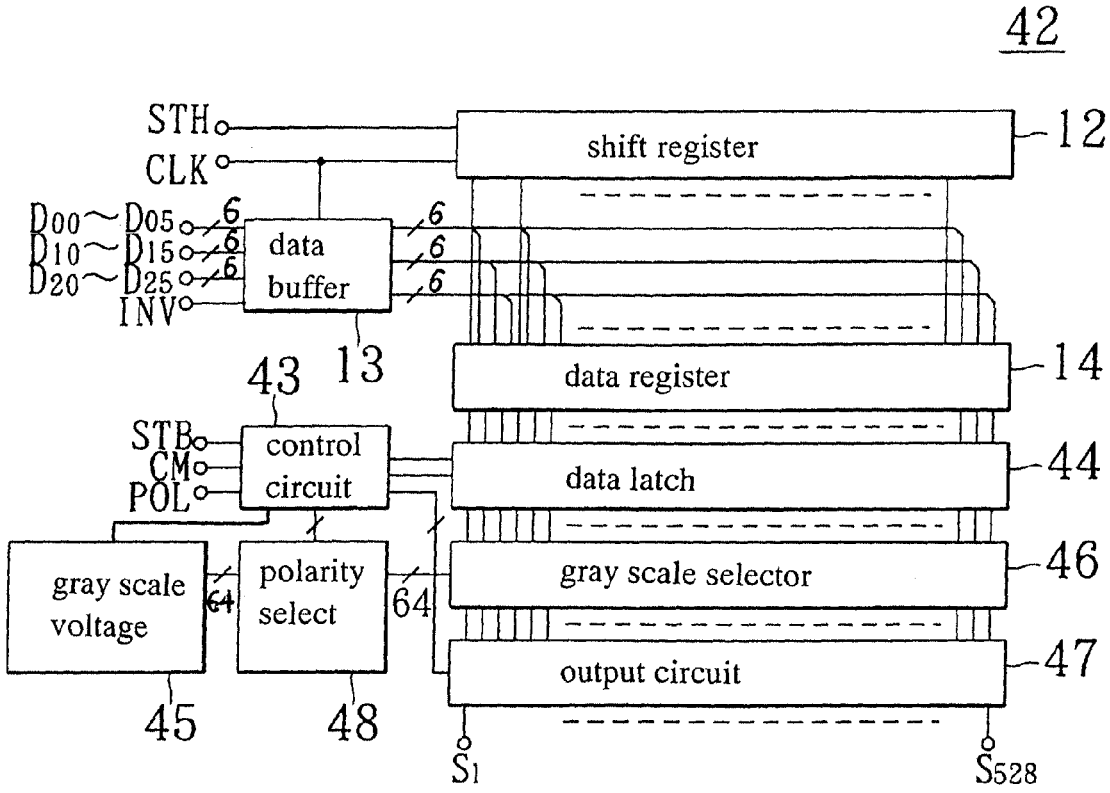
FIG. 10 is a block diagram illustrative of the data electrode driver circuit shown in FIG. 9.

FIG. 10 is a block diagram illustrative of the data electrode driver circuit shown in FIG. 9. It is assumed that a resolution of the color liquid crystal display 1 is defined by 176×220 pixels. Since each pixel comprises three-dots of red (R), green (G) and blue (B), then the color liquid crystal display 1 has a 528×220 dot-pixels.

The data electrode driver circuit 42 includes a shift register 12, a data buffer 13, a data register 14, a control circuit 43, a data latch 44, a gray scale voltage generating circuit 45, a gray scale voltage selecting circuit 46, an output circuit 47 and a polarity selecting circuit 48.

The shift register 12 is a serial-in parallel-out shift register which comprises 176 delay-flip-flops. The shift register 12 receives the clock signal CLK and the horizontal start pulse signal STH from the control circuit 41, so that the shift register 12 shifts the horizontal start pulse signal STH in synchronizing with the clock signal CLK, and generates sampling pulses SP1, SP2, - - - SP176 which comprise a 176-bits parallel-out signal.

The data buffer 13 receives the 18-bits display data D00-D05, D10-D15 and D20-D25 and the data inversion signal INV from the control circuit 41, so that the data buffer 13 performs an inversion operation of the 18-bits display data in accordance with the data inversion signal INV, so that the data buffer 13 outputs 18-bits display data D'00-D'05, D'10-D'15 and D'20-D'25.

Figure 11:
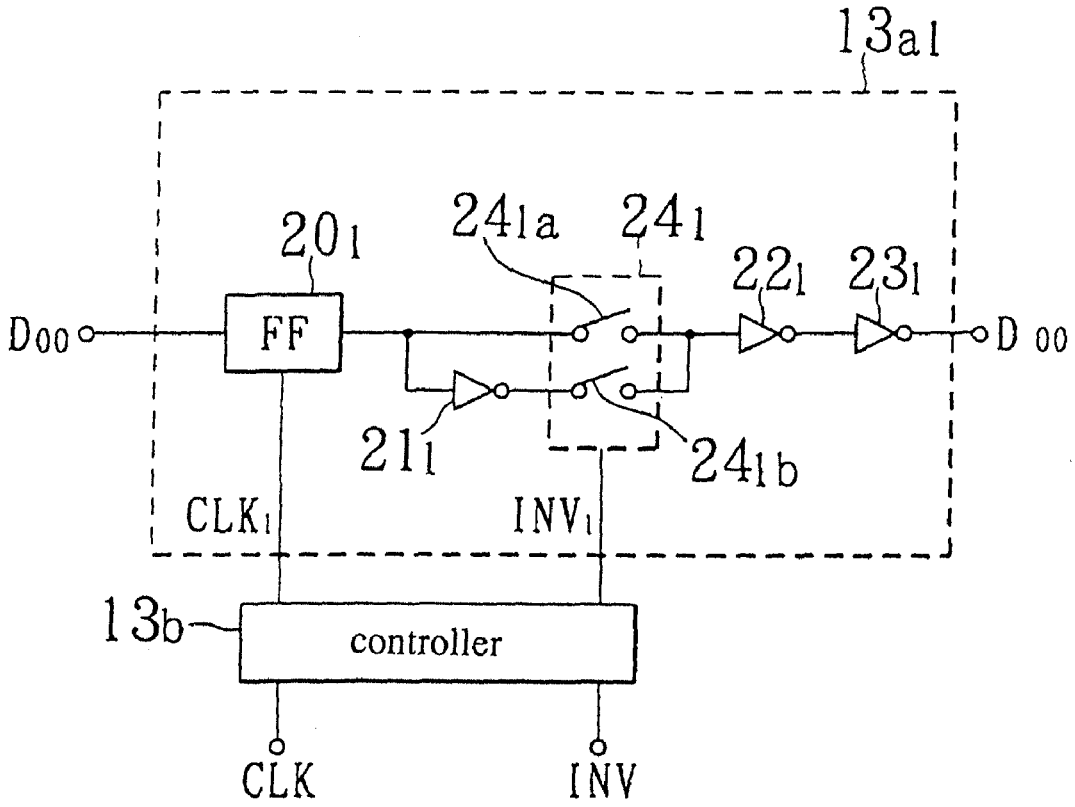
FIG. 11 is a partial circuit diagram illustrative of a part of the circuit configuration of the data buffer shown in FIG. 10.

FIG. 11 is a partial circuit diagram illustrative of a part of the circuit configuration of the data buffer shown in FIG. 10. The data buffer 13 comprises first to eighteenth data buffer circuits 13*a*1, 13*a*2, 13*a*3, - - - 13*a*18, and a single control unit 13*b*. The control unit 13*b* includes two series connections of plural inverters. The two series connections of plural inverters in the control unit 13*b* receive the data inversion signal INV and the clock signal CLK from the control circuit 41 respectively, so that the control unit 13*b* delays the data inversion signal INV and the clock signal CLK from the control circuit 41 by predetermined delay times respectively, whereby the control unit 13*b* supplies a delayed clock signal CLK1 and a delayed data inversion signal INV1 to the first data buffer circuit 13*a*1.

The control unit 13*b* also supplies other delayed clock signals CLK2, CLK3, - - - CLK18 and other delayed data inversion signals INV2, INV3 - - - INV18 to the remaining second to eighteenth data buffer circuits 13*a*2, 13*a*3, - - - 13*a*18, respectively. The first to eighteenth data buffer circuits 13*a*1, 13*a*2, 13*a*3, - - - 13*a*18 have the same circuit configuration and perform the same operations, for which reason the following description will focus on the first data buffer circuit 13*a*1 only.

The first data buffer circuit 13*a*1 includes a D-flip-flop 20-1, inverters 21-1, 22-1 and 23-1, and a switching circuit 24-1. The switching circuit 24-1 comprises two parallel switches 24-1*a* and 24-1*b*. The control unit 13*b* supplies the delayed clock signal CLK1 to the D-flip-flop 20-1 and the delayed data inversion signal INV1 to the switching circuit 24-1.

The D-flip-flop 20-1 latches a single bit display data D00 in synchronizing with the clock signal CLK1 for a term corresponding to the single pulse width of the clock signal CLK1, and outputs the single bit display data D00. The inverter 21-1 inverts the single bit display data D00, so that the inverted bit display data D00 is supplied to the switch 24-1*b*. The non-inverted bit display data D00 outputted from the D-flip-flop 20-1 is also directly supplied to the switch 24-1*a*.

If the delayed data inversion signal INV1 from the control unit 13*b* is high level "H", then the switching circuit 24-1*a* is placed in the ON-state, whilst the switching circuit 24-1*b* is placed in the OFF-state, whereby the non-inverted bit display data D00 is transmitted through the series connection of the inverters 22-1 and 23-1 to an output terminal as the output bit display data D'00.

If the delayed data inversion signal INV1 from the control unit 13*b* is low level "H", then the switching circuit 24-1*a* is placed in the OFF-state, whilst the switching circuit 24-1*b* is placed in the ON-state, whereby the inverted bit display data D00 is transmitted through the series connection of the inverters 22-1 and 23-1 to the output terminal as the output single bit display data D'00.

With reference again to FIG. 10, the data register 14 receives the 18-bits display data D'00-D'05, D'10-D'15 and D'20-D'25 from the data buffer 13 and also receives the sampling pulses SP1, SP2, - - - SP176 from the shift register 12. In synchronizing with the sampling pulses SP1, SP2, - - - SP176, the data register 14 accepts the inputs of the 18-bits display data D'00-D'05, D'10-D'15 and D'20-D'25 and transmits display data PD1, PD2, PD3, - - - PD528 to the data latch 44.

The control circuit 43 receives the strobe signal STB, the polarity signal POL and the color mode signal CM from the control circuit 41, so that the control circuit 43 generates a delayed strobe signal STB1, first and second delayed polarity signals POL1 and POL2, first and second delayed color mode signals CM1 and CM2, and a switch control signal SWA, as well as positive and negative switching signals Sswp and Sswn.

The delayed strobe signal STB1 is delayed by a predetermined delay time from the strobe signal STB. The first and second delayed polarity signals POL1 and POL2 are delayed from the polarity signal POL by predetermined different delay times respectively. The first and second delayed color mode signals CM1 and CM2 are delayed from the color mode signal CM by predetermined different delay times respectively. In the full-color mode, the switch control signal SWA is opposite in phase to the delayed strobe signal STB1. In the non-full-color mode or the 8-color mode, the switch control signal SWA is inactivated and fixed in the low level "L". In the full-color mode, the positive and negative switching signals Sswp and Sswn are activated to control the polarity selecting circuit 48 in operation. In the non-full-color mode or the 8-color mode, the positive and negative switching signals Sswp and Sswn are inactivated and fixed in the low level "L".

The control circuit 43 supplies the delayed strobe signal STB1 and the first delayed polarity signal POL1 to the data latch 44. The control circuit 43 also supplies the second delayed polarity signal POL2, the first delayed color mode signal CM1 and the switch control signal SWA to the output circuit 47. The control circuit 43 also supplies the second delayed color mode signal CM2 to the gray scale voltage generating circuit 45. The control circuit 43 also supplies the positive and negative switching signals Sswp and Sswn to the gray scale voltage generating circuit 45 and the polarity selecting circuit 48.

The data register 14 supplies the display data PD1, PD2, PD3, - - - PD528 to the data latch 44. The data latch 44 accepts the inputs of the display data PD1, PD2, PD3, - - - PD528 in synchronizing with a rising edge of the delayed strobe signal STB1 and holds the display data PD1, PD2, PD3, - - - PD528 for a time period of the horizontal synchronizing term or until receipt of the next rising edge of the delayed strobe signal STB1. The data latch 44 performs a voltage conversion of the display data PD1, PD2, PD3, - - - PD528 into voltage-converted 6-bits display data PD'1, PD'2, - - - PD'528, and further optionally perform, based on the first polarity signal POL1, an inversion operation of the voltage-converted display data, so that the data latch 44 outputs the 6-bits display data PD'1, PD'2, - - - PD'528.

The display data PD'1, PD'2, - - - PD'528 are then supplied to the gray scale voltage selecting circuit 46. The data latch 44 supplies most significant bits MSB1, MSB2, - - - , MSB528 of the display data PD'1, PD'2, - - - PD'528 to the output circuit 47, wherein the most significant bits MSB1, MSB2, - - - , MSB528 are respective most significant bits of the 6-bits display data PD'1, PD'2, - - - PD'528. For example, the most significant bit MSB1 comprises 1-bit as the most significant bit of the 6-bits display data PD'1. The most significant bit MSB528 comprises 1-bit as the most significant bit of the 6-bits display data PD'528.

The data latch 44 comprises first to five hundred twenty eighth data latch units 44-1, 44-2, 44-3, - - - , 44-528. The first to five hundred twenty eighth data latch units 44-1, 44-2, 44-3, - - - , 44-528 receive the display data PD1, PD2, PD3, - - - PD528 respectively from the data register 14. For example, the first data latch unit 44-1 receives the display data PD1. The five hundred twenty eighth data latch unit 44-528 receives the display data PD528. The first to five hundred twenty eighth data latch units 44-1, 44-2, 44-3, - - - , 44-528 have the same circuit configuration, for which reason the following description will focus on the first data latch unit 44-1.

Figure 12:
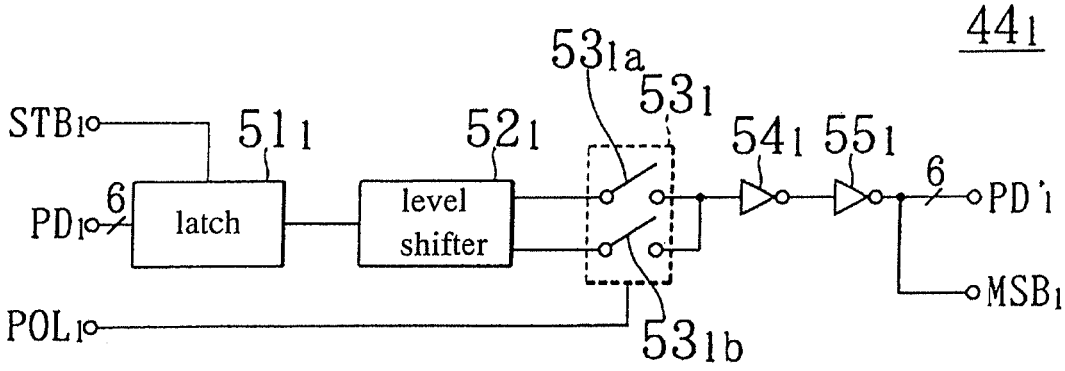
FIG. 12 is a diagram illustrative of the first data latch unit included in the data latch of the data electrode driver circuit shown in FIG. 10.

FIG. 12 is a diagram illustrative of the first data latch unit included in the data latch of the data electrode driver circuit shown in FIG. 10. The first data latch unit 44-1 comprises a latch circuit 51-1, a level shifter 52-1, a switching circuit 53-1, and a series connection of first and second inverters 54-1 and 55-1.

The latch circuit 51-1 accepts an input of the 6-bits display data PD1 from the data register 14 in synchronizing with a rising edge of the delayed strobe signal STB1, and then the latch circuit 51-1 holds the 6-bits display data PD1 for a horizontal time period of the delayed strobe signal STB1 or until the next rising edge of the delayed strobe signal STB1. In synchronizing with the next rising edge of the delayed strobe signal STB1, the latch circuit 51-1 outputs the 6-bits display data PD1 which are then supplied to the level shifter 52-1.

The level shifter 52-1 receives the 6-bits display data PD1 from the latch circuit 51-1. The level shifter 52-1 performs a voltage conversion of the 6-bits display data PD1, for example, from 3V to 5V to generate polarity-non-inverted voltage-converted display data. The level shifter 52-1 further performs a polarity inversion operation of the polarity-non-inverted voltage-converted display data to generate a polarity-inverted voltage-converted display data. The level shifter 52-1 outputs both the polarity-non-inverted voltage-converted display data and the polarity-inverted voltage-converted display data.

The switching circuit 53-1 comprises a parallel connection of first and second switches 53-1*a* and 53-1*b*. The switching circuit 53-1 also receives the first polarity signal POL1 from the control circuit 43. If the first polarity signal POL1 is high level "H", the second switch 53-1*b* turns OFF, whilst the first switch 53-1*a* turns ON, whereby the polarity-non-inverted voltage-converted display data is transmitted through the first switch 53-1*a* to the first inverter 54-1. The first inverter 54-1 inverts the display data from the switching circuit 53-1. The second inverter 55-1 further inverts the display data from the first inverter 54-1 and outputs a positive polarity 6-bits display data PD'1 and separately a most significant bit MSB1 of the positive polarity 6-bits display data PD'1.

If the first polarity signal POL1 is low level "L", the first switch 53-1*a* turns OFF, whilst the second switch 53-1*b* turns ON, whereby the polarity-inverted voltage-converted display data is transmitted through the second switch 53-1*b* to the first inverter 54-1. The first inverter 54-1 inverts the display data from the switching circuit 53-1. The second inverter 55-1 further inverts the display data from the first inverter 54-1 and outputs a negative polarity 6-bits display data PD'1 and separately a most significant bit MSB1 of the negative polarity 6-bits display data PD'1.

Consequently, if the first polarity signal POL1 is high level "H", then the first data latch 44-1 outputs the positive polarity 6-bits display data PD'1 and separately a most significant bit MSB1 of the positive polarity 6-bits display data PD'1. If the first polarity signal POL1 is low level "L", then the first data latch 44-1 outputs the negative polarity 6-bits display data PD'1 and separately a most significant bit MSB1 of the negative polarity 6-bits display data PD'1.

As described above, in accordance with the present invention, the display data PD1, PD2, - - - PD528 are inverted depending on the polarity signal POL on the prior stage to the gray scale voltage selecting circuit 46, so that the selectively inverted display data PD'1, PD'2, - - - PD'528 are supplied to the gray scale voltage selecting circuit 46. For this reason, it is unnecessary to perform any selective polarity-inversion operation of the first to sixty fourth gray scale voltages V1, V2, V3, - - - V64. Namely, the polarity of the first to sixty fourth gray scale voltages V1, V2, V3, - - - V64 is fixed in the gray scale voltage generating circuit 45.

The level shifter 52-1 is provided for converting 3V to 5V. For the purpose of reducing the power consumption and shrinkage of the chip size, a reduced power voltage of 3V is supplied to the shift register 12, the data buffer 13, the data register 14, the control circuit 43 and the data latch 44, whilst the power voltage of 5V is needed to drive the color liquid crystal display 1. For these reasons, the gray scale voltage selecting circuit 46 and the output circuit 47 should be driven in the range of 0V to 5V, and for driving the gray scale voltage selecting circuit 46 and the output circuit 47, it is necessary that the level shifter 52-1 converts 3V to 5V.

Figure 13:
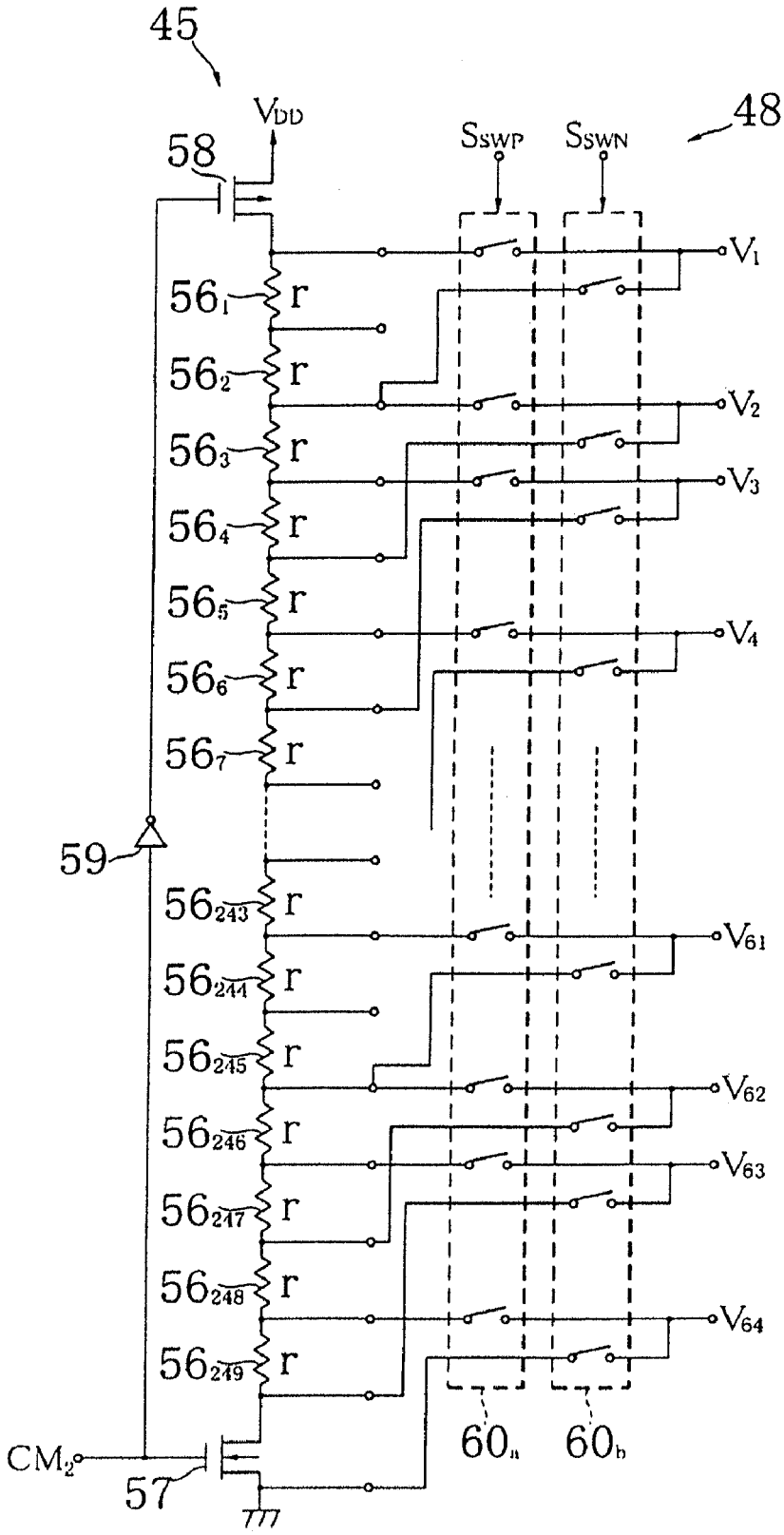
FIG. 13 is a circuit diagram illustrative of the gray scale voltage generating circuit and the polarity selecting circuit shown in FIG. 10.

FIG. 13 is a circuit diagram illustrative of the gray scale voltage generating circuit and the polarity selecting circuit shown in FIG. 10. The polarity selecting circuit 48 is coupled to the gray scale voltage generating circuit 45. The gray scale voltage generating circuit 45 comprises a single inverter 59, and a series connection of first to two hundred forty ninth resistances 56-1, 56-2, 56-3, - - - 56-249, an n-channel MOS field effect transistor 57 and a p-channel MOS field effect transistor 58, wherein the series connection is positioned between the power voltage VDD and the ground voltage GND. The first to two hundred forty ninth resistances 56-1, 56-2, 56-3, - - - 56-249 are connected in series between the n-channel MOS field effect transistor 57 and the p-channel MOS field effect transistor 58.

The n-channel MOS field effect transistor 57 is connected in series between the two hundred forty ninth resistance 56-249 and the ground voltage GND. The p-channel MOS field effect transistor 58 is connected in series between the power voltage VDD and the first resistance 56-1. The second delayed color mode signal CM2 is supplied directly to a gate of the n-channel MOS field effect transistor 57 and also indirectly to a gate of the p-channel MOS field effect transistor 58 through the inverter 59.

The first to two hundred forty ninth resistances 56-1, 56-2, 56-3, - - - 56-249 have a uniform resistance value "r". The series connection of the first to two hundred forty ninth resistances 56-1, 56-2, 56-3, - - - 56-249, the n-channel MOS field effect transistor 57 and the p-channel MOS field effect transistor 58 include first to two hundred fifty first nodes which generate two hundred fifty one divided voltages with respectively different voltage levels depending on the first to two hundred forty ninth resistances 56-1, 56-2, 56-3, - - - 56-249.

The gray scale voltage generating circuit 45 generates positive polarity first to sixty fourth gray scale voltages V1, V2, V3, - - - V64, and also generates negative polarity first to sixty fourth gray scale voltages V1, V2, V3, - - - V64 in response to the difference in applied voltage to transitivity characteristics of the liquid crystal cells between the positive polarity and the negative polarity of the applied voltage.

The gray scale voltage generating circuit 45 is responsible to both operational modes, for example, the full-color mode and the 8-color modes. In the full-color mode, the second color mode signal CM2 from the control circuit 43 is in the high level "H", then both the n-channel MOS field effect transistor 57 and the p-channel MOS field effect transistor 58 turn ON, whereby the series connection of the first to two hundred forty ninth resistances 56-1, 56-2, 56-3, - - - 56-249 is biased between the power voltage VDD and the ground voltage GND, whereby two hundred fifty one divided voltages are generated at the two hundred fifty first nodes.

The polarity selecting circuit 48 selects appropriate sixty four from the generated two hundred fifty one divided voltages in response to the positive polarity first to sixty fourth gray scale voltages V1, V2, V3, - - - V64, or also to the negative polarity first to sixty fourth gray scale voltages V1, V2, V3, - - - V64. This selection by the polarity selecting circuit 48 is made depending on the applied voltage to transitivity characteristics of the color liquid crystal display 1. Since the first to two hundred forty ninth resistances 56-1, 56-2, 56-3, - - - 56-249 have the uniform resistance value "r", and if the power voltage is 5V, then adjacent two of the generated two hundred fifty one divided voltages have a constant difference of 20 mV.

In the 8-color mode, the second color mode signal CM2 from the control circuit 43 is in the low level "L", then both the n-channel MOS field effect transistor 57 and the p-channel MOS field effect transistor 58 turn OFF, whereby the series connection of the first to two hundred forty ninth resistances 56-1, 56-2, 56-3, - - - 56-249 is isolated from the power voltage VDD and the ground voltage GND, whereby no current flows through the series connection of the first to two hundred forty ninth resistances 56-1, 56-2, 56-3, - - - 56-249, resulting in no generations of the divided voltages at the two hundred fifty first nodes. In the 8-color mode, the gray scale voltage generating circuit 45 is inactivated to display without using any gray scale.

The data electrode driver circuit 42 including the gray scale voltage generating circuit 45 may comprise a semiconductor integrated circuit. For forming the semiconductor integrated circuit, it is preferable to use a common mask for forming the first to two hundred forty ninth resistances 56-1, 56-2, 56-3, - - - 56-249. Routine of interconnections between the two hundred fifty first nodes of the gray scale voltage generating circuit 45 and the polarity selecting circuit 48 may preferably be made depending on the applied voltage to transitivity characteristics of the color liquid crystal display 1. The first to two hundred forty ninth resistances 56-1, 56-2, 56-3, - - - 56-249 may also preferably comprise aluminum patterns in an aluminum interconnection layer.

The polarity selecting circuit 48 includes a first switching group 60*a* on a first stage and a second switching group 60*b* on a second stage. The first switching group 60*a* includes parallel connections of first to sixty fourth switches which are controllable by the positive switching signal Sswp. The second switching group 60*b* also includes parallel connections of first to sixty fourth switches which are controllable by the negative switching signal Sswn. The polarity selecting circuit 48 includes first to sixty fourth output nodes which generate the first to sixty fourth gray scale voltages V1, V2, V3, - - - V64 respectively.

The first to sixty fourth switches of the first switching group 60*a* are coupled to the first to sixty fourth output nodes. The first to sixty fourth switches of the second switching group 60*b* are also coupled to the first to sixty fourth output nodes. For example, the first switch in the first switching group 60*a* and the first switch in the second switching group 60*b* are connected to the first output node in parallel to each other. The first switch in the first switching group 60*a* is provided to perform a selective connection between the first node between the p-channel MOS field effect transistor 58 and the first resistance 56-1 and the first output node for generating the positive polarity first gray scale voltage V1.

The first switch in the second switching group 60*b* is provided to perform another selective connection between the third node between the second resistance 56-2 and the third resistance 56-3 and the first output node for generating the negative polarity first gray scale voltage V1.

For example, the sixty fourth switch in the first switching group 60*a* and the sixty fourth switch in the second switching group 60*b* are connected to the sixty fourth output node in parallel to each other. The sixty fourth switch in the first switching group 60*a* is provided to perform a selective connection between the two hundred forty ninth node between the two hundred forty eighth resistance 56-248 and the two hundred forty ninth resistance 56-249 and the sixty fourth output node for generating the positive polarity sixty fourth gray scale voltage V64. The sixty fourth switch in the second switching group 60*b* is provided to perform another selective connection between the two hundred fifty first node between the two hundred forty ninth resistance 56-249 and the n-channel MOS field effect transistor 57 and the sixty fourth output node for generating the negative polarity sixty fourth gray scale voltage V64.

In the full-color mode, the polarity selecting circuit 48 is activated to perform such an output operation that one of the positive-polarity and negative polarity gray scale signals is selected by the positive and negative switching signals Sswp and Sswn for each of the first to sixty fourth output nodes. For example, one of the positive-polarity first gray scale voltage V1 and the negative-polarity first gray scale voltage V1 is selected by the positive and negative switching signals Sswp and Sswn, for supplying the selected-polarity first gray scale voltage V1 at the first output node. Similarly, one of the positive-polarity sixty fourth gray scale voltage V64 and the negative-polarity sixty fourth gray scale voltage V64 is selected by the positive and negative switching signals Sswp and Sswn, for supplying the selected-polarity sixty fourth gray scale voltage V64 at the sixty fourth output node.

In the full-color mode, exclusive one of the positive and negative switching signals Sswp and Sswn is selectively placed in high level "H". If the positive switching signal Sswp is in the high level "H", then the first to sixty fourth switches of the first switching group 60*a* turn ON. If the negative switching signal Sswn is in the high level "H", then the first to sixty fourth switches of the second switching group 60*b* turn ON.

Routines of interconnections between the first to sixty fourth switches in the first switching group 60*a* and the gray scale voltage generating circuit 45 as well as of interconnections between the first to sixty fourth switches in the second switching group 60*b* and the gray scale voltage generating circuit 45 depend on the applied voltage to transitivity characteristics of the color liquid crystal display 1.

If the positive switching signal Sswp is in the high level "H" and the negative switching signal Sswn is in the low level "L", then the first to sixty fourth switches of the first switching group 60*a* turn ON and the first to sixty fourth switches of the second switching group 60*b* turn OFF, whereby sixty four divided voltages generated at the sixty four nodes which are respectively connected to the first to sixty fourth switches of the first switching group 60*a* are outputted as the positive polarity first to sixty fourth gray scale voltages V1, V2, V3, - - - V64 from the first to sixty fourth output nodes.

If the positive switching signal Sswp is in the low level "L" and the negative switching signal Sswn is in the high level "H", then the first to sixty fourth switches of the first switching group 60*a* turn OFF and the first to sixty fourth switches of the second switching group 60*b* turn ON, whereby other sixty four divided voltages generated at the other sixty four nodes which are respectively connected to the first to sixty fourth switches of the second switching group 60*b* are outputted as the negative polarity first to sixty fourth gray scale voltages V1, V2, V3, - - - V64 from the first to sixty fourth output nodes.

In the 8-color mode, the polarity selecting circuit 48 is inactivated by always fixed low levels of the positive and negative switching signals Sswp and Sswn, no gray scale voltages are outputted from the first to sixty fourth output nodes.

Figure 14:
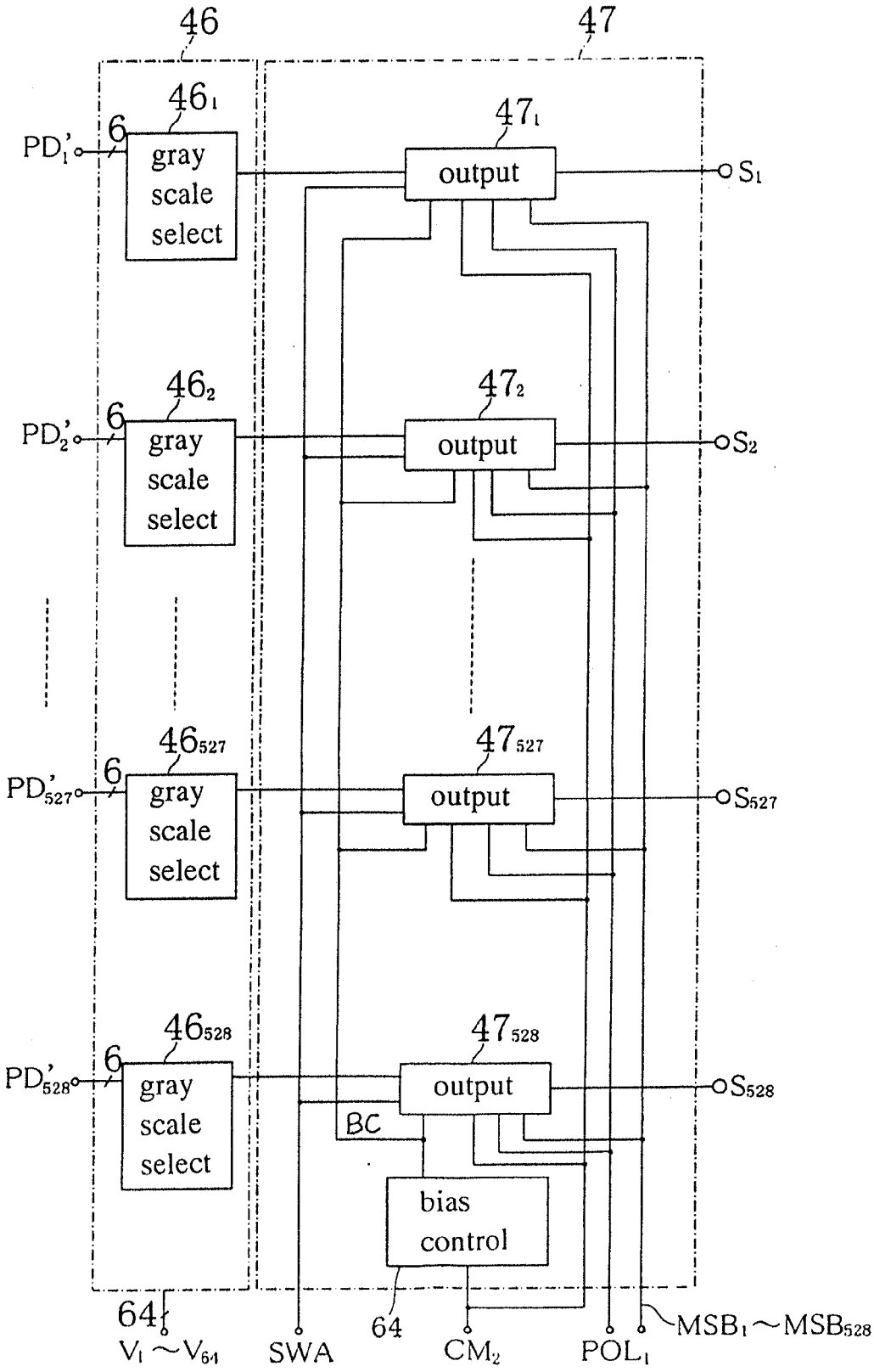
FIG. 14 is a block diagram illustrative of the gray scale voltage selecting circuit and the output circuit shown in FIG. 10.

FIG. 14 is a block diagram illustrative of the gray scale voltage selecting circuit and the output circuit shown in FIG. 10. The gray scale voltage selecting circuit 46 comprises first to five hundred twenty eighth gray scale voltage selecting units 46-1, 46-2, 46-3, - - - , 46-528. The polarity selecting circuit 48 supplies the positive-polarity or negative polarity first to sixty fourth gray scale voltages V1, V2, V3, - - - V64 to each of the first to five hundred twenty eighth gray scale voltage selecting units 46-1, 46-2, 46-3, - - - , 46-528 in parallel. Namely, each of the first to five hundred twenty eighth gray scale voltage selecting units 46-1, 46-2, 46-3, - - - , 46-528 receives 64-bits gray scale signals from the polarity selecting circuit 48.

The first to five hundred twenty eighth gray scale voltage selecting units 46-1, 46-2, 46-3, - - - , 46-528 also receive the 6-bits display data PD'1, PD'2, - - - PD'528 from the first to five hundred twenty eighth data latch units 44-1, 44-2, 44-3, - - - 44-528 respectively. For example, the first gray scale voltage selecting unit 46-1 receives the 6-bits display data PD'1 from the first data latch unit 44-1 in the data latch 44. The second gray scale voltage selecting unit 46-2 receives the 6-bits display data PD'2 from the second data latch unit 44-2 in the data latch 44. Similarly, the five hundred twenty eighth gray scale voltage selecting unit 46-528 receives the 6-bits display data PD'528 from the five hundred twenty eighth data latch unit 44-528 in the data latch 44.

Each of the first to five hundred twenty eighth gray scale voltage selecting units 46-1, 46-2, 46-3, - - - , 46-528 performs to select one of the positive-polarity or negative-polarity first to sixty fourth gray scale voltages V1, V2, V3, - - - V64 based on the received 6-bits display data. The 6-bits display data designates one of the first to sixty fourth gray scale voltages V1, V2, V3, - - - V64. For example, the first gray scale voltage selecting unit 46-1 selects one of the positive-polarity or negative-polarity first to sixty fourth gray scale voltages V1, V2, V3, - - - V64 based on the received 6-bits display data PD'1. The second gray scale voltage selecting unit 46-2 selects one of the positive-polarity or negative-polarity first to sixty fourth gray scale voltages V1, V2, V3, - - - V64 based on the received 6-bits display data PD'2. Similarly, the five hundred twenty eighth gray scale voltage selecting unit 46-528 selects one of the positive-polarity or negative-polarity first to sixty fourth gray scale voltages V1, V2, V3, - - - V64 based on the received 6-bits display data PD'528.

The first to five hundred twenty eighth gray scale voltage selecting units 46-1, 46-2, 46-3, - - - , 46-528 have the same circuit configuration, for which reason the following description will focus only on the first gray scale voltage selecting unit 46-1.

As shown in FIG. 14, the output circuit 47 comprises first to five hundred twenty eighth output units 47-1, 47-2, 47-3, - - - 47-528 and a single bias current control circuit 64. The first to five hundred twenty eighth output units 47-1, 47-2, 47-3, - - - 47-528 are coupled to the first to five hundred twenty eighth gray scale voltage selecting units 46-1, 46-2, 46-3, - - - , 46-528 respectively. Each of the first to five hundred twenty eighth output units 47-1, 47-2, 47-3, - - - 47-528 is also coupled to the single bias current control circuit 64 for receiving a controlled bias current BC from the bias current control circuit 64.

Each of the first to five hundred twenty eighth output units 47-1, 47-2, 47-3, - - - 47-528 also receives the switch control signal SWA, the second delayed color mode signal CM2, and the first delayed polarity signal POL1. Further, the first to five hundred twenty eighth output units 47-1, 47-2, 47-3, - - - 47-528 receive the most significant bit signals MSB1, MSB2, MSB3, - - - MSB528, respectively. For example, the first output unit 47-1 receives the most significant bit signal MSB1 of 1-bit. The second output unit 47-2 receives the most significant bit signal MSB2 of 1-bit. The five hundred twenty eighth output unit 47-528 receives the most significant bit signal MSB528 of 1-bit.

The first to five hundred twenty eighth output units 47-1, 47-2, 47-3, - - - 47-528 have the same circuit configuration, for which reason the following description will focus only on the first output unit 47-1.

Figure 15:
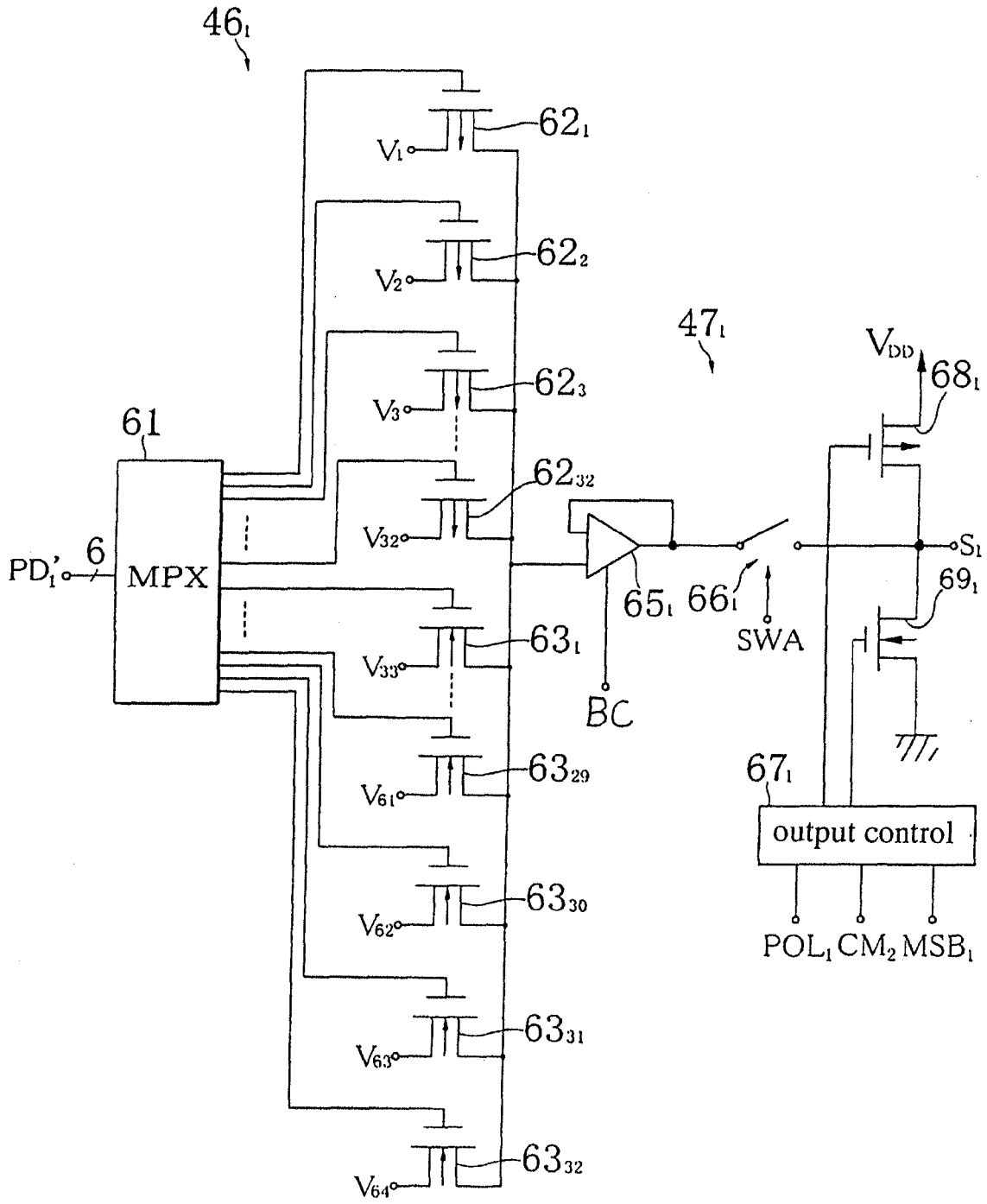
FIG. 15 is a circuit diagram illustrative of the first gray scale voltage selecting unit included in the gray scale voltage selecting circuit and the first output unit included in the output circuit shown in FIG. 14.

FIG. 15 is a circuit diagram illustrative of the first gray scale voltage selecting unit included in the gray scale voltage selecting circuit and the first output unit included in the output circuit shown in FIG. 14. The first gray scale voltage selecting unit 46-1 comprises a single multiplexer 61, and parallel connections of first to thirty second p-channel MOS field effect transistors 62-1, 62-2, 62-3, - - - 62-32, and first to thirty second n-channel MOS field effect transistors 63-1, 63-2, 63-3, - - - 63-32.

The first to thirty second p-channel MOS field effect transistors 62-1, 62-2, 62-3, - - - 62-32, and the first to thirty second n-channel MOS field effect transistors 63-1, 63-2, 63-3, - - - 63-32 are connected in series between a common output node and the first to sixty fourth output nodes of the polarity selecting circuit 48, wherein the first to sixty fourth gray scale voltages 1, V2, V3, - - - V64 appear at the first to sixty fourth output nodes of the polarity selecting circuit 48 respectively.

The multiplexer 61 receives the 6-bits display data PD'1 from the first data latch unit 44-1 included in the data latch 44. The 6-bits display data PD'1 designates one of the first to thirty second p-channel MOS field effect transistors 62-1, 62-2, 62-3, - - - 62-32, and the first to thirty second n-channel MOS field effect transistors 63-1, 63-2, 63-3, - - - 63-32. The multiplexer 61 makes the designated MOS field effect transistor turn ON based on the 6-bits display data PD'1, whereby the designated MOS field effect transistor allows that corresponding one of the first to sixty fourth gray scale voltages V1, V2, V3, - - - V64 to the designated MOS field effect transistor is transmitted through the output node of the first gray scale voltage selecting unit 46-1 to the first output unit 47-1 included in the output circuit 47.

For example, if the first p-channel MOS field effect transistor 62-1 is designated by the 6-bits display data PD'1, then the first p-channel MOS field effect transistor 62-1 allows the first gray scale voltage V1 to be transmitted through the common output node to the first output unit 47-1 included in the output circuit 47. If the first n-channel MOS field effect transistor 63-1 is designated by the 6-bits display data PD'1, then the first n-channel MOS field effect transistor 63-1 allows the thirty third gray scale voltage V33 to be transmitted through the common output node to the first output unit 47-1 included in the output circuit 47. The outputted gray scale voltage serves as a data red, green or blue signal.

In this embodiment, the p-channel and n-channel MOS field effect transistors have the same number of 32 respectively. The respective numbers of the p-channel and n-channel MOS field effect transistors are optional, provided that the total number of the p-channel and n-channel MOS field effect transistors is 64 in correspondence to the first to sixty fourth gray scale voltages V1, V2, V3, - - - V64.

The first output unit 47-1 comprises an amplifier 65-1, a switch 66-1, an output control circuit 67-1, a p-channel MOS field effect transistor 68-1, and an n-channel MOS field effect transistor 69-1. The amplifier 65-1 is selectively biased by the controlled bias current BC supplied from the bias current control circuit 64. The amplifier 65-1 has a first input connected to an output thereof and a second input coupled to the common output node for receiving the data red, green or blue color signal from the first gray scale voltage selecting unit 46-1. In the full-color mode, the amplifier 65-1 is biased by the controlled bias current BC supplied from the bias current control circuit 64, whereby the amplifier 65-1 is activated to amplify the data red, green or blue color signal. In the 8-color mode, the amplifier 65-1 is not biased, whereby the amplifier 65-1 is inactivated.

The switch 66-1 performs a switching operation based on the switch control signal SWA. In the full-color mode, the switch 66-1 performs a switching ON-OFF operation based on the switch control signal SWA for allowing selective transmission of the amplified data red, green or blue color signal S1 to the output node of the first output unit 47-1. In the 8-color mode, the switch 66-1 is always fixed at OFF by the switch control signal SWA, whereby no primary three color signal appears at the output node of the first output unit 47-1.

The output control circuit 67-1 receives the first delayed polarity signal POL1, the second delayed color mode signal CM2 and the most significant bit signal MSB1. The p-channel MOS field effect transistor 68-1 and the n-channel MOS field effect transistor 69-1 are connected in series between the power voltage VDD and the ground voltage GND. Drains of the p-channel MOS field effect transistor 68-1 and the n-channel MOS field effect transistor 69-1 are connected to the output node of the first output unit 47-1.

In the full-color mode, the second delayed color mode signal CM2 is high level "H", then the output control circuit 67-1 disregards the first delayed polarity signal POL1 and the most significant bit signal MSB1, and also the output control circuit 67-1 makes both the p-channel MOS field effect transistor 68-1 and the n-channel MOS field effect transistor 69-1 turn OFF, whereby the amplified data red, green or blue color signal S1 is transmitted through the output node of the first output unit 47-1 to the data electrode of the color liquid crystal display 1.

In the 8-color mode, the second delayed color mode signal CM2 is low level "L", then the output control circuit 67-1 makes one of the p-channel MOS field effect transistor 68-1 and the n-channel MOS field effect transistor 69-1 turn ON and another turn OFF based on both the first delayed polarity signal POL1 and the most significant bit signal MSB1, whereby one of the power voltage VDD and the ground voltage GND is transmitted through the output node of the first output unit 47-1 to the data electrode of the color liquid crystal display 1. As described above, in the 8-color mode, the amplifier 65-1 is inactivated and no data red, green or blue color signal is supplied from the amplifier 65-1.

In the 8-color mode, the predetermined high and low voltages are selectively applied to the data electrode for causing a predetermined large difference in rightness of the pixel. For this reason, it is possible to selectively apply a different high voltage than the power voltage and another different low voltage than the ground voltage to the data electrode.

Figure 16:
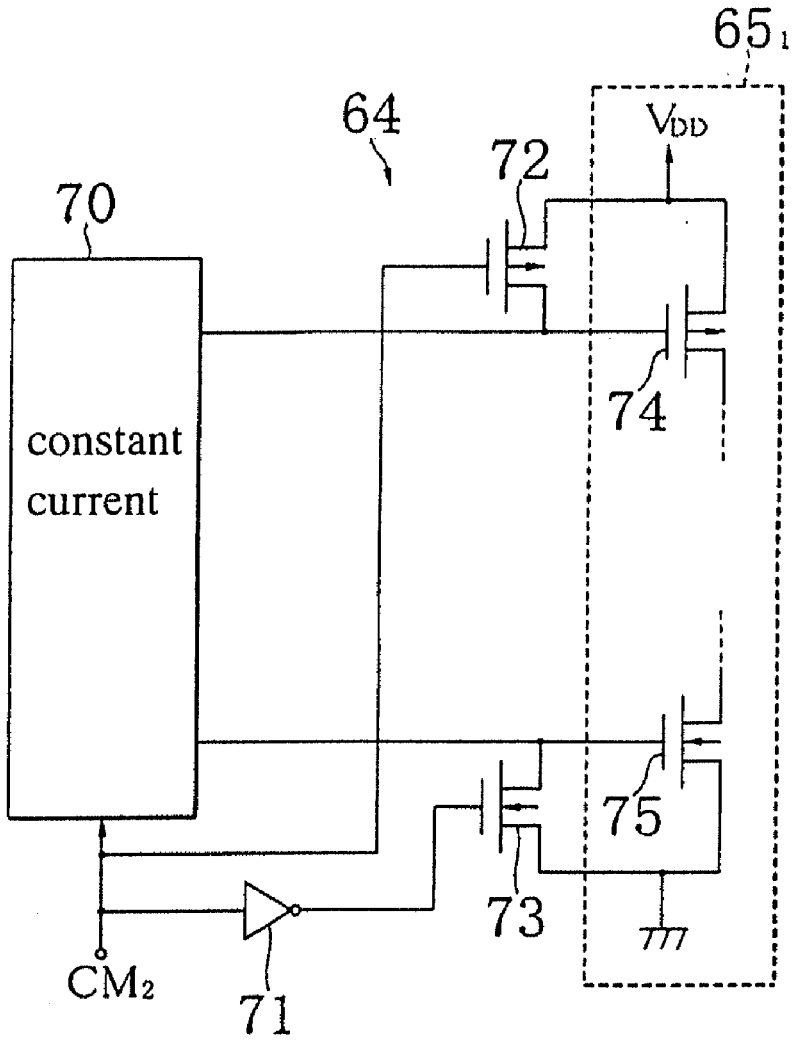
FIG. 16 is a circuit diagram illustrative of the bias current control circuit included in the output circuit shown in FIG. 14 as well as of a part of the amplifier included in the first output unit shown in FIG. 15.

FIG. 16 is a circuit diagram illustrative of the bias current control circuit included in the output circuit shown in FIG. 14 as well as of a part of the amplifier included in the first output unit shown in FIG. 15. The bias current control circuit 64 supplies a controlled bias current to the amplifier 65-1. The bias current control circuit 64 comprises a constant current circuit 70, an inverter 71, a p-channel MOS field effect transistor 72 and an n-channel MOS field effect transistor 73. The second delayed color mode signal CM2 is supplied from the control circuit 43 to the constant current circuit 70 and also to a gate of the p-channel MOS field effect transistor 72 as well as through the inverter 71 to a gate of the n-channel MOS field effect transistor 73. The amplifier 65-1 includes a p-channel MOS field effect transistor 74 connected to the power voltage VDD and an n-channel MOS field effect transistor 75 connected to the ground voltage GND.

In the full-color mode, the second delayed color mode signal CM2 is high level "H", whereby the constant current circuit 70 is activated to generate constant bias currents. Further, both the p-channel MOS field effect transistor 72 and the n-channel MOS field effect transistor 73 turn OFF. The generated constant bias currents are supplied to the gates of the p-channel MOS field effect transistor 74 and the n-channel MOS field effect transistor 75.

In the 8-color mode, the second delayed color mode signal CM2 is low level "L", whereby the constant current circuit 70 is inactivated to generate no current. Further, both the p-channel MOS field effect transistor 72 and the n-channel MOS field effect transistor 73 turn ON, whereby the power voltage VDD is supplied through the p-channel MOS field effect transistor 72 to the gate of the p-channel MOS field effect transistor 74, and also the ground voltage GND is supplied through the n-channel MOS field effect transistor 73 to the gate of the n-channel MOS field effect transistor 75.

Driving operations to the color liquid crystal display 1 by the above-described driving circuit will be described hereinafter, with focusing operations of the control circuit 41, the common power supply 4 and the data electrode driver circuit 42, assuming that the driver circuit is applied to the mobile phone having a normal full-color mode and a power saving 8-color mode.

Figure 17:
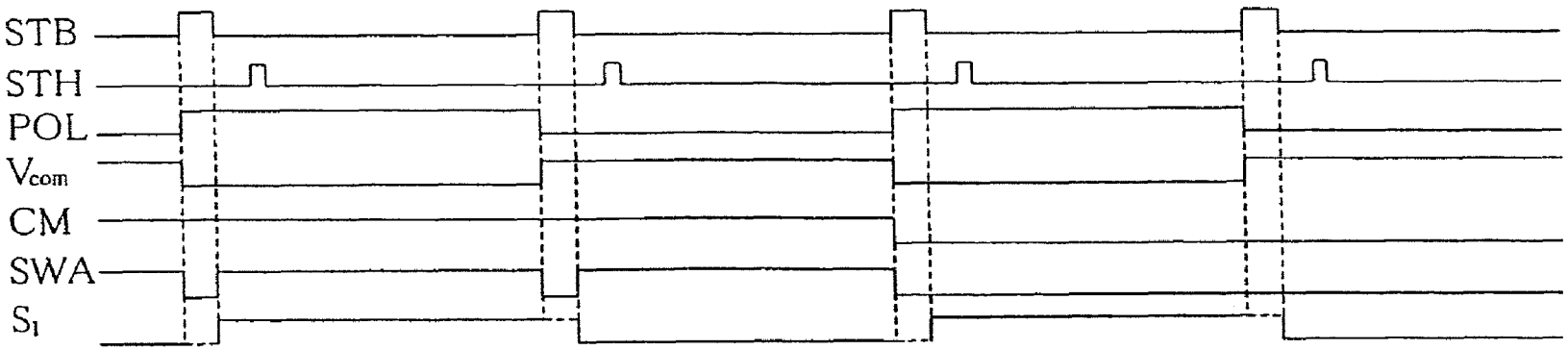
FIG. 17 is a timing chart illustrative of operations of the control circuit, the common power supply and the data electrode driver circuit included in the driver circuit shown in FIG. 9.

FIG. 17 is a timing chart illustrative of operations of the control circuit, the common power supply and the data electrode driver circuit included in the driver circuit shown in FIG. 9. The descriptions will be made for the normal full-color mode and the power saving 8-color mode, separately.

(1) Normal Full-Color Mode:

If the power saving mode signal PS is low level "L", then the driver circuit is in the normal full-color mode, wherein static and/or dynamic images are displayed in full-color on the color liquid crystal display 1 of the mobile phone. The power saving mode signal PS is an externally supplied signal based on operation by use to the mobile phone. If the user intends to display, in full-color, contents on the screen of the color liquid crystal display 1 of the mobile phone, then the user operates the mobile phone to set the power saving mode signal PS in the low level "L". The contents may, for example, be supplied from Word Wide Web Server through Internet.

The power saving mode signal PS in the low level "L" is supplied to the control circuit 41, whereby the control circuit 41 supplies the color mode signal CM of high level "H" to the data electrode driver circuit 42. The control circuit 41 also supplies the data electrode driver circuit 42 with the clock signal CLK, the strobe signal STB, the horizontal start pulse signal STH, and the polarity signal POL. The horizontal start pulse signal STH is delayed by a few pulses of the clock signal CLK from the strobe signal STB. At almost the same time, the control circuit 41 converts the externally supplied 6-bits red data $D_R$, 6-bits green data $D_G$, and 6-bits blue data $D_B$ into the 18-bits display data D00-D05, D10-D15 and D20-D25, and then the control circuit 41 supplies the 18-bits display data D00-D05, D10-D15 and D20-D25 to the data electrode driver circuit 42.

The control circuit 43 in the data electrode driver circuit 42 receives the strobe signal STB, the polarity signal POL, and the color mode signal CM of high level "H" from the control circuit 41. The control circuit 43 generates the strobe signal STB1, the first polarity signal POL1, the second polarity signal POL2, the first color mode signal CM1 of high level "H", the second color mode signal CM2 of high level "H", the switch control signal SWA, and the positive and negative switching signals Sswp and Sswn, based on the strobe signal STB, the polarity signal POL, and the color mode signal CM of high level "H".

The control circuit 43 supplies the strobe signal STB1 and the first polarity signal POL1 to the data latch 44. The control circuit 43 also supplies the second polarity signal POL2, the first color mode signal CM1, and the switch control signal SWA to the output circuit 47. The control circuit 43 also supplies the second color mode signal CM2 to the gray scale voltage generating circuit 45. The control circuit 43 also supplies the positive and negative switching signals Sswp and Sswn to the polarity selecting circuit 48.

In synchronizing with the clock signal CLK1, the shift register 12 in the data electrode driver circuit 42 performs to shift the horizontal start pulse signal STH as well as to output 176-bits sampling pulse signals SP1-SP176. In synchronizing with the clock signal CLK1 which is delayed by a predetermined time from the clock signal CLK, the data buffer 13 holds the 18-bits display data D00-D05, D10-D15 and D20-D25 for a time period corresponding to a single pulse width of the clock signal CLK1, and then outputs the 18-bits display data D'00-D'05, D'10-D'15 and D'20-D'25 which are then supplied to the data register 14.

In synchronizing with the 176-bits sampling pulse signals SP1-SP176 supplied from the shift register 12, the data register 14 accepts series inputs of the 18-bits display data D'00-D'05, D'10-D'15 and D'20-D'25 as the 6-bits display data PD1, PD2, - - - PD528. In synchronizing with the rising edge of the strobe signal STB1, the data latch 44 accepts simultaneous inputs of the 6-bits display data PD1, PD2, - - - PD528, so that the latch circuits 51-1, 51-2, 51-3, - - - 51-528 in the data latch 44 respectively hold the 6-bits display data PD1, PD2, - - - PD528 for a single horizontal synchronizing time period. The 6-bits display data PD1, PD2, - - - PD528 are then supplied to the level shifters 52-1, 52-2, 52-3, - - - 52-528, respectively.

If the polarity signal POL is high level "H", then the 6-bits display data PD1, PD2, - - - PD528 are converted in voltage from 3V to 5V by the level shifters 52-1, 52-2, 52-3, - - - 52-528 respectively. The voltage converted 6-bits display data PD1, PD2, - - - PD528 are then transmitted through the switching circuits 53-1, 53-2, 53-3, - - - 53-528, and the inverters 54-1, 54-2, 54-3, - - - 54-528 to the inverters 55-1, 55-2, 55-3, - - - 55-528, whereby the voltage converted 6-bits display data PD1, PD2, - - - PD528 are outputted as the positive polarity 6-bits display data PD'1, PD'2, - - - PD'528.

If the polarity signal POL is low level "L", then the 6-bits display data PD1, PD2, - - - PD528 are converted in voltage from 3V to 5V by the level shifters 52-1, 52-2, 52-3, - - - 52-528 respectively, and further the voltage converted 6-bits display data PD1, PD2, - - - PD528 are inverted. The inverted 6-bits display data PD1, PD2, - - - PD528 are then transmitted through the switching circuits 53-1, 53-2, 53-3, - - - 53-528, and the inverters 54-1, 54-2, 54-3, - - - 54-528 to the inverters 55-1, 55-2, 55-3, - - - 55-528, whereby the inverted 6-bits display data PD1, PD2, - - - PD528 are outputted as the negative polarity 6-bits display data PD'1, PD'2, - - - PD'528.

In this case, the latch circuits 51-1, 51-2, 51-3, - - - 51-528 in the data latch 44 outputs the most significant bit signals MSB1, MSB2, MSB3, - - - , MSB528, respectively. The most significant bit signals MSB1, MSB2, MSB3, - - - , MSB528 are to be used only in the power saving 8-color mode. Namely, in the full-color mode, the most significant bit signals MSB1, MSB2, MSB3, - - - , MSB528 are not used.

The circuit 43 supplies the gray scale voltage generating circuit 45 with the second delayed color mode signal CM2 of high level "H", whereby both the n-channel MOS field effect transistor 57 and the p-channel MOS field effect transistor 58 in the gray scale voltage generating circuit 45 are placed in ON-state, whereby the series connection of the first to two hundred forty ninth resistances 56-1, 56-2, 56-3, - - - 56-249 is biased between the power voltage VDD and the ground voltage GND, and two hundred fifty one divided voltages are generated at the two hundred fifty first nodes.

If the polarity signal POL is high level "H", then the control circuit 43 supplies the polarity selecting circuit 48 with the positive switching signal Sswp of high level "H" and the negative switching signal Sswn of low level "L". The first to sixty fourth switches of the first switching group 60*a* turn ON, whilst the first to sixty fourth switches of the second switching group 60*b* turn OFF. The positive polarity first to sixty fourth gray scale voltages V1, V2, V3, - - - V64 are outputted and supplied to the gray scale voltage selecting circuit 46.

In each of the first to five hundred twenty eighth gray scale voltage selecting units 46-1, 46-2, 46-3, - - - , 46-528 in the gray scale voltage selecting circuit 46, the multiplexer 61 selects one of the p-channel MOS field effect transistors 62-1, 62-2, 62-3, - - - 62-32 and the n-channel MOS field effect transistors 63-1, 63-2, 63-3, - - - 63-32, based on the received 6-bits display data PD'1, PD'2, - - - PD'528, whereby the selected one of the p-channel MOS field effect transistors 62-1, 62-2, 62-3, - - - 62-32 and the n-channel MOS field effect transistors 63-1, 63-2, 63-3, - - - 63-32 turns ON, whereby corresponding one of the positive polarity first to sixty fourth gray scale voltages V1, V2, V3, - - - V64 to the MOS field effect transistor placed in ON-state is transmitted as the data red, green or blue signal to the amplifiers 65-1, 65-2, 65-3, - - - 65-528 in the output circuit 47.

The bias current control circuit 64 receives the second delayed color mode signal CM2 of high level "H" from the control circuit 43. The constant current circuit 70 in the bias current control circuit 64 performs to supply the constant bias currents to the gates of the p-channel and n-channel MOS field effect transistors 74 and 75 in each of the amplifiers 65-1, 65-2, 65-3, - - - 65-528 in the output units 47-1, 47-2, 47-3, - - - 47-528, wherein the p-channel and n-channel MOS field effect transistors 72 and 73 in the bias current control circuit 64 turn OFF.

In the output units 47-1, 47-2, 47-3, - - - 47-528 in the output circuit 47, the output control circuits 67-1, 67-2, 67-3, - - - 67-528 place, into OFF-state, the corresponding pairs of the p-channel MOS field effect transistors 68-1, 68-2, 68-3, - - - 68-528 and the n-channel MOS field effect transistors 69-1, 69-2, 69-3, - - - 69-528, respectively.

The first to five hundred twenty eighth gray scale voltage selecting units 46-1, 46-2, 46-3, - - - , 46-528 in the gray scale voltage selecting circuit 46 supply the corresponding data red, green and blue signals to the amplifiers 65-1, 65-2, 65-3, - - - , 65-528 in the output circuit 47. The data red, green and blue signals are amplified by the amplifiers 65-1, 65-2, 65-3, - - - , 65-528 in the output circuit 47 respectively. The amplified data red, green and blue signals are transmitted through switching operations of the switches 66-1, 66-2, 66-3, - - - , 66-528 under the control by the switch control signal SWA which is risen in synchronizing with the rising edge of the strobe signal STB. The amplified data red, green and blue signals are then supplied as the data red, green and blue signals S1, S2, S3, - - - S528 to the corresponding data electrodes of the color liquid crystal display 1.

In FIG. 17, one example of the data red signal S1 is shown if the 6-bit display data PD1 is "000000". The data latch unit 44-1 outputs the 6-bits display data PD'1 "000000" which is the same as the latched original 6-bits display data PD1 "000000". In the first gray scale voltage selecting unit 46-1, the multiplexer 61 makes the p-channel MOS field effect transistor 62-1 turn ON based on the 6-bits display data PD'1 "000000", whereby the first gray scale voltage V1, which is closest to the power voltage level VDD, is outputted as the data red signal S1.

In FIG. 17, when the strobe signal STB is high level "H", the data red signal S1 is represented by broken lines because the switch 66-1 is OFF and the voltage applied to the corresponding data electrode of the color liquid crystal display 1 based on the data red signal S1 from the output unit 47-1 is in the high impedance state.

The common power supply 4 supplies the common voltage Vcom of the ground level GND to the common electrode of the color liquid crystal display 1 based on the polarity signal POL of high level "H". The pixel corresponding to the data electrode shows black, assuming that the color liquid crystal display 1 is of the normally white type.

If the polarity signal POL is low level "L", then the 6-bits display data PD1, PD2, - - - PD528 are held by the latch circuits 51-1, 51-2, 51-3, - - - 51-528 in the data latch 44 respectively for a single horizontal synchronizing time period. The 6-bits display data PD1, PD2, - - - PD528 are then converted in voltage from 3V to 5V by the level shifters 52-1, 52-2, 52-3, - - - 52-528 respectively, and further the voltage converted 6-bits display data PD1, PD2, - - - PD528 are inverted. The inverted 6-bits display data PD1, PD2, - - - PD528 are then transmitted through the switching circuits 53-1, 53-2, 53-3, - - - 53-528, and the inverters 54-1, 54-2, 54-3, - - - 54-528 to the inverters 55-1, 55-2, 55-3, - - - 55-528, whereby the inverted 6-bits display data PD1, PD2, - - - PD528 are outputted as the negative polarity 6-bits display data PD'1, PD'2, - - - PD'528. The most significant bit signals MSB1, MSB2, MSB3, - - - , MSB528 are to be used only in the power saving 8-color mode. Namely, in the full-color mode, the most significant bit signals MSB1, MSB2, MSB3, - - - , MSB528 are not used.

The circuit 43 supplies the gray scale voltage generating circuit 45 with the second delayed color mode signal CM2 of high level "H", whereby both the n-channel MOS field effect transistor 57 and the p-channel MOS field effect transistor 58 in the gray scale voltage generating circuit 45 are placed in ON-state, whereby the series connection of the first to two hundred forty ninth resistances 56-1, 56-2, 56-3, - - - 56-249 is biased between the power voltage VDD and the ground voltage GND, and two hundred fifty one divided voltages are generated at the two hundred fifty first nodes.

If the polarity signal POL is low level "L", then the control circuit 43 supplies the polarity selecting circuit 48 with the positive switching signal Sswp of low level "L" and the negative switching signal Sswn of high level "H". The first to sixty fourth switches of the first switching group 60*a* turn OFF, whilst the first to sixty fourth switches of the second switching group 60*b* turn ON. The negative polarity first to sixty fourth gray scale voltages V1, V2, V3, - - - V64 are outputted and supplied to the gray scale voltage selecting circuit 46.

In each of the first to five hundred twenty eighth gray scale voltage selecting units 46-1, 46-2, 46-3, - - - , 46-528 in the gray scale voltage selecting circuit 46, the multiplexer 61 selects one of the p-channel MOS field effect transistors 62-1, 62-2, 62-3, - - - 62-32 and the n-channel MOS field effect transistors 63-1, 63-2, 63-3, - - - 63-32, based on the received inverted 6-bits display data PD'1, PD'2, - - - PD'528, whereby the selected one of the p-channel MOS field effect transistors 62-1, 62-2, 62-3, - - - 62-32 and the n-channel MOS field effect transistors 63-1, 63-2, 63-3, - - - 63-32 turns ON, whereby corresponding one of the negative polarity first to sixty fourth gray scale voltages V1, V2, V3, - - - V64 to the MOS field effect transistor placed in ON-state is transmitted as the data red, green or blue signal to the amplifiers 65-1, 65-2, 65-3, - - - 65-528 in the output circuit 47.

The first to five hundred twenty eighth gray scale voltage selecting units 46-1, 46-2, 46-3, - - - , 46-528 in the gray scale voltage selecting circuit 46 supply the corresponding data red, green and blue signals to the amplifiers 65-1, 65-2, 65-3, - - - , 65-528 in the output circuit 47. The data red, green and blue signals are amplified by the amplifiers 65-1, 65-2, 65-3, - - - , 65-528 in the output circuit 47 respectively. The amplified data red, green and blue signals are transmitted through switching operations of the switches 66-1, 66-2, 66-3, - - - , 66-528 under the control by the switch control signal SWA which is risen in synchronizing with the rising edge of the strobe signal STB. The amplified data red, green and blue signals are then supplied as the data red, green and blue signals S1, S2, S3, - - - S528 to the corresponding data electrodes of the color liquid crystal display 1.

In FIG. 17, one example of the data red signal S1 is shown if the 6-bit display data PD1 is "000000". The data latch unit 44-1 outputs the inverted 6-bits display data PD'1 "111111" which are inverted from the original 6-bits display data PD1 "000000". In the first gray scale voltage selecting unit 46-1, the multiplexer 61 makes the p-channel MOS field effect transistor 63-32 turn ON based on the inverted 6-bits display data PD'1 "111111", whereby the sixty fourth gray scale voltage V64, which is closest to the ground voltage level GND, is outputted as the data red signal S1.

The common power supply 4 supplies the common voltage Vcom of the power voltage level VDD to the common electrode of the color liquid crystal display 1 based on the polarity signal POL of high level "H". The pixel corresponding to the data electrode shows black, assuming that the color liquid crystal display 1 is of the normally white type.

If it is possible that simultaneous switching operations of the first and second switching groups 60*a* and 60*b* in the polarity selecting circuit 48 may cause indefinite or unintentional gray scale voltages V1, V2, V3, - - - V64, it may be effective to avoid this disadvantage by differentiating rising and falling timings between the positive and negative switching signals Sswp and Sswn.

(2) Power Saving 8-Color Mode:

If the power saving mode signal PS is high level "H", then the driver circuit is in the power saving 8-color mode, wherein static and/or dynamic images are displayed in 8-color on the color liquid crystal display 1 of the mobile phone. The power saving mode signal PS is an externally supplied signal based on operation by use to the mobile phone. If the user intends to display, in 8-color, characters and marks on the screen of the color liquid crystal display 1 of the mobile phone, then the user operates the mobile phone to set the power saving mode signal PS in the high level "H". The characters and marks may, for example, be supplied from e-mails through Internet.

The power saving mode signal PS in the high level "H" is supplied to the control circuit 41, whereby the control circuit 41 supplies the color mode signal CM of low level "L" to the data electrode driver circuit 42. The control circuit 41 also supplies the data electrode driver circuit 42 with the clock signal CLK, the strobe signal STB, the horizontal start pulse signal STH, and the polarity signal POL. The horizontal start pulse signal STH is delayed by a few pulses of the clock signal CLK from the strobe signal STB. At almost the same time, the control circuit 41 converts the externally supplied 6-bits red data $D_R$, 6-bits green data $D_G$, and 6-bits blue data $D_B$ into the 18-bits display data D00-D05, D10-D15 and D20-D25, and then the control circuit 41 supplies the 18-bits display data D00-D05, D10-D15 and D20-D25 to the data electrode driver circuit 42.

The control circuit 43 in the data electrode driver circuit 42 receives the strobe signal STB, the polarity signal POL, and the color mode signal CM of low level "L" from the control circuit 41. The control circuit 43 generates the strobe signal STB1, the first polarity signal POL1, the second polarity signal POL2, the first color mode signal CM1 of low level "L", the second color mode signal CM2 of low level "L", the switch control signal SWA of low level "L", and the positive and negative switching signals Sswp and Sswn of low level "L", based on the strobe signal STB, the polarity signal POL, and the color mode signal CM of low level "L".

The control circuit 43 supplies the strobe signal STB1 and the first polarity signal POL1 to the data latch 44. The control circuit 43 also supplies the second polarity signal POL2, the first color mode signal CM1, and the switch control signal SWA to the output circuit 47. The control circuit 43 also supplies the second color mode signal CM2 to the gray scale voltage generating circuit 45. The control circuit 43 also supplies the positive and negative switching signals Sswp and Sswn to the polarity selecting circuit 48.

In synchronizing with the clock signal CLK1, the shift register 12 in the data electrode driver circuit 42 performs to shift the horizontal start pulse signal STH as well as to output 176-bits sampling pulse signals SP1-SP176. In synchronizing with the clock signal CLK1 which is delayed by a predetermined time from the clock signal CLK, the data buffer 13 holds the 18-bits display data D00-D05, D10-D15 and D20-D25 for a time period corresponding to a single pulse width of the clock signal CLK1, and then outputs the 18-bits display data D'00-D'05, D'10-D'15 and D'20-D'25 which are then supplied to the data register 14.

In synchronizing with the 176-bits sampling pulse signals SP1-SP176 supplied from the shift register 12, the data register 14 accepts series inputs of the 18-bits display data D'00-D'05, D'10-D'15 and D'20-D'25 as the 6-bits display data PD1, PD2, - - - PD528. In synchronizing with the rising edge of the strobe signal STB1, the data latch 44 accepts simultaneous inputs of the 6-bits display data PD1, PD2, - - - PD528, so that the latch circuits 51-1, 51-2, 51-3, - - - 51-528 in the data latch 44 respectively bold the 6-bits display data PD1, PD2, - - - PD528 for a single horizontal synchronizing time period. The 6-bits display data PD1, PD2, - - - PD528 are then supplied to the level shifters 52-1, 52-2, 52-3, - - - 52-528, respectively.

If the polarity signal POL is high level "H", then the 6-bits display data PD1, PD2, - - - PD528 are converted in voltage from 3V to 5V by the level shifters 52-1, 52-2, 52-3, - - - 52-528 respectively. The voltage converted 6-bits display data PD1, PD2, - - - PD528 are then transmitted through the switching circuits 53-1, 53-2, 53-3, - - - 53-528, and the inverters 54-1, 54-2, 54-3, - - - 54-528 to the inverters 55-1, 55-2, 55-3, - - - 55-528, whereby the voltage converted 6-bits display data PD1, PD2, - - - PD528 are outputted as the positive polarity 6-bits display data PD'1, PD'2, - - - PD'528.

If the polarity signal POL is low level "L", then the 6-bits display data PD1, PD2, - - - PD528 are converted in voltage from 3V to 5V by the level shifters 52-1, 52-2, 52-3, - - - 52-528 respectively, and further the voltage converted 6-bits display data PD1, PD2, - - - PD528 are inverted. The inverted 6-bits display data PD1, PD2, - - - PD528 are then transmitted through the switching circuits 53-1, 53-2, 53-3, - - - 53-528, and the inverters 54-1, 54-2, 54-3, - - - 54-528 to the inverters 55-1, 55-2, 55-3, - - - 55-528, whereby the inverted 6-bits display data PD1, PD2, - - - PD528 are outputted as the negative polarity 6-bits display data PD'1, PD'2, - - - PD'528.

In this case, the latch circuits 51-1, 51-2, 51-3, - - - 51-528 in the data latch 44 outputs the most significant bit signals MSB1, MSB2, MSB3, - - - , MSB528, respectively. The most significant bit signals MSB1, MSB2, MSB3, - - - , MSB528 are to be used only in the power saving 8-color mode.

The circuit 43 supplies the gray scale voltage generating circuit 45 with the second delayed color mode signal CM2 of low level "L", whereby both the n-channel MOS field effect transistor 57 and the p-channel MOS field effect transistor 58 in the gray scale voltage generating circuit 45 are placed in OFF-state, whereby the series connection of the first to two hundred forty ninth resistances 56-1, 56-2, 56-3, - - - 56-249 is isolated from the power voltage VDD and the ground voltage GND, and no divided voltages are generated. In this power saving 8-color mode, the gray scale voltage generating circuit 45 is inactivated, and further the polarity selecting circuit 48 is also inactivated by the positive and negative switching signals Sswp and Sswn of low level "L".

In each of the first to five hundred twenty eighth gray scale voltage selecting units 46-1, 46-2, 46-3, - - - , 46-528 in the gray scale voltage selecting circuit 46, the multiplexer 61 selects one of the p-channel MOS field effect transistors 62-1, 62-2, 62-3, - - - 62-32 and the n-channel MOS field effect transistors 63-1, 63-2, 63-3, - - - 63-32, based on the received 6-bits display data PD'1, PD'2, - - - PD'528, whereby the selected one of the p-channel MOS field effect transistors 62-1, 62-2, 62-3, - - - 62-32 and the n-channel MOS field effect transistors 63-1, 63-2, 63-3, - - - 63-32 turns ON. However, as described above, both the gray scale voltage generating circuit 45 and the polarity selecting circuit 48 are inactivated, for which reason voltages to be applied to input terminals of the output units 47-1, 47-2, 47-3, - - - 47-528 respectively corresponding to the first to five hundred twenty eighth gray scale voltage selecting units 46-1, 46-2, 46-3, - - - , 46-528 are in the high impedance state.

The bias current control circuit 64 receives the second delayed color mode signal CM2 of low level "L" from the control circuit 43. The constant current circuit 70 in the bias current control circuit 64 is inactivated to supply no constant bias currents to the gates of the p-channel and n-channel MOS field effect transistors 74 and 75 in each of the amplifiers 65-1, 65-2, 65-3, - - - 65-528 in the output units 47-1, 47-2, 47-3, - - - 47-528, wherein the p-channel and n-channel MOS field effect transistors 72 and 73 in the bias current control circuit 64 turn ON. The amplifiers 65-1, 65-2, 65-3, - - - 65-528 in the output units 47-1, 47-2, 47-3, - - - 47-528 are inactivated. The switches 66-1, 66-2, 66-3, - - - , 66-528 are always kept in OFF-state by the switch control signal SWA of low level "L".

In the output units 47-1, 47-2, 47-3, - - - , 47-528 in the output circuit 47, the output control circuits 67-1, 67-2, 67-3, - - - 67-528 place, into ON-state, one of the p-channel MOS field effect transistors 68-1, 68-2, 68-3, - - - 68-528 and the n-channel MOS field effect transistors 69-1, 69-2, 69-3, - - - 69-528, based on the most significant bit signals MSB1, MSB2, MSB3, - - - , MSB528 and the polarity signal POL of high level "H", whereby one of the power voltage VDD and the ground voltage GND is supplied to the corresponding data electrodes of the color liquid crystal display 1.

In FIG. 17, one example of the data red signal S1 is shown if the 6-bit display data PD1 is "000000". The data latch unit 44-1 outputs the most significant bit signal MSB1 "0" in addition to the 6-bits display data PD'1 "000000" which is the same as the latched original 6-bits display data PD'1 "000000".

In the first output unit 47-1, the p-channel MOS field effect transistor 68-1 turns ON in response to the most significant bit signal MSB1 "0" of the 6-bits display data PD'1 "000000" and the polarity signal POL of high level "H", whereby the power voltage VDD is outputted as the data red signal S1.

The common power supply 4 supplies the common voltage Vcom of the ground level GND to the common electrode of the color liquid crystal display 1 based on the polarity signal POL of high level "H". The pixel corresponding to the data electrode shows black, assuming that the color liquid crystal display 1 is of the normally white type.

If the polarity signal POL is low level "L", then the 6-bits display data PD1, PD2, - - - PD528 are held by the latch circuits 51-1, 51-2, 51-3, - - - 51-528 in the data latch 44 respectively for a single horizontal synchronizing time period. The 6-bits display data PD1, PD2, - - - PD528 are then converted in voltage from 3V to 5V by the level shifters 52-1, 52-2, 52-3, - - - 52-528 respectively, and further the voltage converted 6-bits display data PD1, PD2, - - - PD528 are inverted. The inverted 6-bits display data PD1, PD2, - - - PD528 are then transmitted through the switching circuits 53-1, 53-2, 53-3, - - - 53-528, and the inverters 54-1, 54-2, 54-3, - - - 54-528 to the inverters 55-1, 55-2, 55-3, - - - 55-528, whereby the inverted 6-bits display data PD1, PD2, - - - PD528 are outputted as the negative polarity 6-bits display data PD'1, PD'2, - - - PD'528. The most significant bit signals MSB1, MSB2, MSB3, - - - , MSB528 are to be used only in the power saving 8-color mode.

The circuit 43 supplies the gray scale voltage generating circuit 45 with the second delayed color mode signal CM2 of low level "L", whereby both the n-channel MOS field effect transistor 57 and the p-channel MOS field effect transistor 58 in the gray scale voltage generating circuit 45 are placed in OFF-state, whereby the series connection of the first to two hundred forty ninth resistances 56-1, 56-2, 56-3, - - - 56-249 is not biased between the power voltage VDD and the ground voltage GND, and no divided voltages are generated.

If the polarity signal POL is low level "L", then the control circuit 43 supplies the polarity selecting circuit 48 with the positive switching signal Sswp of low level "L" and the negative switching signal Sswn of low level "L", whereby the polarity selecting circuit 48 is inactivated.

In each of the first to five hundred twenty eighth gray scale voltage selecting units 46-1, 46-2, 46-3, - - - , 46-528 in the gray scale voltage selecting circuit 46, the multiplexer 61 selects one of the p-channel MOS field effect transistors 62-1, 62-2, 62-3, - - - 62-32 and the n-channel MOS field effect transistors 63-1, 63-2, 63-3, - - - 63-32, based on the received inverted 6-bits display data PD'1, PD'2, - - - PD'528, whereby the selected one of the p-channel MOS field effect transistors 62-1, 62-2, 62-3, - - - 62-32 and the n-channel MOS field effect transistors 63-1, 63-2, 63-3, - - - 63-32 turns ON. However, both the gray scale voltage generating circuit 45 and the polarity selecting circuit 48 are inactivated. Voltages to be applied to the input terminals of the output units 47-1, 47-2, 47-3, - - - 47-528 respectively corresponding to the first to five hundred twenty eighth gray scale voltage selecting units 46-1, 46-2, 46-3, - - - , 46-528 are in the high impedance state.

The bias current control circuit 64 receives the second delayed color mode signal CM2 of low level "L" from the control circuit 43. The constant current circuit 70 in the bias current control circuit 64 is inactivated to supply no constant bias currents to the gates of the p-channel and n-channel MOS field effect transistors 74 and 75 in each of the amplifiers 65-1, 65-2, 65-3, - - - 65-528 in the output units 47-1, 47-2, 47-3, - - - 47-528, wherein the p-channel and n-channel MOS field effect transistors 72 and 73 in the bias current control circuit 64 turn ON. The amplifiers 65-1, 65-2, 65-3, - - - 65-528 in the output units 47-1, 47-2, 47-3, - - - 47-528 are inactivated. The switches 66-1, 66-2, 66-3, - - - , 66-528 are always kept in OFF-state by the switch control signal SWA of low level "L".

In the output units 47-1, 47-2, 47-3, - - - , 47-528 in the output circuit 47, the output control circuits 67-1, 67-2, 67-3, - - - 67-528 place, into ON-state, one of the p-channel MOS field effect transistors 68-1, 68-2, 68-3, - - - 68-528 and the n-channel MOS field effect transistors 69-1, 69-2, 69-3, - - - 69-528, based on the most significant bit signals MSB1, MSB2, MSB3, - - - MSB528 and the polarity signal POL of low level "L", whereby one of the power voltage VDD and the ground voltage GND is supplied to the corresponding data electrodes of the color liquid crystal display 1.

In FIG. 17, one example of the data red signal S1 is shown if the 6-bit display data PD1 is "000000". The data latch unit 44-1 outputs the most significant bit signal MSB1 "1" in addition to the inverted 6-bits display data PD'1 "111111" which are inverted from the original 6-bits display data PD1 "000000". In the output unit 47-1, the output control circuit 67-1 makes the n-channel MOS field effect transistor 69-1 turn ON based on both the most significant bit signal MSB1 "1" of the inverted 6-bits display data PD'1 "111111" and the polarity signal POL of low level "L", whereby the ground voltage GND is outputted as the data red signal S1.

The common power supply 4 supplies the common voltage Vcom of the power voltage level VDD to the common electrode of the color liquid crystal display 1 based on the polarity signal POL of low level "L". The pixel corresponding to the data electrode shows black, assuming that the color liquid crystal display 1 is of the normally white type.

If it is possible that simultaneous switching operations of the first and second switching groups 60*a* and 60*b* in the polarity selecting circuit 48 may cause indefinite or unintentional gray scale voltages V1, V2, V3, - - - V64, it may be effective to avoid this disadvantage by differentiating rising and falling timings between the positive and negative switching signals Sswp and Sswn.

In accordance with this first embodiment, the gray scale voltage generating circuit 45, the polarity selecting circuit 48 and the amplifiers 65-1, 65-2, 65-3, - - - 65-528 in the output circuit 47 are inactivated in the power saving 8-color mode. Either the p-channel MOS field effect transistors 68-1, 68-2, 68-3, - - - 68-528 or the n-channel MOS field effect transistors 69-1, 69-2, 69-3, - - - 69-528 turn ON based on the most significant bit signals MSB1, MSB2, MSB3, - - - , MSB528 and the polarity signal POL, whereby either the power voltage VDD or the ground voltage GND is applied to the data electrode of the color liquid crystal display 1. The inactivation of the gray scale voltage generating circuit 45, the polarity selecting circuit 48 and the amplifiers 65-1, 65-2, 65-3, - - - 65-528 in the output circuit 47 during the power saving 8-color mode results in a large reduction in power consumption by the driver circuit for driving the color liquid crystal display 1.

The following description is one presumption on the effect of the present invention how many power saving can be obtained. It is assumed that in the full-color mode, each amplifier 65 in the output circuit 47 has a constant current of approximately 10 micro-A. In this case, the output circuit 47 including the first to five hundred twenty eighth amplifiers 65-1, 65-2, 65-3, - - - , 65-528 consumes a constant current of approximately 5.28 mA. It is also assumed that the power voltage VDD is 5V. The output circuit 47 including the first to five hundred twenty eighth amplifiers 65-1, 65-2, 65-3, - - - , 65-528 consumes a power of approximately 26.4 mW in the full-color mode.

In the power saving 8-color mode, all of the first to five hundred twenty eighth amplifiers 65-1, 65-2, 65-3, - - - , 65-528 in the output circuit 47 are inactivated, whereby no constant currents are applied to the first to five hundred twenty eighth amplifiers 65-1, 65-2, 65-3, - - - , 65-528, and a reduction by approximately 26.4 mW in power consumption of the output circuit 47 can be obtained. Further, in the power saving 8-color mode, the gray scale voltage generating circuit 45 is also inactivated, whereby a further reduction by approximately 1 mW in power consumption of the gray scale voltage generating circuit 45 can be obtained.

The above described prior art, the first to sixty fourth gray scale voltages V1, V2, V3, - - - V64 are switched in polarity for every lines based on the polarity signal POL.

In accordance with the present invention, however, selective inversions, based on the polarity signal POL, to the first to sixty fourth gray scale voltages V1, V2, V3, - - - V64 for every lines are made for allowing the non-inverted or inverted first to sixty fourth gray scale voltages V1, V2, V3, - - - V64 to be outputted. For this reason, each of the first to five hundred twenty eighth gray scale voltage selecting units 46-1, 46-2, 46-3, - - - , 46-528 of the gray scale voltage selecting circuit 46 does not include nay transfer gates. As shown in FIG. 15, each of the first to five hundred twenty eighth gray scale voltage selecting units 46-1, 46-2, 46-3, - - - , 46-528 of the gray scale voltage selecting circuit 46 includes the p-channel MOS field effect transistors 62-1, 62-2, 62-3, - - - 62-32 on the high voltage side and also the n-channel MOS field effect transistors 63-1, 63-2, 63-3, - - - 63-32 on the low voltage side, resulting in one half reduction in the number of the necessary elements for the gray scale voltage selecting circuit 46.

The above one half reduction in the number of the necessary elements can reduce an occupied area over a printed board as well as can achieve a scaling down of the integrated circuit of the data electrode driver circuit 42 including the gray scale voltage selecting circuit 46, resulting in a certain reduction of chip size. The driver circuit as described above is thus suitable for various portable electronic devices, for example, note-type computers, palm-type computers, pocket-type computers, mobile terminals such as personal digital assistants, mobile phones, and personal handy-phone systems.

Further, as described above, each of the first to five hundred twenty eighth gray scale voltage selecting units 46-1, 46-2, 46-3, - - - , 46-528 in the gray scale voltage selecting circuit 46 comprises the p-channel MOS field effect transistors 62-1, 62-2, 62-3, - - - 62-32 and the n-channel MOS field effect transistors 63-1, 63-2, 63-3, - - - 63-32. This structure provides a further advantage in one-half reduction of parasitic capacitance thereof. The one-half reduction in the parasitic capacitance can reduce by one half the power consumptions by the gray scale voltage generating circuit 45 and the gray scale voltage selecting circuit 46. This results in a large reduction in power consumption by the portable electronic device, and also in an increased long use time without changing the battery.

Charge and discharge currents to and from the resistances 56-1, 56-2, 56-3, - - - 56-528 are reduced in both amount and time, whereby it is possible to ensure desirable high contrasts of the images displayed on the color liquid crystal display 1.

The gray scale voltage generating circuit 45 generates positive polarity first to sixty fourth gray scale voltages V1, V2, V3, - - - V64, and also generates negative polarity first to sixty fourth gray scale voltages V1, V2, V3, - - - V64 in response to the difference in applied voltage to transitivity characteristics of the liquid crystal cells between the positive polarity and the negative polarity of the applied voltage. For this reason, it is easy to do color corrections to ensure desirable high quality images on the color liquid crystal display 1.

Second Embodiment

Figure 18:
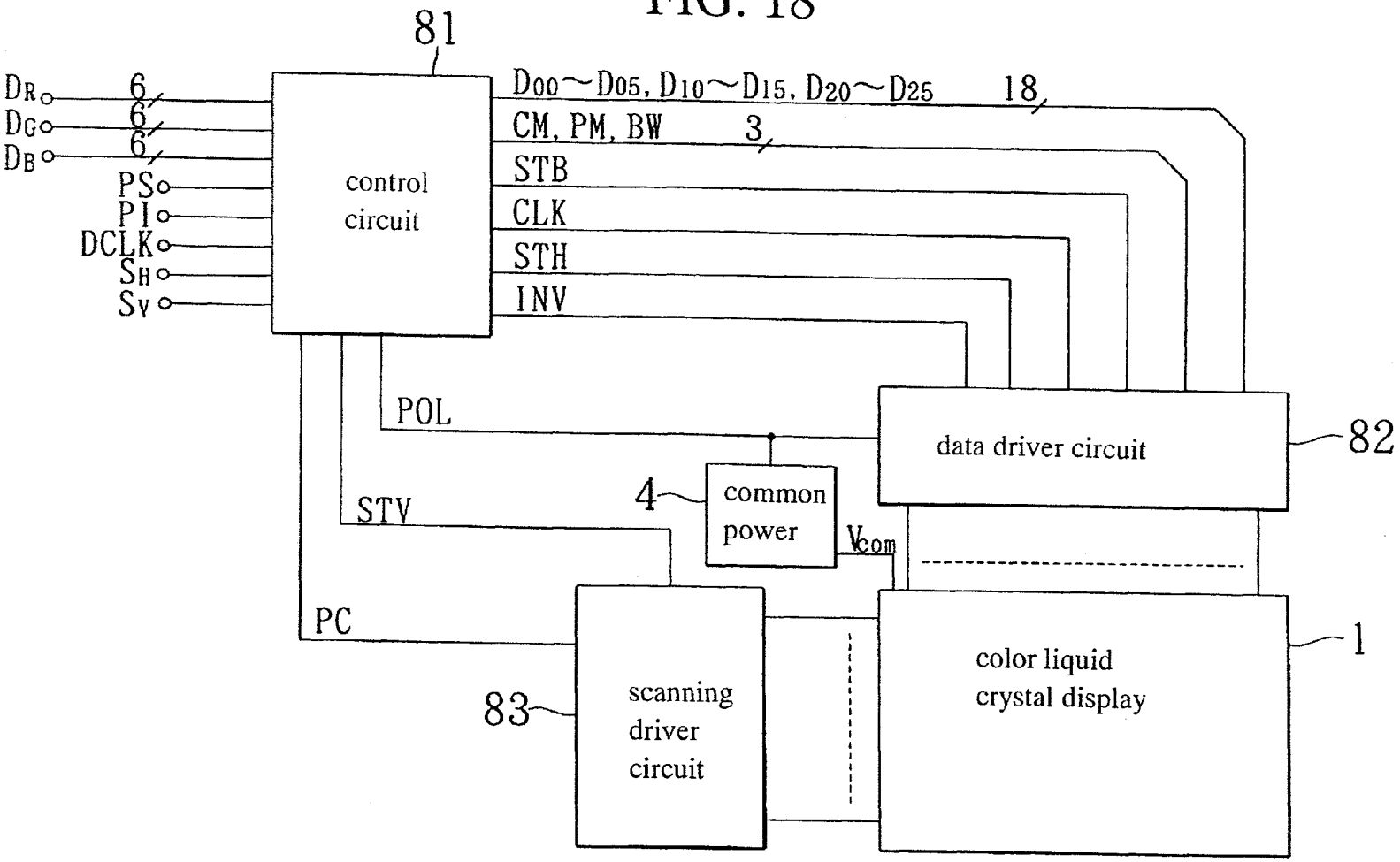
FIG. 18 is a block diagram illustrative of a second novel driver circuit for driving a color liquid crystal display in a second embodiment in accordance with the present invention.

A second embodiment according to the present invention will be described in detail with reference to the drawings. FIG. 18 is a block diagram illustrative of a second novel driver circuit for driving a color liquid crystal display in a second embodiment in accordance with the present invention.

A color liquid crystal display 1 may be driven by an active matrix driving system using thin film transistors as switching devices. The color liquid crystal display 1 includes a plurality of scanning lines or data lines which extend parallel to each other in a column direction at a constant pitch, and a plurality of data lines or source lines which extend parallel to each other in a row direction at another constant pitch, as well as a two-dimensional matrix array of pixels, each of which is positioned in an area defined by adjacent two of the scanning lines and adjacent two of the data lines.

Each of the pixels further includes a liquid crystal cell as an equivalent capacitive load, a common electrode, a thin film transistor for driving the liquid crystal cell, and a data electrode for storing data charge in a vertical synchronizing term. A gate electrode of the thin film transistor is connected to the scanning line. The gate electrode of the thin film transistor serves as a scanning electrode.

The color liquid crystal display 1 may be driven as follows. The common electrode is applied with a common potential Vcom. The data electrode is applied with data signals, wherein the data signals may include data red signals, data green signals and data blue signals, which have been generated from red data $D_R$, green data $D_G$, and blue data $D_B$ as digital image data. The scanning electrode is applied with a scanning signal which has been generated from a horizontal synchronizing signal $S_H$ and a vertical synchronizing signal $S_V$.

The following description with reference to FIG. 18 will be made assuming that the color liquid crystal display 1 is a normally white type color liquid crystal display which is high in transitivity under no voltage application.

The driver circuit for driving the color liquid crystal display 1 mainly includes a control circuit 81, a common power supply 4, a data electrode driver circuit 82, and a scanning electrode driver circuit 83.

The control circuit 81 may, for example, comprise an application specific integrated circuit (ASIC). The control circuit 81 receives parallel inputs of red data $D_R$ of 6-bits, green data $D_G$ of 6-bits and blue data $D_B$ of 6-bits. The control circuit 81 converts the red data $D_R$, green data $D_G$ and blue data $D_B$ into 18-bits display data D00-D05, D10-D15 and D20-D25 respectively, and outputs the 18-bits display data. The 18-bits display data outputted from the control circuit 81 are supplied to the data electrode driver circuit 42.

The control circuit 81 also receives further inputs of a dot-clock signal DCLK, a horizontal synchronizing signal $S_H$, and a vertical synchronizing signal $S_V$, so that the control circuit 81 generates a strobe signal STB, a clock signal CLK, a horizontal start pulse signal STH, a vertical start pulse signal STV, a polarity signal POL, and a data inversion signal INV from the dot-clock signal DCLK, the horizontal synchronizing signal S11, and the vertical synchronizing signal $S_V$. The strobe signal STB, the clock signal CLK, the horizontal start pulse signal STH and the data inversion signal INV are supplied to the data electrode driver circuit 42. The polarity signal POL is supplied to the common power supply 4 and also to the data electrode driver circuit 42. The vertical start pulse signal STV is supplied to the scanning electrode driver circuit 6.

The control circuit 81 also receives a furthermore input of a partial display mode signal PI, so that the control circuit 81 generates a partial display signal PM, a monochrome signal BW and a plural scanning signal PC based on the partial display mode signal PI. The partial display signal PM, the monochrome signal BW and the plural scanning signal PC are then supplied to the data electrode driver circuit 82.

If the power saving mode signal PS is high level "H", then the partial display mode signal PI of high level "H" instructs to perform a necessary minimum display on the screen of the color liquid crystal display 1. The partial display signal PM of high level "H" sets the data electrode driver circuit 82 in the partial display mode. The monochrome signal BW is always in low level "L" in order to display "white" compulsorily on a display-unnecessary region of the display screen. The plural scanning signal PC is to instruct simultaneous scannings of plural scanning electrodes of the color liquid crystal display 1.

If both the power saving mode signal PS and the partial display mode signal PI are high level "H", then the control circuit 81 outputs the color mode signal CM of high level "H".

The strobe signal STB has the same cycle as the horizontal synchronizing signal $S_H$. The clock signal CLK may be either identical with or different in frequency from the dot-clock signal DCLK. The clock signal CLK may be used for allowing shift registers in the data electrode driver circuit 42 to generate sampling pulse signals SP1-SP176 from the horizontal start pulse signal STH.

The horizontal start pulse signal STH is identical in cycle to the horizontal synchronizing signal $S_H$, and delayed from the strobe signal STB by a time corresponding to a few pulses of the clock signal CLK. The polarity signal POL is inverted in a single line unit or in a single horizontal synchronizing cycle for alternating current driving of the color liquid crystal display 1. The vertical start pulse signal STV has the same cycle as the vertical synchronizing signal $S_V$.

The data inversion signal INV is used for the purpose of reducing the power which is consumed by the control circuit 81. If the current 18-bits display data D00-D05, D10-D15 and D20-D25 has at least 10-inverted bits from the previous 18-bits display data, the data inversion signal INV is inverted in synchronizing with the clock signal CLK, instead of inversions of the current 18-bits display data D00-D05, D10-D15 and D20-D25 for the following reasons.

It is general that the control circuit 81 is integrated over a printed board, whilst the data electrode driver circuit 42 is mounted as a tape carrier package (TCP) over a film tape carrier which provides an electrical connection between the printed board and the color liquid crystal display 1. The printed board is mounted at an upper portion on a back face of a back light which is attached to the color liquid crystal display 1.

18-signal lines are provided on the film carrier tape for transmitting the 18-bits display data D00-D05, D10-D15 and D20-D25 from the control circuit 81 to the data electrode driver circuit 42. The 18-signal lines have a line capacitance.

In addition, the data electrode driver circuit 42 has an input capacitance of about 20 pF from the control circuit 81. A sufficient current for charging and discharging the line capacitance and the input capacitance would be needed if the polarity of the 18-bits display data D00-D05, D10-D15 and D20-D25 are inverted and supplied to the data electrode driver circuit 42 from the control circuit 81. For reducing the necessary charge and discharge currents to the line capacitance and the input capacitance, it is effective that the data inversion signal INV is inverted, instead of inversions of the 18-bits display data D00-D05, D10-D15 and D20-D25. The reduction of the charge and discharge currents results in a reduction in the power consumed by the control circuit 81.

Figure 19:
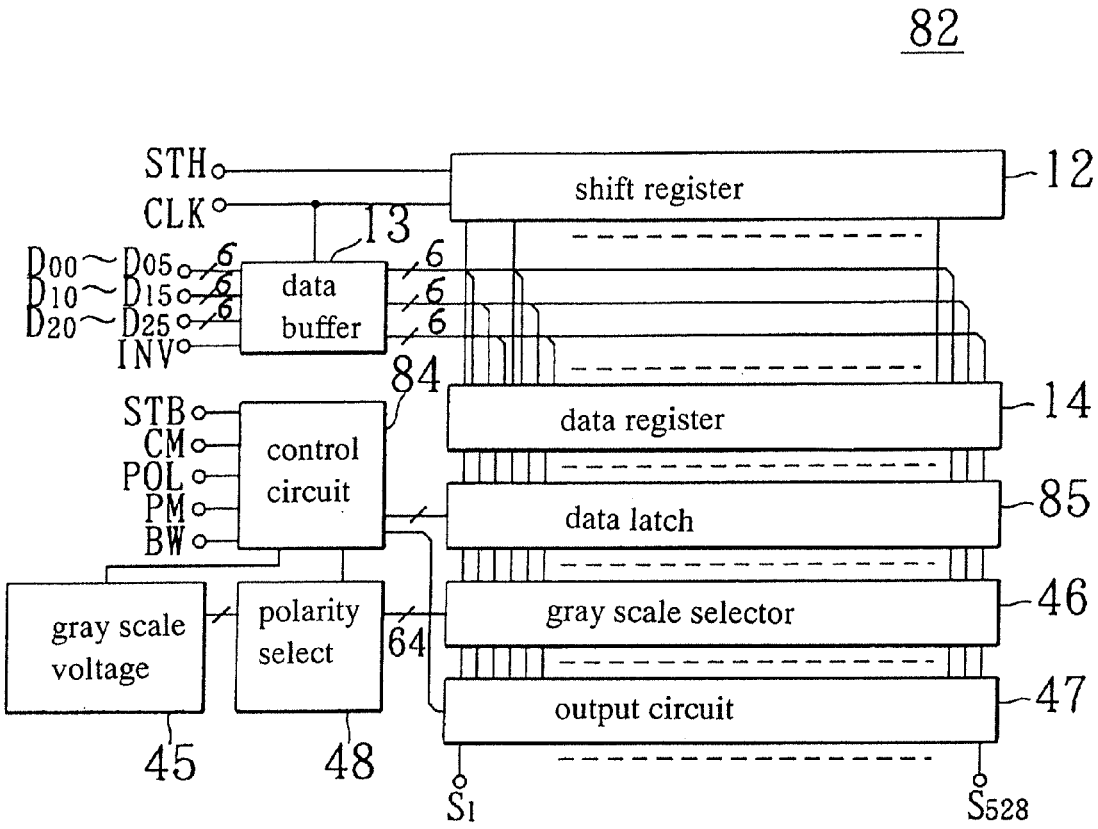
FIG. 19 is a block diagram illustrative of the data electrode driver circuit shown in FIG. 18.

FIG. 19 is a block diagram illustrative of the data electrode driver circuit shown in FIG. 18. It is assumed that a resolution of the color liquid crystal display 1 is defined by 176×220 pixels. Since each pixel comprises three-dots of red (R), green (G) and blue (B), then the color liquid crystal display 1 has a 528×220 dot-pixels.

The data electrode driver circuit 82 includes a shift register 12, a data buffer 13, a data register 14, a control circuit 84, a data latch 85, a gray scale voltage generating circuit 45, a gray scale voltage selecting circuit 46, an output circuit 47 and a polarity selecting circuit 48.

The shift register 12 is a serial-in parallel-out shift register which comprises 176 delay-flip-flops. The shift register 12 receives the clock signal CLK and the horizontal start pulse signal STH from the control circuit 41, so that the shift register 12 shifts the horizontal start pulse signal STH in synchronizing with the clock signal CLK, and generates sampling pulses SP1, SP2, - - - SP176 which comprise a 176-bits parallel-out signal.

The data buffer 13 receives the 18-bits display data D00-D05, D10-D15 and D20-D25 and the data inversion signal INV from the control circuit 41, so that the data buffer 13 performs an inversion operation of the 18-bits display data in accordance with the data inversion signal INV, so that the data buffer 13 outputs 18-bits display data D'00-D'05, D'10-D'15 and D'20-D'25.

The data register 14 receives the 18-bits display data D'00-D'05, D'10-D'15 and D'20-D'25 from the data buffer 13 and also receives the sampling pulses SP1, SP2, - - - SP176 from the shift register 12. In synchronizing with the sampling pulses SP1, SP2, - - - SP176, the data register 14 accepts the inputs of the 18-bits display data D'00-D'05, D'10-D'15 and D'20-D'25 and transmits display data PD1, PD2, PD3, - - - PD528 to the data latch 85.

The control circuit 84 receives the strobe signal STB, the polarity signal POL, the color mode signal CM, the partial display signal PM and the monochrome signal BW from the control circuit 41, so that the control circuit 84 generates a partial display signal PM1 and a monochrome signal BW1 in addition to a delayed strobe signal STB1, first and second delayed polarity signals POL1 and POL2, first and second delayed color mode signals CM1 and CM2, and a switch control signal SWA, as well as positive and negative switching signals Sswp and Sswn.

The partial display signal PM1 is delayed by a predetermined delay time from the partial display signal PM. The monochrome signal BW1 is delayed by a predetermined delay time from the monochrome signal BW. The delayed strobe signal STB1 is delayed by a predetermined delay time from the strobe signal STB. The first and second delayed polarity signals POL1 and POL2 are delayed from the polarity signal POL by predetermined different delay times respectively. The first and second delayed color mode signals CM1 and CM2 are delayed from the color mode signal CM by predetermined different delay times respectively. In the full-color mode, the switch control signal SWA is opposite in phase to the delayed strobe signal STB1.

The control circuit 84 supplies the partial display signal PM1, the monochrome signal BW1, the delayed strobe signal STB1 and the first delayed polarity signal POL1 to the data latch 85. The control circuit 84 also supplies the second delayed polarity signal POL2, the first delayed color mode signal CM1 and the switch control signal SWA to the output circuit 47. The control circuit 84 also supplies the second delayed color mode signal CM2 to the gray scale voltage generating circuit 45. The control circuit 84 also supplies the positive and negative switching signals Sswp and Sswn to the gray scale voltage generating circuit 45 and the polarity selecting circuit 48.

The data register 14 supplies the display data PD1, PD2, PD3, - - - PD528 to the data latch 85. The data latch 85 accepts the inputs of the display data PD1, PD2, PD3, - - - PD528 in synchronizing with a rising edge of the delayed strobe signal STB1 and holds the display data PD1, PD2, PD3, - - - PD528 for a time period of the horizontal synchronizing term or until receipt of the next rising edge of the delayed strobe signal STB1. The data latch 85 performs a voltage conversion of the display data PD1, PD2, PD3, - - - PD528 into voltage-converted 6-bits display data PD'1, PD'2, - - - PD'528, or another voltage conversion of the monochrome signal BW1 into a voltage-converted monochrome signal BW1 based on the partial display signal PM1. Further, the data latch 85 optionally performs, based on the first polarity signal POL1, an inversion operation of the voltage-converted display data, so that the data latch 85 outputs the 6-bits display data PD'1, PD'2, - - - PD'528. The display data PD'1, PD'2, - - - PD'528 are then supplied to the gray scale voltage selecting circuit 46.

The data latch 85 supplies most significant bits MSB1, MSB2, - - - , MSB528 of the display data PD'1, PD'2, - - - PD'528 to the output circuit 47, wherein the most significant bits MSB1, MSB2, - - - , MSB528 are respective most significant bits of the 6-bits display data PD'1, PD'2, - - - PD'528. For example, the most significant bit MSB1 comprises 1-bit as the most significant bit of the 6-bits display data PD'1. The most significant bit MSB528 comprises 1-bit as the most significant bit of the 6-bits display data PD'528.

The data latch 85 comprises first to five hundred twenty eighth data latch units 85-1, 85-2, 85-3, - - - , 85-528. The first to five hundred twenty eighth data latch units 85-1, 85-2, 85-3, - - - , 85-528 receive the display data PD1, PD2, PD3, - - - PD528 respectively from the data register 14. For example, the first data latch unit 85-1 receives the display data PD1. The five hundred twenty eighth data latch unit 85-528 receives the display data PD528. The first to five hundred twenty eighth data latch units 85-1, 85-2, 85-3, - - - 85-528 have the same circuit configuration, for which reason the following description will focus on the first data latch unit 85-1.

Figure 20:
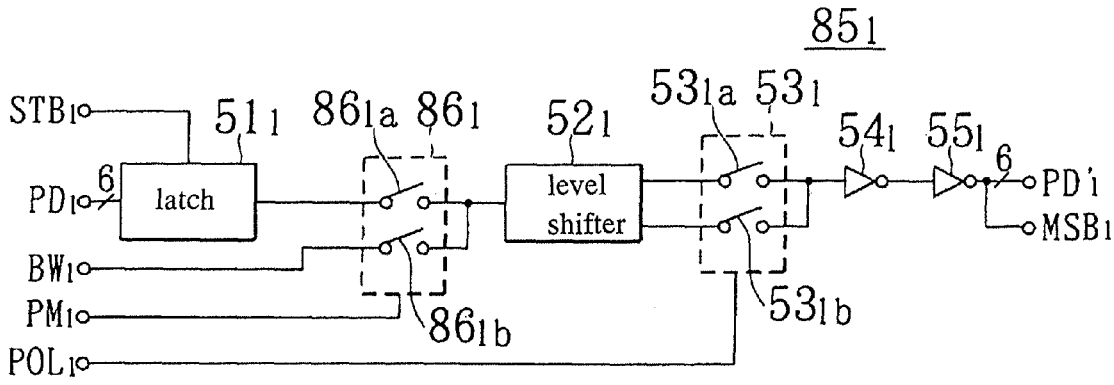
FIG. 20 is a diagram illustrative of the first data latch unit included in the data latch of the data electrode driver circuit shown in FIG. 18.

FIG. 20 is a diagram illustrative of the first data latch unit included in the data latch of the data electrode driver circuit shown in FIG. 18. The first data latch unit 85-1 comprises a latch circuit 51-1, a switching circuit 86-1, a level shifter 52-1, a switching circuit 53-1, and a series connection of first and second inverters 54-1 and 55-1.

The latch circuit 51-1 accepts an input of the 6-bits display data PD1 from the data register 14 in synchronizing with a rising edge of the delayed strobe signal STB1, and then the latch circuit 51-1 holds the 6-bits display data PD1 for a horizontal time period of the delayed strobe signal STB1 or until the next rising edge of the delayed strobe signal STB1. In synchronizing with the next rising edge of the delayed strobe signal STB1, the latch circuit 51-1 outputs the 6-bits display data PD1 which are then supplied to the switching circuit 86-1.

The switching circuit 86-1 comprises parallel connections of a first switch 86-1*a* and a second switch 86-1*b*. The first switch 86-1*a* receives the 6-bits display data PD1 from the latch circuit 51-1. The second switch 86-1*b* receives the monochrome signal BW1 from the control circuit 84. The first switch 86-1*a* and the second switch 86-1*b* perform switching operations under controls of the partial display signal PM1 from the control circuit 84. If the partial display signal PM1 is low level "L", then the second switch 86-1*b* turns OFF and the first switch 86-1*a* turns ON, whereby the 6-bits display data PD1 is transmitted to the level shifter 52-1. If the partial display signal PM1 is high level "H", then the first switch 86-1*a* turns OFF and the second switch 86-1*b* turns ON, whereby the monochrome signal BW1 is transmitted to the level shifter 52-1.

The level shifter 52-1 receives the 6-bits display data PD1 or the monochrome signal BW1 from the switching circuit 86-1. The level shifter 52-1 performs a voltage conversion of the 6-bits display data PD1 or the monochrome signal BW1, for example, from 3V to 5V to generate polarity-non-inverted voltage-converted display data or a voltage-converted monochrome signal BW1. The level shifter 52-1 further performs a polarity inversion operation of the polarity-non-inverted voltage-converted display data or the voltage-converted monochrome signal BW1 to generate a polarity-inverted voltage-converted display data or a polarity-inverted voltage-converted monochrome signal. The level shifter 52-1 outputs both the polarity-non-inverted voltage-converted display data and the polarity-inverted voltage-converted display data and also outputs the polarity-non-inverted voltage-converted monochrome signal and the polarity-inverted voltage-converted monochrome signal.

The switching circuit 53-1 comprises a parallel connection of first and second switches 53-1*a* and 53-1*b*. The switching circuit 53-1 also receives the first polarity signal POL1 from the control circuit 84. If the first polarity signal POL1 is high level "H", the second switch 53-1*b* turns OFF, whilst the first switch 53-1*a* turns ON, whereby the polarity-non-inverted voltage-converted display data or the polarity-non-inverted voltage-converted monochrome signal is transmitted through the first switch 53-1*a* to the first inverter 54-1. The first inverter 54-1 inverts the output from the switching circuit 53-1. The second inverter 55-1 further inverts the output from the first inverter 54-1, whereby outputs a positive polarity 6-bits display data PD'1 and separately a most significant bit MSB1 of the positive polarity 6-bits display data PD'1.

If the first polarity signal POL1 is low level "L", the first switch 53-1*a* turns OFF, whilst the second switch 53-1*b* turns ON, whereby the polarity-inverted voltage-converted display data or the polarity-inverted voltage-converted monochrome signal is transmitted through the second switch 53-1*b* to the first inverter 54-1. The first inverter 54-1 inverts the output from the switching circuit 53-1. The second inverter 55-1 further inverts the output from the first inverter 54-1 and outputs a negative polarity 6-bits display data PD'1 and separately a most significant bit MSB1 of the negative polarity 6-bits display data PD'1.

Consequently, if the partial display signal PM1 is low level "L" and the first polarity signal POL1 is high level "H", then the first data latch 85-1 outputs the positive polarity 6-bits display data PD'1 and separately a most significant bit MSB1 of the positive polarity 6-bits display data PD'1. If the partial display signal PM1 is low level "L" and the first polarity signal POL1 is low level "L", then the first data latch 85-1 outputs the negative polarity 6-bits display data PD'1 and separately a most significant bit MSB1 of the negative polarity 6-bits display data PD'1.

If the partial display signal PM1 is high level "H" and the first polarity signal POL1 is high level "H", then the first data latch 85-1 outputs the positive polarity monochrome signal BW1. If the partial display signal PM1 is high level "H" and the first polarity signal POL1 is low level "L", then the first data latch 85-1 outputs the negative polarity monochrome signal BW1.

With reference again to FIG. 18, if the plural scanning signal PC is low level "L", then at a timing of the vertical start pulse signal STV supplied from the control circuit 81, the scanning electrode driver circuit 83 performs continuous series generations of scanning signals which are then sequentially applied to the scanning electrodes of the color liquid crystal display 1. If the plural scanning signal PC is high level "H", then at a timing of the vertical start pulse signal STV supplied from the control circuit 81, the scanning electrode driver circuit 83 performs discontinuous generations of scanning signals which are then simultaneously applied to a predetermined set of the scanning electrodes of the color liquid crystal display 1.

Figure 21:
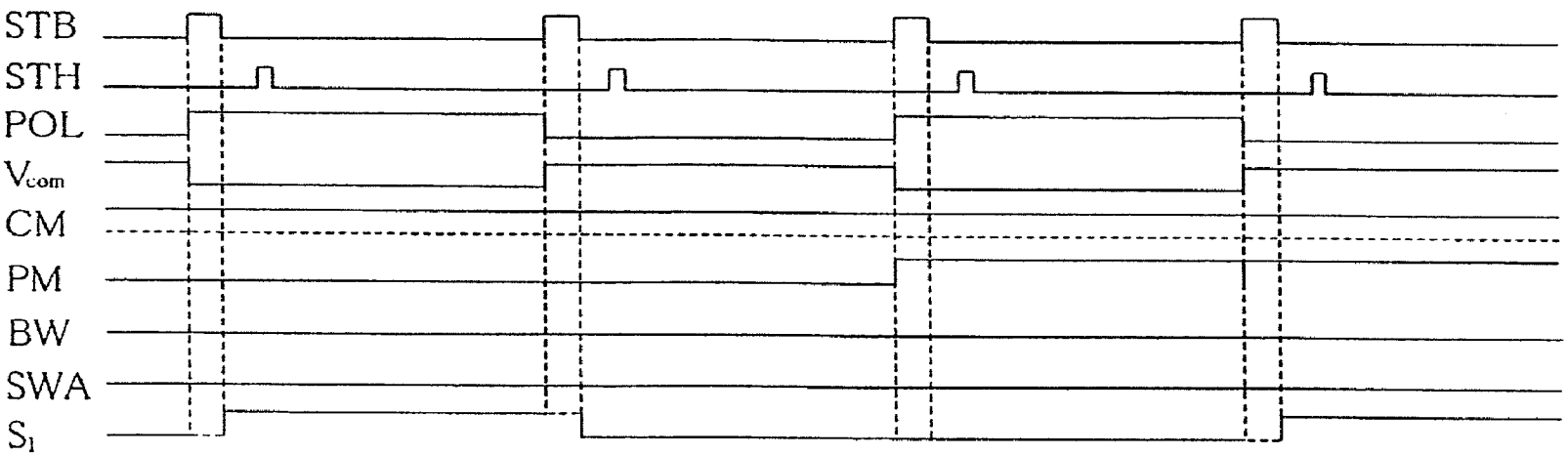
FIG. 21 is a timing chart illustrative of operations of the control circuit, the common power supply and the data electrode driver circuit included in the driver circuit shown in FIG. 18.

Operations of the above-described driver circuit for driving the liquid crystal display will hereinafter be described. FIG. 21 is a timing chart illustrative of operations of the control circuit, the common power supply and the data electrode driver circuit included in the driver circuit shown in FIG. 18. If the power saving mode signal PS is low level "L", then the partial display mode signal PI is always low level "L". If the power saving mode signal PS is high level "H", then the partial display mode signal PI may be switched between high level "H" and low level "L". If the partial display mode signal PI is low level "L", then the operations of the driver circuit are the same as described in the first embodiments. Duplicate descriptions to the operations will be omitted. The following descriptions will focus on operations of the driver circuit if both the power saving mode signal PS and the partial display mode signal PI are high level "H".

If both the power saving mode signal PS and the partial display mode signal PI are high level "H", then this means that the mobile phone is in the stand-by mode, wherein a predetermined stand-by image is displayed on the color liquid crystal display 1. The control circuit 81 receives the power saving mode signal PS of high level "H" and the partial display mode signal PI of high level "H", based on which the control circuit 81 generates the color mode signal CM of high level "H", the partial display signal PM, and the monochrome signal BW of low level "L". The color mode signal CM of high level "H", the partial display signal PM, and the monochrome signal BW of low level "L" are supplied to the data electrode driver circuit 82.

The control circuit 81 also supplies the clock signal CLK, the strobe signal STB, the horizontal start pulse signal STH, and the polarity signal POL to the data electrode driver circuit 82. The horizontal start pulse signal STH is delayed from the strobe signal STB by a few pulses of the clock signal CLK. At almost the same time, the control circuit 81 converts the externally supplied 6-bits red data $D_R$, 6-bits green data $D_G$, and 6-bits blue data $D_B$ into the 18-bits display data D00-D05, D10-D15 and D20-D25, and then the control circuit 81 supplies the 18-bits display data D00-D05, D10-D15 and D20-D25 to the data electrode driver circuit 82.

The control circuit 84 in the data electrode driver circuit 82 receives the strobe signal STB, the polarity signal POL, the color mode signal CM of high level "H", the partial display signal PM and the monochrome signal BW of low level "L"

from the control circuit 81. The control circuit 84 generates the strobe signal STB1, the first polarity signal POL1, the second polarity signal POL2, the first color mode signal CM1 of low level "L", the second color mode signal CM2 of low level "L", the partial display signal PM1, the monochrome signal BW1, the switch control signal SWA of low level "L", and the positive and negative switching signals Sswp and Sswn of low level "L", based on the strobe signal STB, the polarity signal POL1, the color mode signal CM of high level "H", the partial display signal PM and the monochrome signal BW of low level "L".

The control circuit 84 supplies the strobe signal STB1, the first polarity signal POL1, the partial display signal PM1, and the monochrome signal BW1 to the data latch 85. The control circuit 84 also supplies the second polarity signal POL2, the first color mode signal CM1, and the switch control signal SWA to the output circuit 47. The control circuit 84 also supplies the second color mode signal CM2 to the gray scale voltage generating circuit 45. The control circuit 84 also supplies the positive and negative switching signals Sswp and Sswn to the polarity selecting circuit 48.

In synchronizing with the clock signal CLK1, the shift register 12 in the data electrode driver circuit 82 performs to shift the horizontal start pulse signal STH as well as to output 176-bits sampling pulse signals SP1-SP176. In synchronizing with the clock signal CLK1 which is delayed by a predetermined time from the clock signal CLK, the data buffer 13 holds the 18-bits display data D00-D05, D10-D15 and D20-D25 for a time period corresponding to a single pulse width of the clock signal CLK1, and then outputs the 18-bits display data D'00-D'05, D'10-D'15 and D'20-D'25 which are then supplied to the data register 14.

In synchronizing with the 176-bits sampling pulse signals SP1-SP176 supplied from the shift register 12, the data register 14 accepts series inputs of the 18-bits display data D'00-D'05, D'110-D'15 and D'20-D'25 as the 6-bits display data PD1, PD2, - - - PD528. In synchronizing with the rising edge of the strobe signal STB1, the data latch 85 accepts simultaneous inputs of the 6-bits display data PD1, PD2, - - - PD528, so that the latch circuits 51-1, 51-2, 51-3, - - - 51-528 in the data latch 85 respectively hold the 6-bits display data PD1, PD2, - - - PD528 for a single horizontal synchronizing time period. The 6-bits display data PD1, PD2, - - - PD528 are then supplied through the switches 86-1*a*, 86-2*a*, 86-3*a*, - - - , 86-528*a* in the switching circuits 86-1, 86-2, 86-3, - - - , 86-528 to the level shifters 52-1, 52-2, 52-3, - - - , 52-528, respectively if the partial display signal PM is low level "L".

The level shifters 52-1, 52-2, 52-3, - - - 52-528 perform respective voltage conversion operations from 3V to 5V of the 6-bits display data PD1, PD2, - - - PD528. If the polarity signal POL is high level "H", then the voltage-converted 6-bits display data PD1, PD2, - - - PD528 are transmitted through the switches 53-1*a*, 53-2*a*, 53-3*a*, - - - , 53-528*a* in the switching circuits 53-1, 53-2, 53-3, - - - , 53-528 and also through the inverters 54-1, 54-2, 54-3, - - - 54-528 to the inverters 55-1, 55-2, 55-3, - - - 55-528, whereby the voltage converted 6-bits display data PD1, PD2, - - - PD528 are outputted as the positive polarity 6-bits display data PD'1, PD'2, - - - PD'528.

If the partial display signal PM is low level "L" and the polarity signal POL is low level "L", then the 6-bits display data PD1, PD2, - - - PD528 are converted in voltage from 3V to 5V by the level shifters 52-1, 52-2, 52-3, - - - 52-528 respectively, and further the voltage converted 6-bits display data PD1, PD2, - - - PD528 are inverted. The inverted 6-bits display data PD1, PD2, - - - PD528 are then transmitted through the switches 53-1*b*, 53-2*b*, 53-3*b*, - - - 53-528*b* in the switching circuits 53-1, 53-2, 53-3, - - - 53-528, and through the inverters 54-1, 54-2, 54-3, - - - 54-528 to the inverters 55-1, 55-2, 55-3, - - - 55-528, whereby the inverted 6-bits display data PD1, PD2, - - - PD528 are outputted as the negative polarity 6-bits display data PD'1, P'2, - - - PD'528.

If the partial display signal PM is high level, then the switches 86-1*a*, 86-2*a*, 86-3*a*, - - - , 86-528*a* turn OFF, whilst the switches 86-1*b*, 86-2*b*, 86-3*b*, - - - , 86-528*b* turn ON. The 6-bits display data PD1, PD2, - - - PD528 outputted from the latch circuits 51-1, 51-2, 51-3, - - - 51-528 are not transmitted to the level shifters 52-1, 52-2, 52-3, - - - 52-528. The monochrome signal BW1 from the control circuit 84 is transmitted through the switches 86-1*b*, 86-2*b*, 86-3*b*, 86-528*b* to the level shifters 52-1, 52-2, 52-3, - - - 52-528. Since the monochrome signal BW1 is low level "L", voltage conversion operations by the level shifters 52-1, 52-2, 52-3, - - - 52-528 unchange the monochrome signal BW1 at low level "L".

If the partial display signal PM is high level and the polarity signal POL is high level "H", then the switches 53-1*b*, 53-2*b*, 53-3*b*, - - - , 53-528*b* turn OFF, whilst the switches 53-1*a*, 53-2*a*, 53-3*a*, - - - , 53-528*a* turn ON, whereby the outputs from the level shifters 52-1, 52-2, 52-3, - - - 52-528 are transmitted through the switches 53-1*a*, 53-2*a*, 53-3*a*, - - - , 53-528*a* and also through the inverters 54-1, 54-2, 54-3, - - - 54-528 to the inverters 55-1, 55-2, 55-3, - - - 55-528, whereby the 6-bits display data PD1, PD2, - - - PD528 are outputted as the positive polarity 6-bits display data PD'1, PD'2, - - - PD'528.

If the partial display signal PM is high level and the polarity signal POL is low level "L" then the switches 53-1*b*, 53-2*b*, 53-3*b*, - - - , 53-528*b* turn ON, whilst the switches 53-1*a*, 53-2*a*, 53-3*a*, - - - , 53-528*a* turn OFF, whereby the outputs from the level shifters 52-1, 52-2, 52-3, - - - 52-528 are transmitted through the switches 53-1*b*, 53-2*b*, 53-3*b*, - - - , 53-528*b* and also through the inverters 54-1, 54-2, 54-3, - - - 54-528 to the inverters 55-1, 55-2, 55-3, - - - 55-528, whereby the 6-bits display data PD1, PD2, - - - PD528 are outputted as the negative polarity 6-bits display data PD'1, PD'2, - - - PD'528. The data latch 85 supplies most significant bits MSB1, MSB2, - - - MSB528 of the display data PD'1, PD'2, - - - PD'528 to the output circuit 47, wherein the most significant bits MSB1, MSB2, - - - , MSB528 are respective most significant bits of the 6-bits display data PD'1, PD'2, - - - PD'528.

The subsequent operations of the data electrode driver circuit 82 to the above descriptions are the same as described in the first embodiment with reference to the data electrode driver circuit 42. Duplicate descriptions of the subsequent operations of the data electrode driver circuit 82 will be omitted.

If the plural scanning signal PC supplied from the control circuit 81 is high level "H", then at the timing of the vertical start pulse signal STV from the control circuit 81, the scanning electrode driver circuit 83 performs discontinuous generation operations of the scanning signals which are then simultaneously supplied to a predetermined set of the scanning electrodes of the color liquid crystal display 1.

The center region of the display screen of the color liquid crystal display 1 displays "white" independent from the externally supplied red data $D_R$, green data $D_G$, and blue data $D_B$. Since the color liquid crystal display 1 is of the normally white type, no voltages are applied to the data electrodes which correspond to the center region of the display screen of the color liquid crystal display 1. No voltage applications result in a desirable reduction of the power consumption.

The scanning electrode driver circuit 83 simultaneously applies the same scanning signal to the predetermined set of the plural scanning electrodes of the color liquid crystal display 1. This causes a substantive reduction in scanning frequency, resulting in a further desirable reduction of the power consumption.

The following descriptions are concerned with some examples of possible modifications to the above-described first and second embodiments.

Although the above-described first and second embodiments have been silent on the resolution of the color liquid crystal display 1 and on the size of the display screen, the resolution and the size are optional. The application of the present invention to conditions, that the display screen size is 12-13 inches or less and no remarkable flicker appears even in the line-inversion driving method or the frame-inversion driving method would particularly be effective.

In the above-described first and second embodiments, based on the power saving mode signal PS, the color mode signal CM is fixed low level "L" or high level "H" with reference to the vertical start pulse signal STV. If the color mode signal CM is fixed low level "L", then an entirety of the display region of the display screen is the 8-color mode. If the color mode signal CM is fixed high level "H", then an entirety of the display region of the display screen is the full-color mode. These are mere examples.

Figure 22:
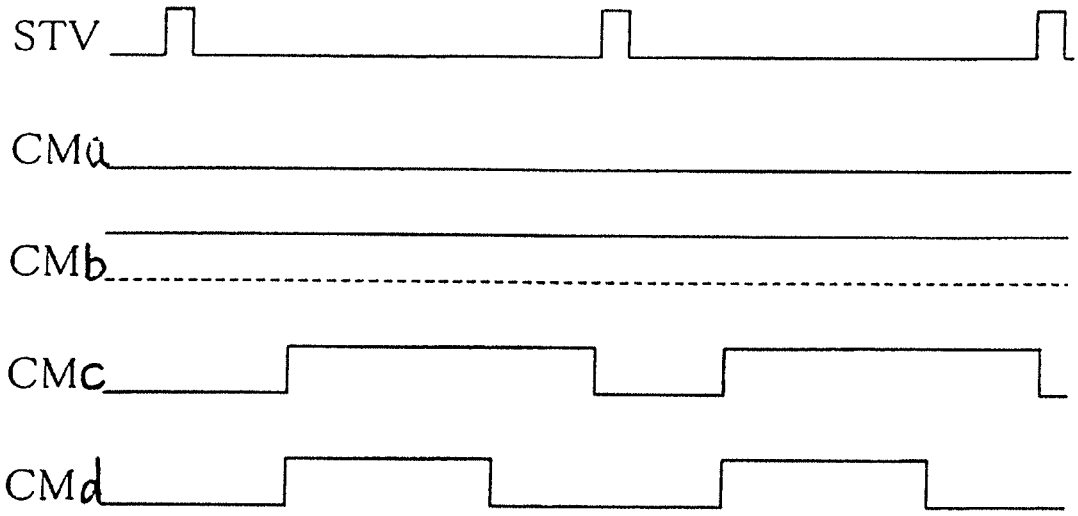
FIG. 22 is a timing chart illustrative of four possible modifications to waveforms of the four color mode signals CMa, CMb, CMc and CMd with reference to the vertical start pulse signal STV.
Figure 23:
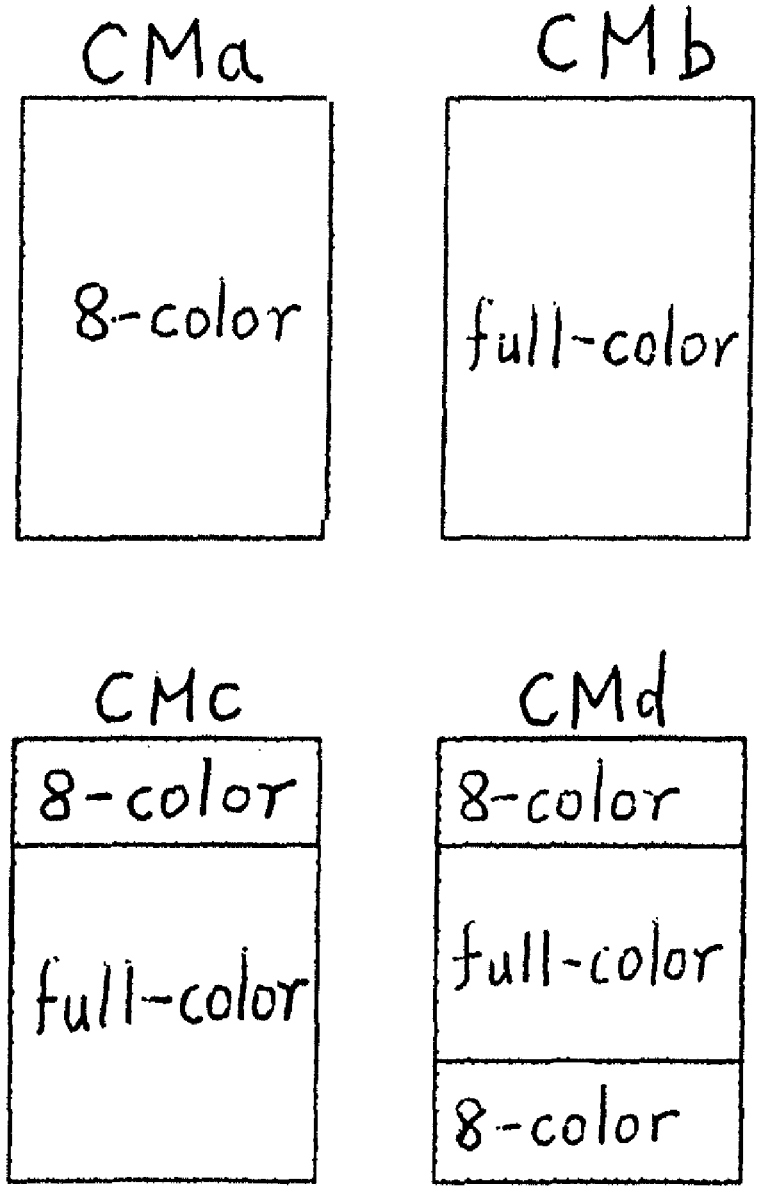
FIG. 23 is a view illustrative of corresponding four display states of the display screen to the four color mode signals CMa, CMb, CMc and CMd shown in FIG. 22.

FIG. 22 is a timing chart illustrative of four possible modifications to waveforms of the four color mode signals CMa, CMb, CMc and CMd with reference to the vertical start pulse signal STV. FIG. 23 is a view illustrative of corresponding four display states of the display screen to the four color mode signals CMa, CMb, CMc and CMd shown in FIG. 22. If the color mode signal CMa is fixed at low level "L" with reference to the vertical start pulse signal STV, then the display screen is entirely displayed in the 8-color mode. If the color mode signal CMb is fixed at high level "H" with reference to the vertical start pulse signal STV, then the display screen is entirely displayed in the full-color mode.

If the color mode signal CMc varies with reference to the vertical start pulse signal STV as shown in FIG. 22, then the upper region of the display screen is displayed in the 8-color mode, whilst the remaining center and lower regions of the display screen are displayed in the full-color mode. If the color mode signal CMd varies with reference to the vertical start pulse signal STV as shown in FIG. 22, then the upper region and the lower region of the display screen are displayed in the 8-color mode, whilst the remaining center region of the display screen is displayed in the full-color mode.

Although the above-described first and second embodiments are silent on further issues of input timings of the power saving mode signal PS and the partial display mode signal PI into the control circuit 81, these timings are optional. It is, for example, possible that the timings are decided depending on residual charge amount of the battery of the electronic device.

In the above-described first and second embodiments, the color liquid crystal display 1 is of the normal white type. The present invention is also applicable to the normal black type color liquid crystal display. In this case, "black" is compulsorily displayed on other region than the region for displaying the essential characters and marks.

In the above-described first and second embodiments, the display in the power saving mode is made in 8-colors, wherein the most significant bit signals are used. It is also possible that the display may be made in 16-colors or 32-colors in the power saving mode. In the 16-color mode, the most significant bit signals and second most significant bit signals are used. In the 32-color mode, the most significant bit signals, second most significant bit signals and third most significant bit signals are used.

In the above-described second embodiment, the partial display mode is utilized in the power saving 8-color mode. It is also possible that the partial display mode is utilized in the full-color mode.

In the above-described first and second embodiments, the gray scale voltage generating circuit 45 has the circuit configuration as shown in FIG. 13. Various modifications to the circuit configuration are available. For example, the gray scale voltage generating circuit may comprise a first resistance group including plural resistances for generating positive polarity first to sixty fourth gray scale voltages V1, V2, V3, - - - V64, and a second resistance group including other plural resistances for generating negative polarity first to sixty fourth gray scale voltages V1, V2, V3, - - - V64. If the power saving mode signal PS is low level "L", then either opposite sides of the first resistance group or opposite sides of the second resistance group are biased between the power voltage VDD and the ground voltage GND based on the positive and negative switching signals Sswp and Sswn to generate positive polarity or negative polarity first to sixty fourth gray scale voltages V1, V2, V3, - - - V64. If the power saving mode signal PS is high level "H", then both opposite sides of the first resistance group and opposite sides of the second resistance group are not biased between the power voltage VDD and the ground voltage GND independent from the positive and negative switching signals Sswp and Sswn to generate no gray scale voltages.

The driver circuit as described above is thus suitable for various portable electronic devices having the liquid crystal display with a relatively small display screen, for example, note-type computers, palm-type computers, pocket-type computers, mobile terminals such as personal digital assistants, mobile phones, and personal handy-phone systems.

In the power saving mode, voltages corresponding to highly significant bit signals of the image display data are applied as the display data signals to the data electrodes of the color liquid crystal display, in order to reduce the power consumption in the line-inversion driving system or the frame-inversion driving system.

Although the invention has been described above in connection with several preferred embodiments therefor, it will be appreciated that those embodiments have been provided solely for illustrating the invention, and not in a limiting sense. Numerous modifications and substitutions of equivalent materials and techniques will be readily apparent to those skilled in the art after reading the present application, and all such modifications and substitutions are expressly understood to fall within the true scope and spirit of the appended claims.

What is claimed is:

1. A method of driving a color display having a driving circuit for driving data electrodes of a displaying device, wherein in normal driving mode, gray scale signals corresponding to all bit signals of an image display data are output to the data electrodes via an output amplifier, and wherein in power saving mode, gray scale signals corresponding to highly significant bit signals of the image display data are output to the data electrodes without the output amplifier.

2. The method as claimed in claim 1, wherein said power saving mode includes an essential information display mode, where a predetermined uniform voltage level, which corresponds to a predetermined color and which is independent from said image display data, is uniformly applied to all data electrodes on other region than at least a designated region for displaying the essential information.

3. The method as claimed in claim 2, wherein said color display is of normally white type, and said predetermined color is white.

4. The method as claimed in claim 2, wherein said color display is of normally black type, and said predetermined color is black.

5. The method as claimed in claim 2, wherein a uniform scanning signal is simultaneously applied to all scanning electrodes on other region than said at least designated region for displaying the essential information.

6. The method as claimed in claim 1, wherein at least a full color display region in said color display is displayed in said normal driving mode, and wherein at least a partial color display region in said color display is displayed in said power saving mode.

7. The method as claimed in claim 1, wherein said power saving mode further inactivates a gray scale voltage generating circuit and a polarity selecting circuit.

8. The method of driving a color display of claim 1 further comprising the steps of:

generating a plurality of scanning signals by a scanning electrode driver circuit;

applying sequentially said plurality of scanning signals to a plurality of scanning electrodes in the color display by controlling said scanning electrode circuit;

applying sequentially data signals to a plurality of data electrodes by controlling a data electrode driving circuit.

9. The method of driving a color display of claim 8 wherein said voltages corresponding to highly significant bit signals of said image display data are selected to values which are high voltages different from a power voltage for driving said data electrode driving circuit or low voltages different from a grounded voltage and are applied to a corresponding data electrode as said data signals.

10. The method of driving a color display of claim 1, wherein said highly significant bit signals are a plurality of most significant bits of the image display data.

* * * * *